US006536895B2

(12) United States Patent
Kashiwagi et al.

(10) Patent No.: US 6,536,895 B2
(45) Date of Patent: Mar. 25, 2003

(54) INK-JET PRINTER

(75) Inventors: Takashi Kashiwagi, Mishima (JP); Hiroshi Yamaguchi, Numazu (JP); Shinichiro Fujii, Mishima (JP); Juntaro Oku, Numazu (JP); Masaaki Oyaide, Shizuoka-ken (JP); Hitoshi Ushiogi, Mishima (JP); Tadao Kamano, Shizuoka-ken (JP); Sakae Shiida, Numazu (JP); Hidenobu Suzuki, Numazu (JP); Yasuhiro Suzuki, Numazu (JP); Akira Sato, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/850,775

(22) Filed: May 8, 2001

(65) Prior Publication Data

US 2001/0028381 A1 Oct. 11, 2001

Related U.S. Application Data

(62) Division of application No. 09/152,115, filed on Sep. 3, 1998, now Pat. No. 6,247,809, which is a continuation of application No. PCT/JP98/00037, filed on Jan. 8, 1998.

(30) Foreign Application Priority Data

| | | |
|---|---|---|
| Jan. 8, 1997 | (JP) | 9-001200 |
| Jan. 8, 1997 | (JP) | 9-001201 |
| Jan. 8, 1997 | (JP) | 9-001202 |
| Jan. 8, 1997 | (JP) | 9-001206 |
| Jan. 8, 1997 | (JP) | 9-001207 |
| Jan. 8, 1997 | (JP) | 9-001208 |
| Mar. 12, 1997 | (JP) | 9-057541 |
| Mar. 12, 1997 | (JP) | 9-057626 |
| Feb. 12, 1997 | (JP) | 9-027772 |

(51) Int. Cl.[7] ..... B41J 2/01
(52) U.S. Cl. ..... 347/104; 347/101
(58) Field of Search ..... 347/100, 101, 347/104, 74; 399/303, 397; 346/138

(56) References Cited

U.S. PATENT DOCUMENTS

| | | | | |
|---|---|---|---|---|
| 4,442,439 A | * | 4/1984 | Mizuno | 347/55 |
| 5,081,488 A | * | 1/1992 | Suzuki | 355/200 |
| 6,048,060 A | * | 4/2000 | Narushima et al. | 347/104 |

FOREIGN PATENT DOCUMENTS

| | | | | |
|---|---|---|---|---|
| JP | 56-169964 | | 12/1981 | |
| JP | 61-217268 | | 9/1986 | |
| JP | 2-133355 | | 11/1990 | |
| JP | 4-31070 | | 2/1992 | |
| JP | 4-193538 | | 7/1992 | |
| JP | 4-197766 | | 7/1992 | |
| JP | 8-174946 | | 7/1996 | |
| JP | 08-282039 | | 10/1996 | |
| JP | 10-138588 | * | 5/1998 | B41J/13/08 |

OTHER PUBLICATIONS

Electric Circuits by J. Richard Johnson Chapter 3 (1984) p.: 46–49.*

Patent Abstracts of Japan, vol. 005, No. 135 (M–085), Aug. 27, 1981 and JP 56–069172 A (Ricoh Co. Ltd.), Jun. 10, 1981—Abstract.

* cited by examiner

*Primary Examiner*—Anh T. N. Vo
*Assistant Examiner*—Manish S. Shah
(74) *Attorney, Agent, or Firm*—Frishauf, Holtz, Goodman & Chick, P.C.

(57) ABSTRACT

An ink-jet printer includes a rotary drum 10, having a dielectric peripheral surface 11, for rotating at a constant speed, a sheet loader 90 for loading a sheet to the rotary drum 10, a sheet holding system for causing the sheet to be held on the peripheral surface 11 of the rotary drum 10, and a print head section 200 for printing an image on the sheet held on the peripheral surface 11 of the rotary drum 10 by jetting ink to the sheet while the rotary drum 10 makes a predetermined number of rotations. Particularly, the sheet holding system includes a charging section 20 and a supplementary charger section 26. The charging section 20 is charges the peripheral surface 11 of the rotary drum 10 on an upstream side of the loading point where the leading end of the sheet loaded by the sheet loader 90 contacts the peripheral surface 11 of the rotary drum 10. The supplementary charger section 26 charges the sheet to supplement the electrostatic attraction force attenuated during the rotation of the rotary drum 10.

17 Claims, 20 Drawing Sheets

INK-JET PRINTER

CROSS-REFERENCE TO RELATED APPLICATIONS

This is a Division of U.S. Ser. No. 09/152,115, filed on Sep. 3, 1998, allowed on Feb. 7, 2001, now U.S. Pat. No. 6,247,809, which is a Continuation of International application PCT/JP98/00037 (not published in English) filed Jan. 8, 1998.

BACKGROUND OF THE INVENTION

The present invention relates to an ink-jet printer which performs printing by jetting ink onto a sheet of paper which is held on a rotary drum as a print medium.

High-performance and low-cost personal computers are easily available in recent years, and have come into wide use. In accordance with this, the demand for color printers is also increasing. A variety of ink-jet printers have been developed as personal-use color printers.

Conventionally, an ink-jet printer capable of printing 500 sheets or more successively is known. This ink-jet printer comprises a rotary drum which rotates at a constant circumferential speed, and a print head which jets color inks onto a sheet held on the peripheral surface of the rotary drum. The sheet is fed toward the rotary drum from the front side thereof, and printing is performed when the sheet is wound around the rotary drum. After printing, the sheet is removed from the rotary drum and discharged to the rear side of the rotary drum.

The print head is made up of nozzle units for yellow, cyan, magenta and black, which are arranged along the peripheral surface of the rotary drum. Each nozzle unit has a plurality of ink-jet nozzles which are arranged across the sheet in the main scanning direction parallel to the axis of the rotary drum) and jets ink with the rotation of the drum. Each nozzle unit is shifted in the main scanning direction at a constant rate each time the rotary drum makes one rotation, and returned to an original position after a predetermined number of rotations which cause the nozzle unit to be moved by a distance equal to the nozzle pitch. Each nozzle unit performs printing of the whole sheet by jetting in the main scanning direction and the sub-scanning direction perpendicular to the main scanning direction as described above. During this printing, the sheet is held on the rotary drum with electrostatic attraction, negative-pressure suction and mechanical clamping, taken singly or in combination.

The utilization of the electrostatic attraction is most advantageous in providing a small-sized ink-jet printer. Where the electrostatic attraction is utilized, a charger is provided to charge the sheet by applying electrostatic charges. The charger is formed to perform charging in a non-contact manner that the charger does not contact the sheet, in a contact manner that the charger contacts the sheet, or in a combination of these manners. In general, interference with the sheet or the peripheral surface of the rotary drum can be avoided in the non-contact manner, although a high charging efficiency cannot be obtained since the charger indirectly charges the sheet with a use of the rotary drum. On the other hand, a high charging efficiency in the contact manner since the charger is brought into contact with the sheet and mechanically presses the sheet against the rotary drum.

However, the contact manner requires measures for preventing the charger from interfering with the sheet and the peripheral surface of the rotary drum. In addition, the contact manner requires a sequence control of synchronizing the operation of the charger with the timing at which the sheet is fed to the rotary drum. Moreover, electrostatic charges are applied to the sheet's obverse side which is brought into contact with the charger. This being so, if the sheet is relatively thick, the electrostatic charges do not serve to produce electrostatic attraction on the sheet's reverse side which contacts the rotary drum. As a result, the substantial charging efficiency is decreased. In each of the contact and non-contact manners, electrostatic attraction attenuates due to leakage of electrostatic charges which occurs upon ejection of ink while the sheet is rotated along with the rotary drum. This phenomenon leads to the jamming of sheets or the alignment error of color dots.

BRIEF SUMMARY OF THE INVENTION

An object of the present invention is to provide an ink-jet printer in which a print medium can be reliably and securely held on a rotary drum without requiring a complicated structure.

According to the present invention, there is provided an ink-jet printer which comprises: a rotary drum, having a dielectric peripheral surface, for rotating at a constant speed; a medium supply section for feeding a print medium to the rotary drum; a medium holding system for causing the print medium to be held on the peripheral surface of the rotary drum; and a print head section for printing an image on the print medium by jetting ink onto the print medium held on the peripheral surface of the rotary drum while the rotary drum makes a predetermined number of rotations, wherein the medium holding system includes a first charger for charging the peripheral surface of the rotary drum on an upstream side of a loading point where the leading end of the print medium fed by the medium supply section is brought into contact with the peripheral surface, such that the print medium is held on the rotary drum by electrostatic attraction using an electrostatic attraction force obtained by the charging, and a second charger for charging the print medium to supplement the electrostatic attraction force attenuated during rotation of the rotary drum.

In the present ink-jet printer, the first charger charges the peripheral surface of the rotary drum before the print medium is fed to the rotary drum. Therefore, a desired electrostatic attraction force can be obtained without interfering with the print medium. Since the print medium is indirectly charged through the rotary drum, the charging efficiency is not decreased due to the thickness of the print medium.

In addition, the second charger charges the print medium to supplement the electrostatic attraction force attenuated during the rotation of the rotary drum. Therefore, the print medium can be reliably and securely held on the rotary drum.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

An ink-jet printer according to the first embodiment of the present invention will now be described with reference to FIGS. 1 to 4. The ink-jet printer is employed to print a multi-color image on a cut sheet M serving as a print medium. The sheet M is a plain paper sheet or an OHP sheet, for example.

Figure 1:
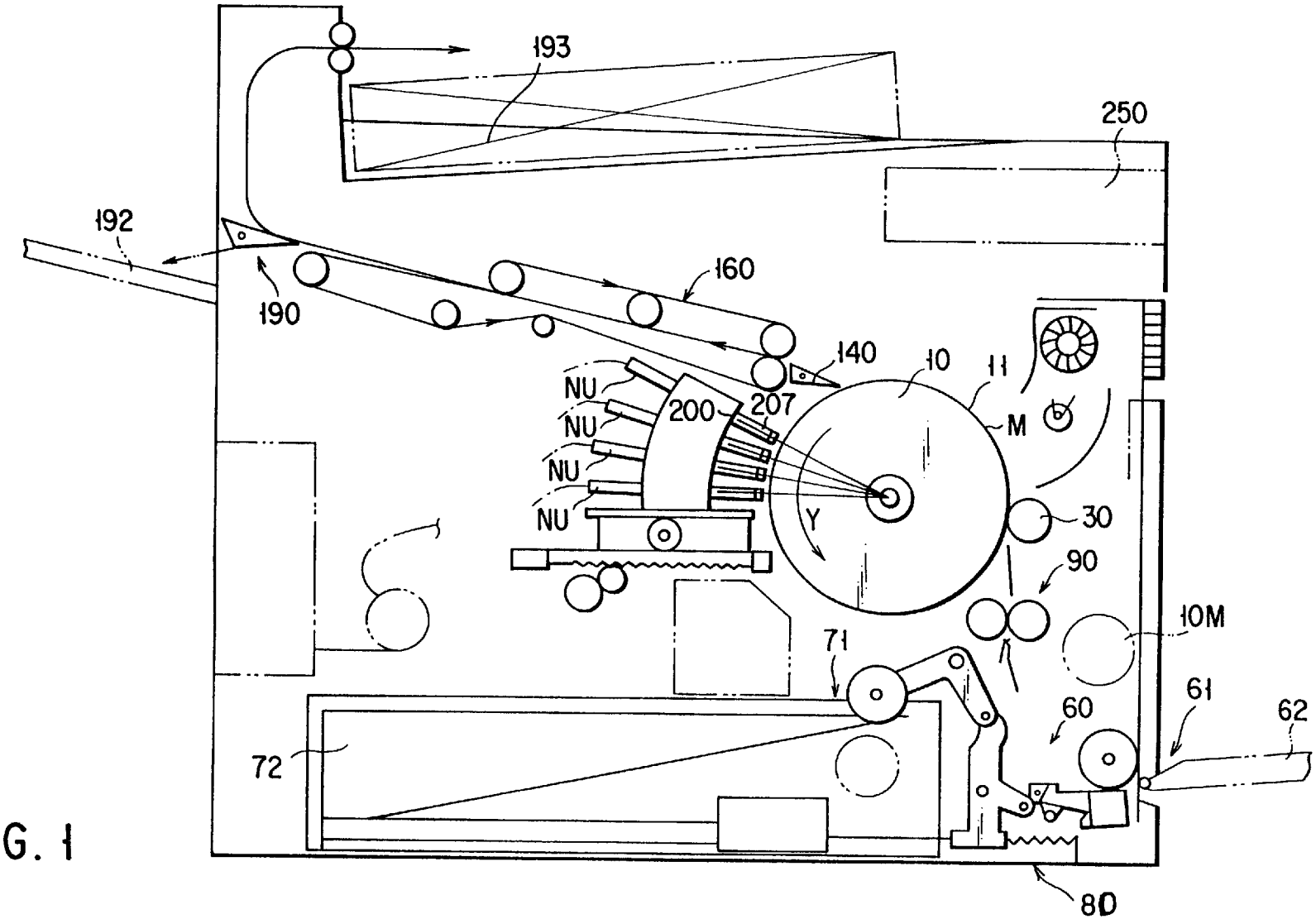
FIG. 1 is a view showing the internal structure of an ink-jet printer according to the first embodiment of the present invention.

FIG. 1 shows the internal structure of the ink-jet printer. The ink-jet printer comprises: a rotary drum 10 which rotates at a constant circumferential speed, together with a sheet M held thereon; a print head section 200 for printing a multi-color image on the sheet M which rotates together with the rotary drum; a manual feed tray 62 for receiving each of sheets M to be inserted one by one; a sheet cassette 72 for receiving a stack of sheets M; a sheet feed-in mechanism 60 for feeding each sheet M from the sheet cassette 72 and the manual feed tray 62 to the rotary drum 10; a sheet feed-out mechanism 160 for feeding out the sheet M printed at the rotary drum 10; and a control unit 250 for controlling the whole operation of the ink-jet printer. As shown in FIG. 1, the rotary drum 10 is arranged near the center position in the housing. The sheet tray 62 is located at the front of the housing and protrudes outward at a level lower than that of the rotary drum 10. The sheet cassette 72 is arranged below the rotary drum 10. The sheet feed-in mechanism 60 is located between the manual feed tray 62 and the sheet cassette 72. The print head section 200 is arranged behind the rotary drum 10. The sheet feed-out mechanism 160 is arranged above the print head section 200 behind the rotary drum 10.

The rotary drum 10 is supported such that it is rotatable with a shaft 15 as a central axis, and has a sheet holding system for holding the sheet M wound around the peripheral surface 11 of the drum 10 with the rotation of the drum. The rotational position of the rotary drum 10 is detected by a rotational position detector 10S disposed near the peripheral surface of the rotary drum 10. The print head section 200 is made up of four nozzle units NU which are arranged along the peripheral surface 11 of the rotary drum 10 to perform printing for the sheet M with yellow, magenta, cyan and black inks, and receives inks of different colors from four ink supply sections 210 arranged apart therefrom. Each nozzle unit NU has a plurality of ink-jet nozzles 207 arranged in the axial direction of the rotary drum 10 at a pitch PT, for example, of 1/75 inch to eject a corresponding color ink on the sheet M. The ink-jet nozzles 207 are arrayed to have a length corresponding to 210 mm, which is the width of the sheet M of the A4 size. The sheet feed-in mechanism 60 has a sheet loader 90 for loading the sheet M to the rotary drum 10 such that the width direction of the sheet M coincides with the axial direction of the rotary drum 10, a manual feeder 61 for picking up the sheet M from the manual feed tray 62 and feeding the sheet M to the sheet loader 90, a cassette feeder 71 for picking up the sheet M from the sheet cassette 72 and feeding the sheet to the sheet loader 90, and a feeder switching section 80 for driving one of the manual feeder 61 and the cassette feeder 71. The sheet loader 90 is controlled to feed the sheet M toward the rotary drum 10 when it is detected from a position detector 17 that the rotary drum 10 has reached a predetermined position by rotation. The sheet M is held on the peripheral surface 11 of the rotary drum 10 by the sheet holding system. The print head section 200 performs color printing for the sheet M during rotation of the rotary drum 10.

After the printing, the sheet M is removed from the peripheral surface 11 of the rotary drum 10 by a sheet separator 140 and fed in a preset direction by the sheet feed-out mechanism 160. The sheet separator 140 is a separation claw which is brought into contact with the rotary drum 10 at the time of sheet removal. A discharge switch 190 selectively guides the sheet M to one of a rear discharge tray 192 for discharging with a print surface facing upward or a upper discharge tray 193 for discharging with a print surface facing downward.

The print head section 200 reciprocally movable in the main scanning direction X parallel to the axial direction of the rotary drum 10, and also movable between a printing position adjacent to the rotary drum 10 and a standby position away from the printing position.

The rotary drum 10 rotates such that the sheet M wound around and held on the peripheral surface 11 thereof is moved in the sub-scanning direction Y perpendicular to the main scanning direction X to face the nozzle units NU. The rotary drum 10 is maintained at a constant rotation number of, e.g., 120 rpm and makes one rotation every 0.5 second in order to achieve multi-color printing of 20 ppm, for example. In the printing operation, the nozzle unit NU is shifted in the main scanning direction X at a constant rate of a ¼ nozzle pitch PT each time the rotary drum 10 makes one rotation so that it moves for the distance equal to the nozzle pitch PT while the rotary drum makes four rotations. With this structure, printing of the entire surface of the sheet M can be completed within two seconds (=0.5 sec.×4) required for the rotary drum 10 to make four rotations. Even considering a time required for one drum rotation of winding up the sheet M before the start of printing and one drum rotation of removing the sheet after printing, multi-color printing can be performed at a high speed of 3 (=2+1) seconds per A4 size sheet M. Therefore, printing of 20 sheets per minute can be performed successively.

The sheet loader 90 comprises at least one pair of loading rollers 91 and 92 extending in the axial direction of the drum, and is used to load each sheet M fed from the feeders 61 and 71 to the rotary drum 10 at a predetermined timing. The feed speed of the sheet M is set at a value corresponding to the circumferential speed of the rotary drum 10.

At least one of the loading roller 91 and 92 receives a rotating force applied from a main motor 10M constituting feed force applying section together with a gear train, a clutch, and the like. The main motor 10M drives the loading rollers 91 and 92 under the control of the control unit 250, and causes the sheet M to be fed toward the rotary drum 10. The rotary drum 10 is rotated by a driving force which is provided by the main motor 10M and transmitted to a shaft 15 through a timing belt and gears. The main motor 10M is made of a servo motor that has quick-response and constant-speed characteristics. The shaft of the rotary drum 10 is earth-grounded through a grounding line 19. Since the diameter of the rotary drum 10 is 130 mm, the circumferential speed of 816 mm/sec=120 πd/60 is obtained. The peripheral surface 11 of the rotary drum 10 has a width of about 220 mm in the axial direction, and a length of 408 mm (=πd) in the rotational direction. Accordingly, the rotary drum 10 can satisfactorily hold an A4 size sheet M, which has a length of 297 mm and a width of 210 mm.

The control unit 250 includes a CPU, a ROM, a RAM, a keyboard, a display unit, a timepiece circuit, an input and output port, etc. The control unit 250 is connected to the main motor 10M, the sheet loader 90, a roller position controller 95, a charger section 20, a roller position controller 29, a supplementary charger section 26, an electric discharge section 70, the print head section 200, the sheet separator 140, the rotational position detector 10S, a sheet sensor 97, another sheet sensor 98, etc. When the rotational position detector 10S detects that the rotary drum 10 is at the predetermined rotational position, the sheet loader 90 is driven by the driving force from the main motor 10M under the control of the control unit 250, so that the sheet M is fed to the rotary drum 10.

The sheet holding system comprises: a charger section 20 capable of applying the rotary drum 10 with electric charges in a non-contact manner before the leading end of a sheet M fed from the sheet loader 90 contacts the peripheral surface 11 of the rotary drum 10, which is rotated at a constant circumferential speed in the Y direction indicated in FIG. 1; and a supplementary charger section 26 for providing an additional electrostatic attraction force to the sheet M which is held on the peripheral surface 11 of the drum by the electrostatic attraction force from the charger section 20, such that the electrostatic attraction force is supplemented by an amount attenuated during rotation. The rotary drum 10 includes a dielectric layer 12 constituting the peripheral surface 11 and having a resistance in the range of $1\times10^{12}$ to $1\times10^{20}$ Ω·cm. In the present embodiment, the dielectric layer 12 is made of a Mylar (polyester film) sheet which is firmly adhered to the rotary drum 10 as the peripheral surface 11. The peripheral surface 11 has a groove section 13 into which the tip end of the sheet separator 140 is temporarily inserted.

The charger section 20, the sheet loader 90, an insulating roller 30, the supplementary charger section 26, the electric discharge section 70, the sheet separator 140, and the print head section 200 are sequentially arranged in the Y direction along the peripheral surface of the rotary drum 10. The charger section 20 is made of a corona charger 21, and the supplementary charger section 26 and the electric discharge section 70 are each made of a corona discharger.

Figure 2:
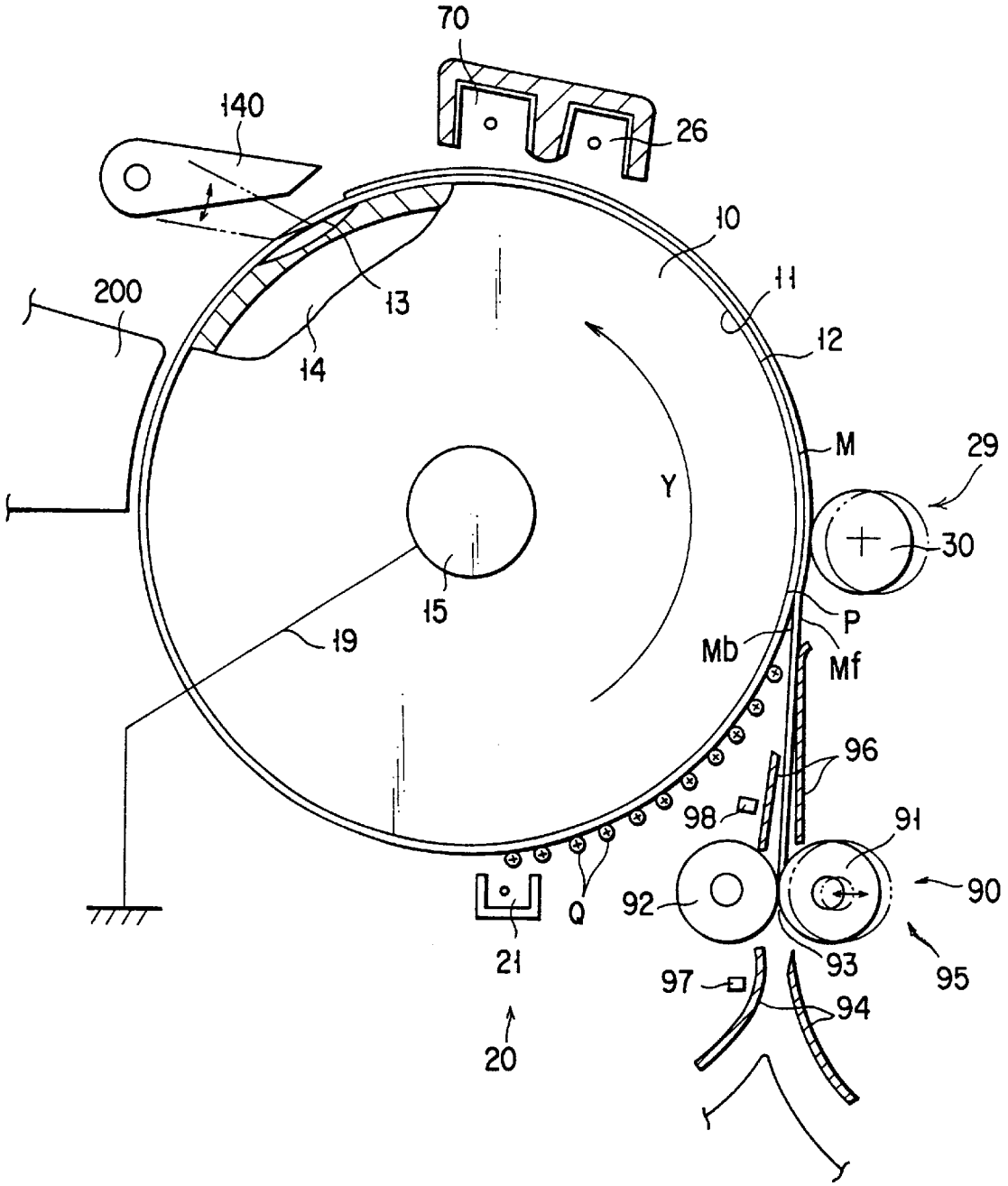
FIG. 2 is a view showing the structure of a sheet holding system which causes a sheet to be held on the rotary drum shown in FIG. 1.

As shown in FIG. 2, the charger section 20 is located on an upstream side of a loading point where the leading end of the sheet M fed by the sheet loader 90 is brought into contact with the peripheral surface, and charges the peripheral surface 11 of the rotary drum 10 by applying positive charges Q to the peripheral surface 11 in the non-contact manner before the sheet M is loaded. That is, the positive charges Q are applied to the surface of the dielectric layer 12 having a high resistance. As a result, the hold surface Mb on the reverse side of the sheet M is charged to have negative charges by electrostatic induction, thereby creating an electrostatic attraction force between the dielectric layer 12 and the sheet M. Therefore, where the sheet M is relatively thick, the substantial charging efficiency is more improved than that of the case where the print surface Mf on the observe side of the sheet M is charged by direct contact.

In addition, the sheet M held by an electrostatic attraction force and the neighboring structural components 90, 30, 22, 70, 140, etc. are not interfered with. Moreover, the control operation can be facilitated since the sequence adjustment between the sheet loader 90 and the loading timing needs not be performed in an extremely short period of time.

The supplementary charger section 26 charges the sheet M to supplement the electrostatic attraction force attenuated while the rotary drum 10 rotates in association with the operation of the print head section 200. Since this charging operation is performed in the non-contact manner, like the charging by the charger section 20, the print surface Mf of the sheet M is charged. To be more specific, the corona discharger of the supplementary charger section 26 discharges negative charges upon application of a voltage of e.g., −4 (+2, −2) KV, to maintain the electrostatic attraction force constant.

The loading rollers 91 and 92 are used not only for loading the sheet M to the rotary drum 10 but also for making posture adjustment of the sheet M and for performing a feed standby control. The leading end of the sheet M fed from the lower side, as viewed in FIG. 2, collide with the contact portions 93 of the loading rollers 91 and 92, and is elastically deformed inside a guide 94. Therefore, the leading end of the sheet M is aligned in parallel with the shaft 15 of the rotary drum 10, and in this state the sheet M can be loaded to the rotary drum 10 without skewing. Inside the guide 94, the elastically recovering force of the sheet M promotes the posture adjustment. The sheet sensor 97 detects that the sheet M has reached the posture adjustment position.

After completion of the posture adjustment, the loading rollers 91 and 92 feed the sheet M toward the rotary drum 10 along a guide 96 until the leading end of the sheet M comes to the position detectable by the sheet sensor 98. Since the leading end of the sheet M is pinched by the loading rollers 91 and 92, the trailing end of the sheet M can be released from the cassette feeder 71 or the manual feeder 61 located under the guide 94. After the preparation for loading the sheet M, the sheet loader 90 is set in a standby state where the sheet M can be loaded to the rotary drum 10 at any time. Since the previous feeding of the sheet M is completed before it is loaded to the rotary drum 10 at appropriate timings, the printing speed can be further increased.

In FIG. 2, "P" represents the loading point where the sheet M is brought into contact with the peripheral surface 11 of the rotary drum 10. After the leading end of the sheet M reaches the loading point P, the roller position controller 95 in FIG. 3 moves the loading roller 91 to the position indicated by the two-dot-dash line in FIG. 2. Since the trailing end of the sheet M is released from the sheet loader 90, the sheet loader 90 does not impose any load to the rotary drum 10, which rotates together with the sheet M. The roller position controller 95 has a similar configuration to that of the roller position controller 29 described below.

The insulating roller 30 is arranged on a downstream side of the loading point and along the peripheral surface 11 of the rotary drum 10. The insulating roller 30 is disposed near the loading point such that the leading end of the sheet M loaded by the sheet loader 90 does not strike against it. After the leading end of the sheet M contacts the peripheral surface 11 of the rotary drum 10, the sheet M is pressed against the peripheral surface 11 of the rotary drum 10 by the insulating roller 30, which rotates in accordance with the rotation of the drum 10. By the roller position controller 29 shown in FIG. 3, the insulating roller 30 is switchable between the contact state indicated by the solid line in FIG. 2 and the separated state indicated by the two-dot-dash line in the same FIGURE. The insulating roller 30 is made of a rubber roller having a hardness of 20±5 degrees (JIS, A-scale). In this case, the sheet M can be brought into more stable contact with the peripheral surface 11 of the rotating roller 10 by increasing the nip width of the sheet M with pressure applied from the insulating roller 30. The above-described positioning of the insulating roller 30 is important to quickly press the leading end of the sheet M and securely hold it on the peripheral surface 11 by attraction after loading the sheet M.

Figure 3:
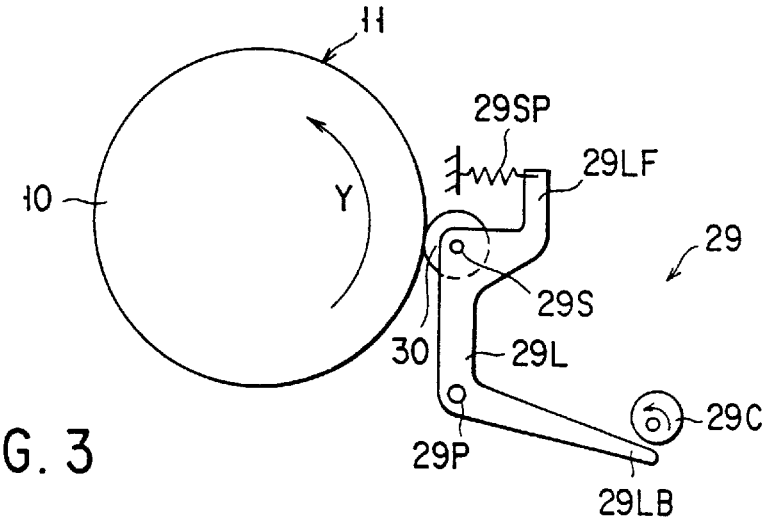
FIG. 3 is a view showing the structure of a roller position controller shown in FIG. 2.

As shown in FIG. 3, the roller position controller 29 is made up of a link lever 29L which is rotatable on a pin member 29P; a spring 29SP which pulls the upper end 29LF of the link lever 29L in the leftward direction, as viewed in FIG. 3; and an eccentric cam 29C which lowers the lower end 29LB of the link lever 29L in the downward direction, as viewed in FIG. 3, against the tension of the spring 29SP. The insulating roller 30 is rotatably coupled to the link lever 29L by means of a support shaft 29S in such a manner that the insulating roller 30 is driven by the rotation of the rotary drum 10.

In the state where the eccentric cam 29C does not move the lower end 29LB downward, the urging force (tension) of the spring 29SP serves to press the insulating roller 30 against the drum peripheral surface 11 or the sheet M with a predetermined pressure. When the eccentric cam 29C moves the lower end 29LB downward, the insulating roller 30 is separated from the drum peripheral surface 11.

The roller position controller 29 operates under the control of the control unit 250 described below. The roller position controller 29 advances the insulating roller 30 so that it moves closer to the peripheral surface 11 of the rotary drum 10, and retreats the insulating roller 30 so that it moves away from the peripheral surface 11. It is desirable that at least the advancing movement of the insulating roller 30 be effected at a timing which is immediately after the leading end of the sheet M contacts the peripheral surface 11.

The electric discharge section 70 is made of a corona discharger capable of applying an AC potential, and is capable of removing the charge attraction force present between the peripheral surface 11 and the sheet M before the mechanical separation made by the sheet separator 140.

The sheet separator 140 is arranged along the peripheral surface 11 of the rotary drum 10 and located on a downstream side of the electric discharge section 70. At appropriate timings, the sheet separator 140 temporarily enters the groove section 13 of the rotary drum 10 to mechanically separate the leading end of the sheet M from the peripheral surface 11 of the rotary drum 10. The sheet separator 140 is driven by a motor or a solenoid by use of a link mechanism or the like.

Figure 4:
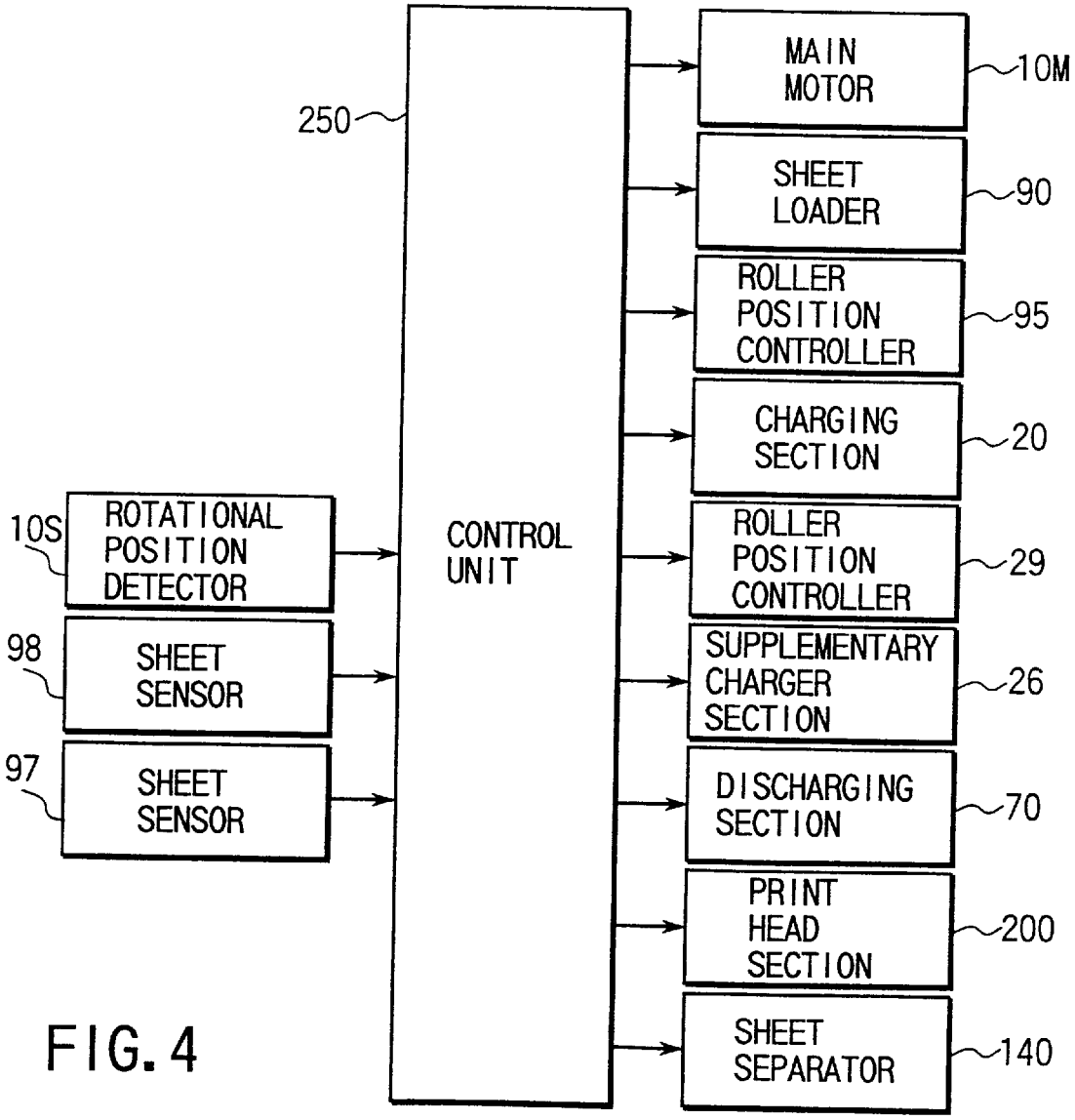
FIG. 4 is a block diagram illustrating a control unit shown in FIG. 1.

In the present embodiment, the control unit 250 in FIG. 4 enables rotation of the main motor 10M when the power supply is switched on. Since no sheet M is held by electrostatic attraction at the time, the charger section 20 is driven to apply negative charges to the peripheral surface 11 of the rotary drum 10. When the rotational position detector 10S detects that the rotary drum 10 has reached the predetermined rotational position (angle), the sheet loader 90 is driven to load the sheet M, which is then in the load standby state, toward the rotary drum 10 at a feed speed corresponding to the drum circumferential speed.

Before or after this operation (alternatively, concurrently therewith), the roller position controller 29 is driven so as to advance the insulating roller 30 from the position of the two-dot-dash line in FIG. 2 to the position of the solid-line line in the same FIGURE. In other words, this advancing movement is executed before the loading point P comes by rotation. The insulating roller 30 is pressed against the drum peripheral surface 11 with a certain pressure, due to the urging force (tension) of the spring 29SP.

Immediately thereafter, the sheet M is held on the peripheral surface 11 of the rotary drum 10 by electrostatic attraction using the electrostatic attraction force. In addition, the hold surface Mb of the sheet M can be charged from the time when the leading end of the sheet M loaded to the loading point P enters between the rotary drum 10 and the insulating roller 30.

After the holding operation of the leading end is completed (in the case of the present embodiment, an output signal from the rotational position detector is used for confirmation), the control unit 250 causes the roller position controller 95 to move one loading roller 91 of the sheet loader 90 to the position indicated by two-dot-dash line shown in FIG. 2. Accordingly, the trailing end of the sheet M is released from the loading rollers 91 and 92, no load is imposed to the rotation of the rotary drum 10. In addition, the hardness of the insulating roller 30 is within the range of 20±5 degrees, and insulating roller 30 is pressed against the dielectric layer 12, thus increasing the nip width.

In the manner described above, the sheet M is held on the drum peripheral surface 11 by electrostatic attraction using the electrostatic attraction force produced on the drum peripheral surface 11 by the charger section 20, is pressed tightly by the pressure provided by the insulating roller 30, and is rotated or moved in the Y direction in accordance with the rotation of the rotary drum 10. Since the insulating roller 30 is rotated by the drum 10, rolls out the sheet M from the leading end to the trailing end while simultaneously keeping tight contact with the peripheral surface 11, a reliable tight contact is ensured between the sheet M and the dielectric layer 12.

When the rotational position detector 10S detects (or confirms) that the trailing end of the sheet M has passed the insulating roller 30 during one rotation of the rotary drum 10, the insulating roller 30 is retreated to the two-dot-dash line position shown in FIG. 2 by the roller position controller 29, and is therefore separated from the sheet M. In other words, the insulating roller 30 is kept at the separated position when it does not have to be in contact with the sheet M. Accordingly, the sheet M is attracted and held on the drum peripheral surface 11 by the electrostatic attraction force alone, and is rotated in the Y direction.

While the rotary drum 10 makes four rotations (second to fifth rotations), ink is jetted from the print head section 200 to the sheet M. In the meantime, the supplementary charger section 26 operates to keep the electrostatic attraction force constant. The control unit 250 causes the sheet loader 90 to set the next sheet M in the standby condition.

Multi-color printing is executed with respect to a sheet (e.g., an A4 -size sheet) during four rotations of the rotary drum 10. After completion of this printing operation, the control unit 250 causes the electric discharge section 70 to remove the electrostatic attraction force present between the printed sheet M and the peripheral surface 11. The control unit 250 further causes the sheet separator 140 to mechanically separate the leading end of the printed sheet M. The separated sheet M is transferred from the sheet separator 140 to the sheet feed-out mechanism 160.

According to the present embodiment, the charger section 20 can provide the rotary drum 10 with electric charges in the non-contact manner before the leading end of a sheet M fed from the sheet loader 90 is brought into contact with the peripheral surface 11 of the rotary drum 10, which is rotated at a constant circumferential speed in one direction, and the supplementary charger section 26 provides an additional electrostatic attraction force for the sheet that is held on the peripheral surface 11 of the rotary drum by electrostatic traction using the electrostatic attraction force provided by the charger section 20, such that an attenuated amount of electrostatic attraction force is supplemented. Since the embodiment can provide the rotary drum 10 with electric charges in the non-contact manner and since the electrostatic attraction force attenuation occurring in accordance with the rotation of the held sheet can be compensated for, the substantial charging efficiency is high, and even a thick sheet can be held reliably and stably.

In addition, the dielectric layer 12 having a resistance in the range of $1\times10^{12}$ to $1\times10^{20}$ Ω·cm is formed on the peripheral surface 11 of the rotary drum 10, the shaft 15 is grounded, and the charging section 20 is made up of the corona discharger 21 for applying positive charges Q to the peripheral surface 11. Accordingly, the substantial charging efficiency is enhanced.

Moreover, the insulating roller 30 can press a sheet M against the peripheral surface of the rotary drum after the sheet M loaded from the sheet loader 90 contacts the peripheral surface 11 of the rotary drum 10. Since, therefore, the sheet can be brought into tight contact with the peripheral surface 11, the holding effect obtained by the electrostatic attraction force can be further enhanced. In addition, since the sheet M is mechanically rolled out from the leading end to the trailing end, the sheet can be uniformly held, and creases or the like can be prevented.

Since the insulating roller 30 can be brought into contact with the sheet M held on the rotary drum 10 or separated therefrom, the insulating roller 30 is prevented from interfering with the sheet M or other structural components.

The electric discharge section 70 is provided to cancel the electrostatic attraction force for causing the sheet M to be held on the peripheral surface 11 of the rotary drum 10. Since the electrostatic attraction force is removed before the separation of the sheet M, the held sheet can be easily separated.

The sheet separator 140 is arranged along the peripheral surface 11 of the rotary drum 10 and located on a downstream side of the electric discharge section 70. The sheet separator 140 mechanically separates the sheet from the peripheral surface 11. Therefore, the separation can be performed smoothly and swiftly immediately after the printing.

Since the insulating roller 30 can be driven in accordance with the rotation of the rotary drum 10, it does not become a great rotation load to the rotary drum 10, and therefore does not apply the sheet M with such a force as will leave wrinkles thereon. In addition, the insulating roller 30 serves to roll out the sheet M from the leading end to the trailing end, thus allowing the sheet M to be in tight contact with the drum peripheral surface 11.

In the advancing state, the roller position controller 29 presses the insulating roller 30 against the drum peripheral surface 11 by utilization of the urging force (tension) of the spring 29SP. Accordingly, the tight contact of the sheet M to the drum peripheral surface 11 is made stable and further improved.

Further, the sheet loader 90 has not only a sheet feed function but also a posture adjustment function and a supply standby function. Therefore, the sheet M can be fed to the rotary drum 10 without skewing and held on the drum 10. In addition, the preparations for loading the next sheet M can be made during the printing of the preceding sheet M. Accordingly, the held and rotated sheet M can be fed at high speed, and the printing can be performed at high speed.

The charger section 20, the sheet loader 90, the insulating roller 30, the supplementary charger section 26, the electric discharge section 70, the sheet separator 140 and the print head section 200 are arranged in the Y direction along the peripheral surface 11 of the rotary drum 10 in the order mentioned. With this arrangement, a series of the charging operation, the sheet loading operation, the sheet pressing operation and the charge supplementing operation can be performed swiftly and stably before printing. Likewise, a series of the charge canceling operation and the sheet separating operation can be performed swiftly and stably after printing.

Figure 5:
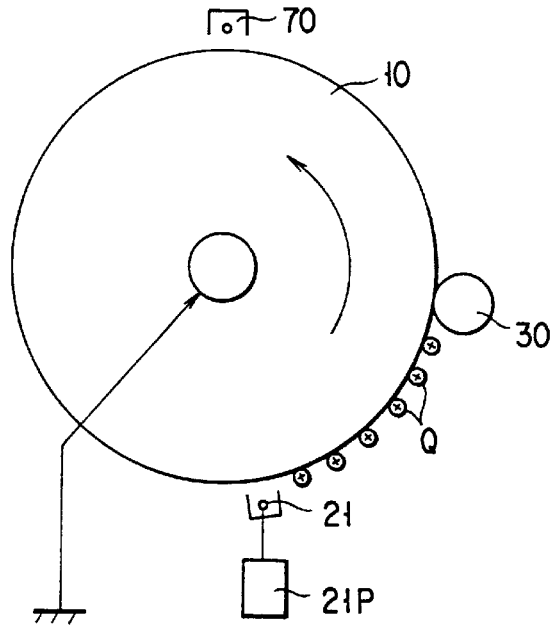
FIG. 5 is a view showing a modification of the sheet holding system shown in FIG. 2.

FIG. 5 shows a modification of the sheet holding system depicted in FIG. 2. According to this embodiment, the charger section 20 is made of a corona discharger 21 of a charge polarity variable type, so that the charger section 20 substantially includes a supplementary charger section 26. To be more specific, the control unit 250 increases the DC output voltage of the power supply unit 21P to enhance the charging efficiency before the sheet M is entirely attracted and held. After the sheet is attracted and held, the polarity of the DC output voltage switched, and the charge efficiency is improved with a low voltage.

The sheet holding system of the modification is advantageous in the same points as the system shown in FIG. 2. Moreover, the system of the modification enables a small-sized printer to be manufactured at low cost. Moreover, it enables a high degree of freedom at the time of layout.

An ink-jet printer according to the second embodiment of the present invention will now be described with reference to FIGS. 6 and 7.

The ink-jet printer comprises a charger roller 21 and an opposite polarity charging section 3. By means of these, the sheet M and the drum peripheral surface 11 are applied with charges opposite in polarity, so as to prevent a decrease in the electrostatic attraction force (i.e., an unstable state). Since the ink-jet printer has a substantially similar structure to that of the above-described embodiment, similar or corresponding structural components will be denoted by the same reference numerals as used above, and a description of such structural components will be omitted or simplified.

Figure 6:
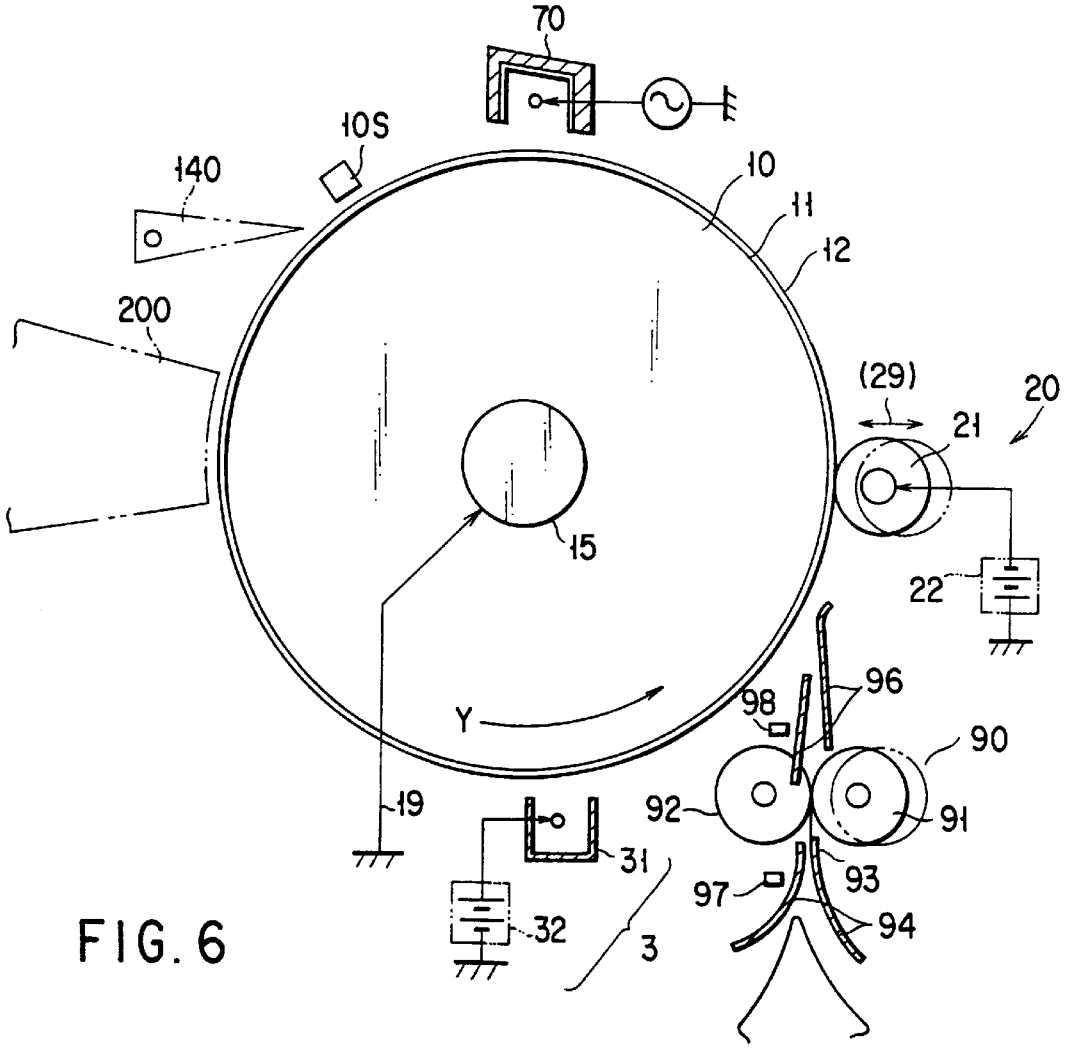
FIG. 6 is a view showing the structure of a sheet holding system incorporated in an ink-jet printer according to the second embodiment of the present invention.
Figure 7:
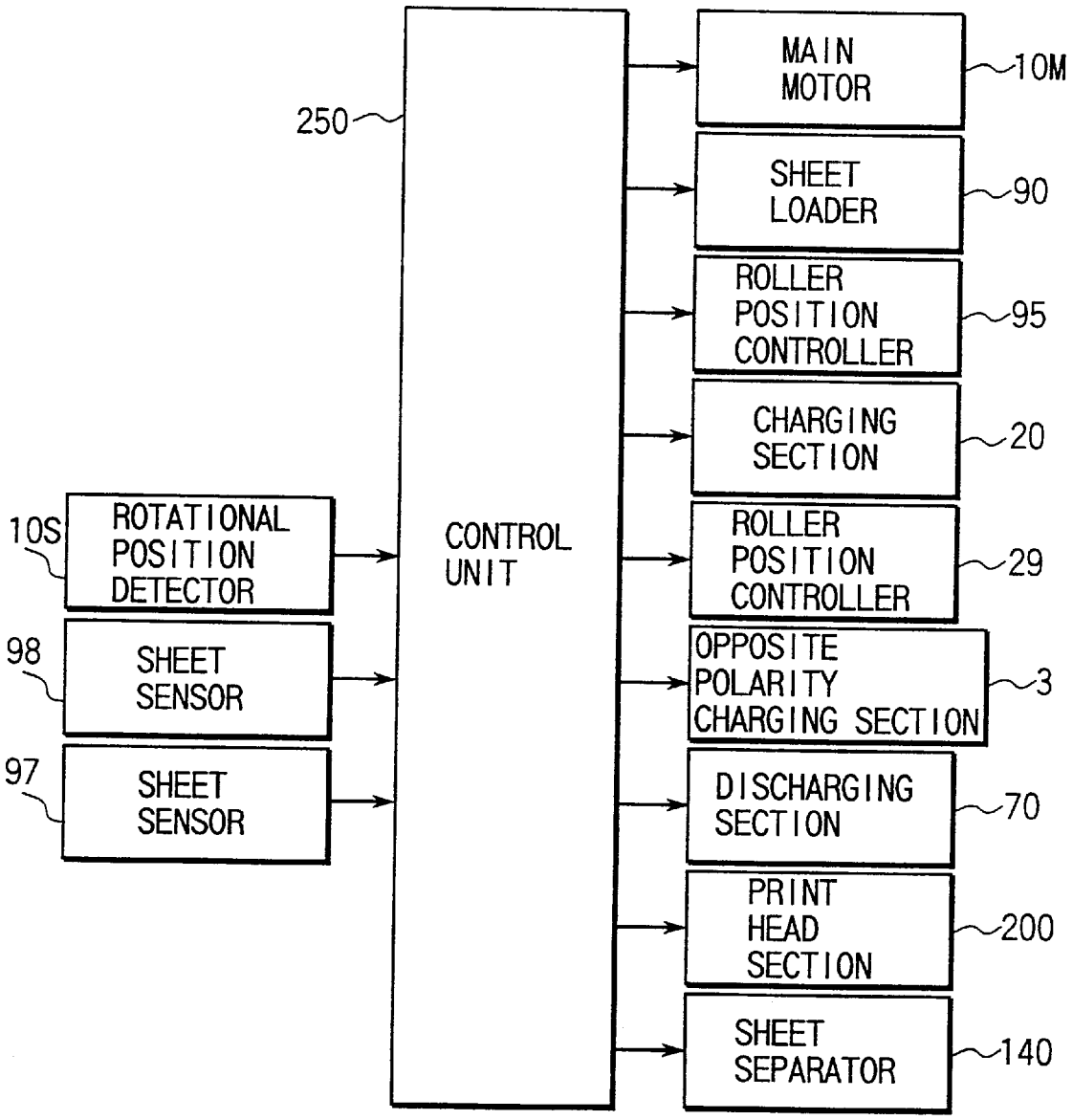
FIG. 7 is a block diagram illustrating a control unit provided for the sheet holding system shown in FIG. 6.

Referring to FIG. 6, the rotary drum 10 is rotatable on a shaft 15, for example, at a rate of 120 rpm, which enables multicolor printing of 20 PPM. The shaft 15 of the rotary drum 10 is grounded by means of a grounding line 19.

A dielectric layer 12 having a resistance (volume resistivity) of $1\times10^{12}$ Ω·cm or higher is formed on the peripheral surface 11 of the rotary drum 10. This is for allowing the surface potential of the rotary drum 10 to be 800V or higher after charging. According to the present embodiment, the dielectric layer is made of a 25 μm-thick polyester film sheet tightly pasted on the rotary drum 10 as the peripheral surface 11. Alternatively, the dielectric layer 12 may be formed in the Teflon resin coating method.

Arranged around the rotary drum 10 are: a sheet loader 90, a charger section 20, a discharge section 26, a sheet separator 140 and a print head section 200. These structural components are arranged along the peripheral surface 11 of the rotary drum 10 in the Y direction in the order mentioned. The charger section 20 comprises a charging roller 21, and a power supply device 22 for applying two kinds of voltage to the charging roller 21. In order to enhance the charging efficiency, the charging roller 21 is made of conductive rubber having a resistance (volume resistivity) of $1\times10^{4}$ Ω·cm to $1\times10^{6}$ Ω·cm. The conductive rubber is specifically polyurethane rubber, silicone rubber, or the like. In the present embodiment, polyurethane rubber is employed. By a roller position controller 29 having such a structure as described in connection with the first embodiment, the charging roller 21 is selectively switchable between the pressed state indicated by the solid line in FIG. 6 and the separated state indicated by the two-dot-dash line in the same FIGURE. In the pressed state, the charging roller 21 directly charges the sheet M into the negative state.

A control unit 250 includes a CPU, a ROM, a RAM, a keyboard, etc. As shown in FIG. 7, it is connected to a main motor M, the sheet loader 90, a sheet position controller 95, the charger section 20, the print head section 200, a rotational position detector 10S, a sheet sensor 97, another sheet sensor 98, etc.

The opposite polarity charging section 3 is arranged along the peripheral surface 11 of the rotary drum 10 and located upstream of the charging roller 21. By the opposite polarity charging section 3, the drum peripheral surface 11, i.e., the dielectric layer 12, is charged to have positive charges, with the sheet M being charged to have negative charges.

The opposite polarity charging section 3 comprises a corona discharger 31 located upstream of the charging roller 21 with respect to the drum rotating direction, and a power supply device 32 for applying positive charges to the corona discharger 31.

A discharge section 70 is made of a corona discharger capable of applying AC potential. Prior to the mechanical separation by the sheet separator 140, the charge attraction force between the peripheral surface 11 and the sheet M is canceled by the discharge section 70.

A description will be given of the operation of the present ink-jet printer.

When the present printer is turned on, the control unit 250 actuates the main motor 10M, by which the rotary drum 10, etc. are driven. Next, the control unit 250 controls the power supply device 32 such that a predetermined voltage (e.g., +5 kV) is applied to the opposite polarity charging section 3. Accordingly, the drum peripheral surface 11 is charged to have positive charges.

When the rotational position detector 10S detects that the rotary drum 10 has reached the predetermined rotational position (angle), the control unit 250 drives the sheet loader 90 so as to feed the sheet M, which is then in the supply standby state, toward the rotary drum 10 shown in FIG. 6. The sheet M is fed at a moving speed corresponding to the circumferential speed of the drum.

Prior to this (or simultaneous with this), the roller position controller 29 is driven so as to advance the charging roller 21 from the position of the two-dot-dash line in FIG. 6 to the position of the solid-line line in the same FIGURE. As in the first embodiment, the charging roller 21 is pressed against the drum peripheral surface 11 with the force caused by the urging force (tension) of the spring 29SP.

When the leading end of the fed sheet M has entered the region between the charging roller 21 (which is driven in accordance with the rotation of the rotary drum 10 and is applied with a voltage) and the peripheral surface 11 of the rotary drum, the sheet M is charged to have negative charges. The leading end of the sheet M is charged in this manner, and the electrostatic attraction produced thereby permits the sheet M to be immediately attracted and held on the peripheral surface 11 of the rotary drum 10.

When it is confirmed on the basis of an output signal from the rotational position detector 10S that the leading end of the sheet M has been held, the control unit 250 moves loading roller 91 of the sheet loader 90 to the position indicated by the two-dot-dash line in FIG. 6. Since the trailing end of the sheet M is released from the sheet loader 90, no load is imposed on the rotary drum 10, which rotates with the sheet M thereon.

In the manner described above, the sheet M is charged while being pressed against the dielectric layer 12 of the rotary drum 10 by the charging roller 21, which has a low electric resistance of $1\times10^6$ Ω·cm. Hence, the sheet M is in tight contact with the drum peripheral surface 11, and is fed in the Y direction in accordance with the rotation of the rotary drum 10.

Since, in this manner, the drum peripheral surface 11 having the sheet M held thereon is directly charged, an electrostatic attraction force can be produced between the drum peripheral surface 11 and the sheet M efficiently and stably. In addition, since the charging roller 21 is used as an auxiliary electrode, the auxiliary charging performed thereby further improves the tight contact state between the drum peripheral surface 11 and the sheet M. Since a decrease in the electrostatic attraction force (i.e., an unstable state) does not occur, the sheet M can be held on the rotary drum 10 reliably and stably.

When the rotational position detector 10S detects (confirms) that the trailing end of the sheet M has passed the charging roller 21 during one rotation of the drum 10, the roller position controller 29 causes the charging roller 21 to separate from the peripheral surface 11 of the rotary drum 10 and retreats to the position indicated by the two-dot-dash line in FIG. 6. Therefore, the sheet M is attracted and held on the drum peripheral surface 11 by the electrostatic attraction force alone, and in this state the sheet M is fed.

While the rotary drum 10 thereafter makes four rotations (second to fifth rotations), ink is jetted from the print head (nozzle units for the respective colors) 200, and printing is executed with respect to the sheet fed by rotation.

Multi-color printing for a sheet of e.g. A4 size is completed when the rotary drum 10 has made four rotations. After this printing operation, the control unit 250 causes the sheet separator 140 to mechanically separate the leading end of the printed sheet M. The separated sheet M is fed to a sheet feed-out mechanism 160 by the sheet separator 140.

According to the present embodiment, the charging roller 21 and the opposite polarity charging section 31 are provided, and the sheet M and the dielectric layer 12 of the drum peripheral surface 11 are provided with charges that are opposite in polarity, so as to present a decrease in the electrostatic attraction force (i.e., an unstable state). Accordingly, high-quality printing can be executed with respect to the sheet that is held on the rotary drum 10 reliably and stably.

The charging roller 21 has a resistance in the range of $1\times10^4$ to $1\times10^6$ Ω·cm, and moves away from the drum peripheral surface 11 after the sheet M is charged. Since the contact charging and the friction charging are thus very effective, the amount of charge provided for the sheet M can be increased. Consequently, the charging efficiency can be improved.

Since the charging roller 21 moves away from the drum peripheral surface 11 after the sheet M is charged, it does not interfere with the sheet M when this sheet is being printed, and the sheet M is not stained with ink. Since the charging efficiency can be further improved, a very smooth printing operation is ensured.

An ink-jet printer according to the third embodiment of the present invention will now be described with reference to FIGS. 8 to 12.

In the present ink-jet printer, a charger section 20 comprises a charging roller 21 and a conductive brush 81. An opposite polarity charging section 3, the charging roller 21 and a conductive brush 81 are arranged along the peripheral surface 11 of a rotary drum 10 in the Y direction.

Since the present ink-jet printer has a substantially similar structure to that of the above-described embodiment, except on the points described below, similar or corresponding structural components will be denoted by the same reference numerals as used above, and a description of such structural components will be omitted or simplified.

Referring to the Figure, the rotary drum 10 is rotatable on a shaft 15, for example, at a rate of 120 rpm, which enables multicolor printing of 20 PPM. The shaft 15 of the rotary drum 10 is grounded by means of a grounding line 19.

A dielectric layer 12 having a resistance (volume resistivity) in the range of $1\times10^{12}$ Ω·cm to $1\times10^{20}$ Ω·cm is formed on the peripheral surface 11 of the rotary drum 10. This is for securing a required surface potential after charging (e.g., 800V or higher). According to the present embodiment, the dielectric layer is made of a 25 μm-thick polyester film sheet tightly pasted on the peripheral surface 11. The reason for determining the thickness of the polyester film sheet to be 25 μm is that a sheet M having this thickness could be held on the peripheral surface 11 very reliably in an experiment. In this experiment, sheets M having different thicknesses were tested to see how reliably they could be held. Incidentally, the dielectric layer 12 may be formed in the Teflon resin coating method.

Arranged around the rotary drum 10 are: the opposite polarity charging section 3, a sheet loader 90, the charging roller 21, the conductive brush 81, a discharge section 70, a sheet separator 140 and a print head section 200. These structural components are arranged along the peripheral surface 11 of the rotary drum 10 in the Y direction in the order mentioned.

Figure 8:
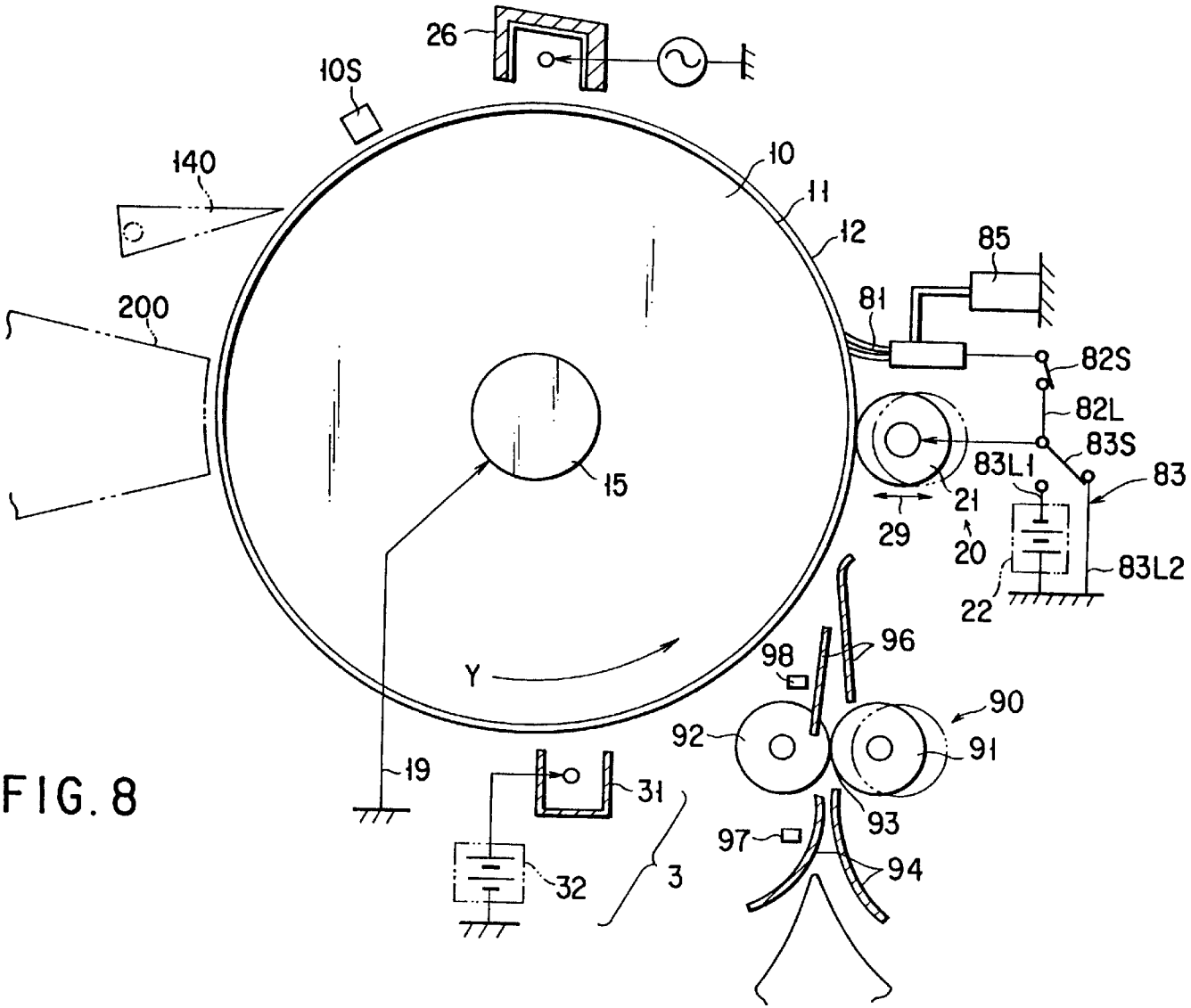
FIG. 8 a view showing the structure of a sheet holding system incorporated in an ink-jet printer according to the third embodiment of the present invention.

The charging roller 21 is selectively switchable between the pressed state indicated by the solid line in FIG. 8 and the separated state indicated by the two-dot-dash line in the same FIGURE. In the pressed state, the charging roller 21 directly charges the sheet M into the negative state.

In order to enhance the charging efficiency, the charging roller 21 is made of conductive rubber having a resistance (volume resistivity) of $1\times10^4$ Ω·cm to $1\times10^6$ Ω·cm. The conductive rubber is specifically polyurethane rubber, silicone rubber, or the like. In the present embodiment, polyurethane rubber is employed. The charging roller 21 is applied with a negative voltage by a power supply device 22 through a selection switch circuit 83. The voltage applied by the power supply device 22 is switchable.

The selection switch circuit 83 includes a changeover switch 83S, current paths 83L1, 83L2, etc. The charging roller 21 can be electric connected or disconnected from the power supply device 22, or it can be grounded by switching the current paths from one to another by means of the changeover switch 83S.

As in the embodiment described above, this roller position controller 29 can advance or retreat under the control of the control unit 250. At least the advancing movement thereof is performed at such a timing as enables the leading end of the sheet M to be charged immediately after the charging roller 21 contacts the drum peripheral surface 11.

The opposite polarity charging section 3 is arranged upstream of the charging roller 21 with respect to the drum rotation direction (Y direction), and charges the drum peripheral surface 11 to have charges (positive charges) that are opposite in polarity to the charges (negative charges) of the sheet M.

According to the present embodiment, the opposite polarity charging section is made of a corona discharger arranged upstream of the charging roller 21 with respect to the drum rotating direction. The corona discharger 31 is applied with a positive voltage by a power supply device 32. The voltage applied by the power supply device 32 can be switched from one to another.

The conductive brush 81 is arranged downstream of the charging direction with respect to the drum rotating direction (Y direction). The conductive brush 81 can be brought into contact with the sheet M held on the drum peripheral surface 11 in the state where it is applied with a voltage or is grounded. The conductive brush 81 can be moved to the drum peripheral surface 11 or away from it by a brush position controller 85.

According to the present embodiment, the conductive brush 81 is made of a conductive brush 81 arranged downstream of the charging roller 21 with respect to the drum rotating direction. This conductive brush 81 is applied with a voltage (or is grounded) by means of the power supply device 22 and the selection switch circuit 83. In other words, the conductive brush 81 can be connected or disconnected from the power supply device 22 (or is grounded) by means of the connection circuit, which includes current path 82S, changeover switch 82S, etc. and the selection switch circuit 83.

The brush position controller 85 is made of a solenoid 85 connected to the conductive brush 81. The conductive brush 81 moves away from the drum peripheral surface 11 by exciting the solenoid 85, and moves closer to the drum peripheral surface 11 by degaussing the solenoid 85.

Figure 9:
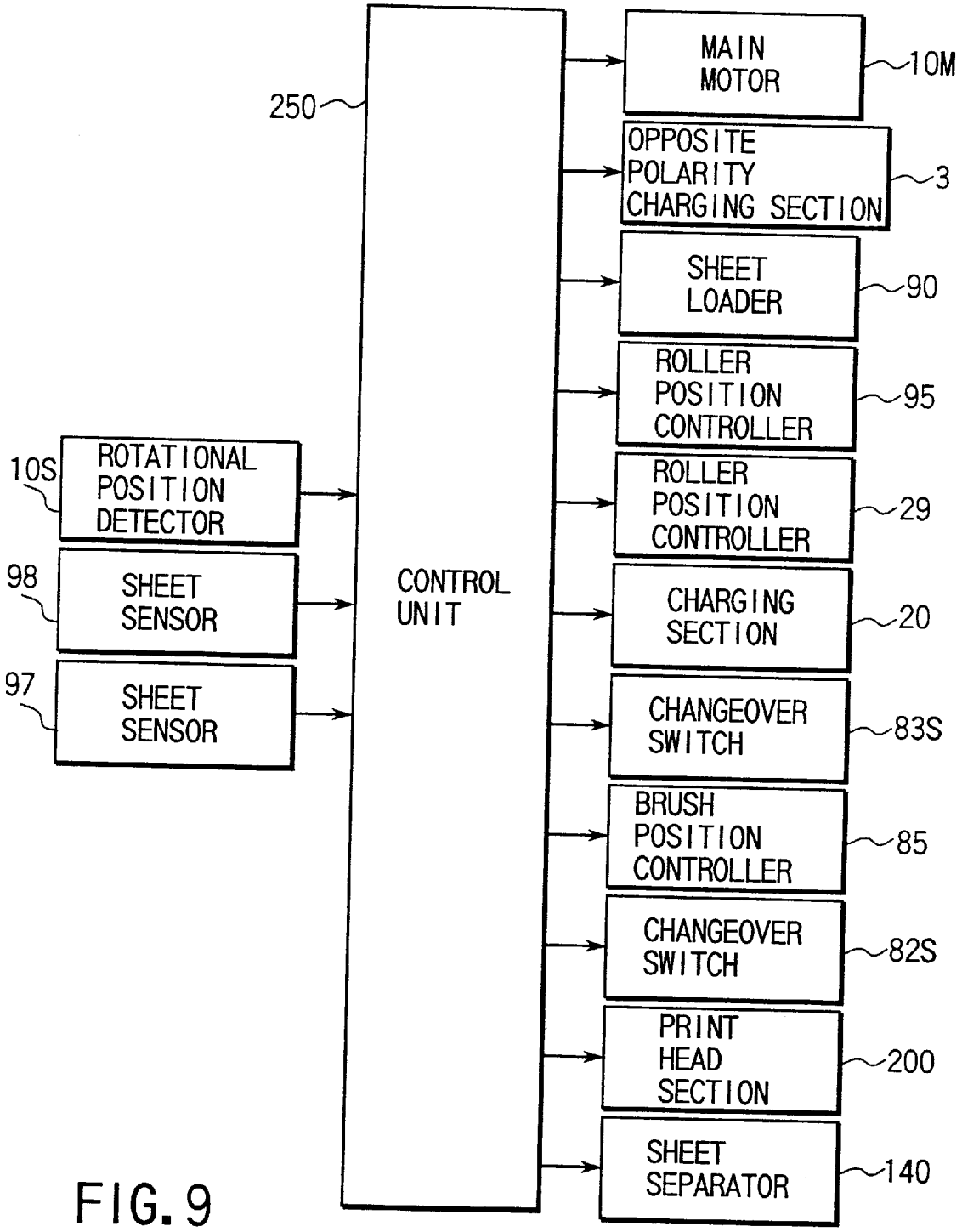
FIG. 9 is a block diagram for explaining a control unit provided for the sheet holding system shown in FIG. 8.

The control unit 250 determines the charging conditions (incl. a grounding condition) with reference to the opposite polarity charging section 3, charging roller 21 and conductive brush 81, in accordance with the type of a sheet M. According to the present embodiment, the control unit 250 includes a CPU, a RAM, a ROM, a keyboard, etc., and is connected to a main motor 10M, the charger section 20, the changeover switches 83S and 82S, the sheet loader 90, the print head section 200, the rotational position detector 10S, a sheet sensor 97, another sheet sensor 98, etc., as shown in FIG. 9.

The keyboard of the control unit 250 is used for entering the type of a sheet M, such as a plastic film (OHP film) or plain copying paper). The CPU sets the charging conditions selected in accordance with the type of the sheet M in the RAM, and drives the power supply devices 22 and 32, changeover switches 83S and 82S and position controllers 29 and 45 in such a manner that the opposite polarity charging section 3, the charging roller 21 and conductive brush 81 are charged or grounded.

The charging conditions according to this embodiment will be described. In the case where the sheet M is plain copying paper, the voltage applied to the opposite polarity charging section 3 is DC+4.5 (or +5) kV, and the charging roller 21 and the conductive brush 81 are grounded. In the case where the sheet M is plastic film (OHP film), the voltage applied to the opposite polarity charging section 3 is DC+5 kV, and the voltage applied to the charging roller 21 independently (or the voltage applied to both the charging roller 21 and the conductive brush 81) is DC−800V.

The discharge section 70 is made of a corona discharger capable of applying AC potential. Prior to the mechanical separation by the sheet separator 140, the charge attraction force between the peripheral surface 11 and the sheet M is canceled by the discharge section 70.

A description will be given of the operation of the present ink-jet printer.

When the present printer is turned on, the control unit 250 actuates the main motor 10M. Subsequently, when the rotational position detector 10S detects that the rotary drum 10 has reached the predetermined rotational position (angle), the control unit 250 drives the sheet loader 90 so as to feed the sheet M, which is then in the supply standby state, toward the rotary drum 10 shown in FIG. 8. The sheet M is fed at a moving speed corresponding to the circumferential speed of the drum.

Prior to this (or simultaneous with this), the control unit 250 drives the power supply devices 22 and 32, changeover switches 83S and 82S and position controllers 29 and 45 in such a manner that the opposite polarity charging section 3, the charging roller 21 and conductive brush 81 are charged or grounded under the charging conditions corresponding to the entered type of the sheet M (e.g., plastic film [OHP film]).

Figure 10:
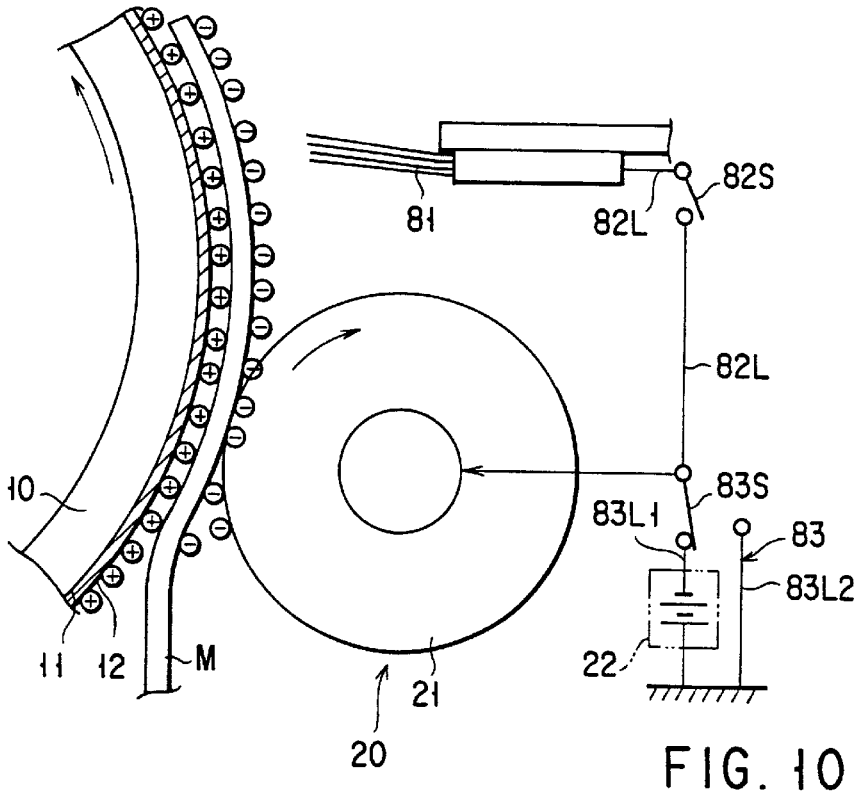
FIG. 10 is a view for explaining a charging condition employed in a case where a plastic film is held on the peripheral surface of a rotary drum by the sheet holding system shown in FIG. 8.
Figure 11:
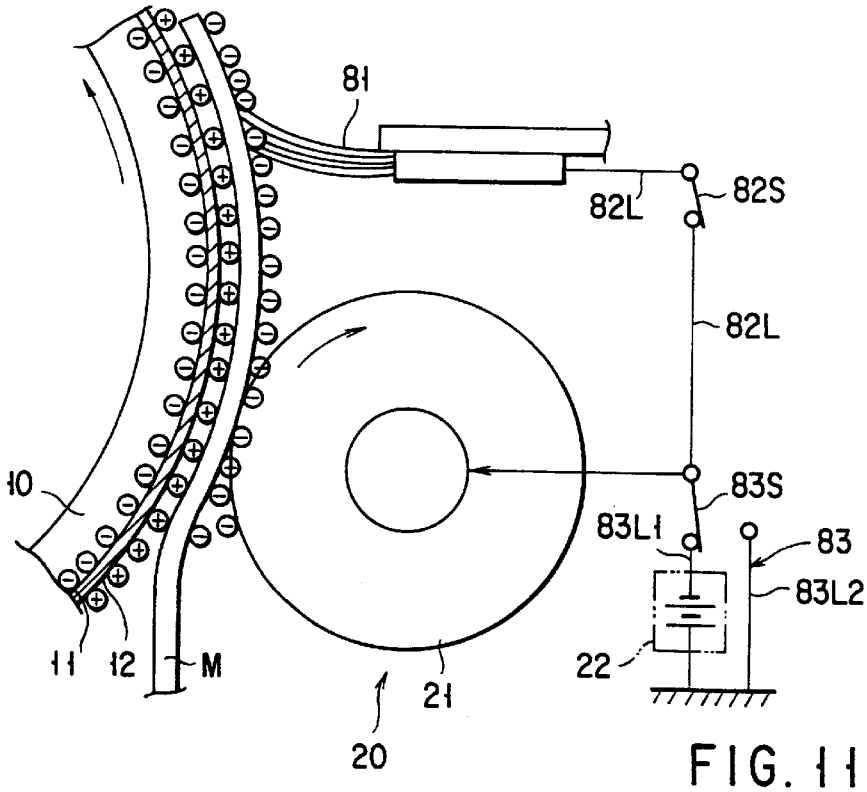
FIG. 11 is a view for explaining another charging condition employed in a case where a plastic film is held on the peripheral surface of the rotary drum by the sheet holding system shown in FIG. 8.
Figure 12:
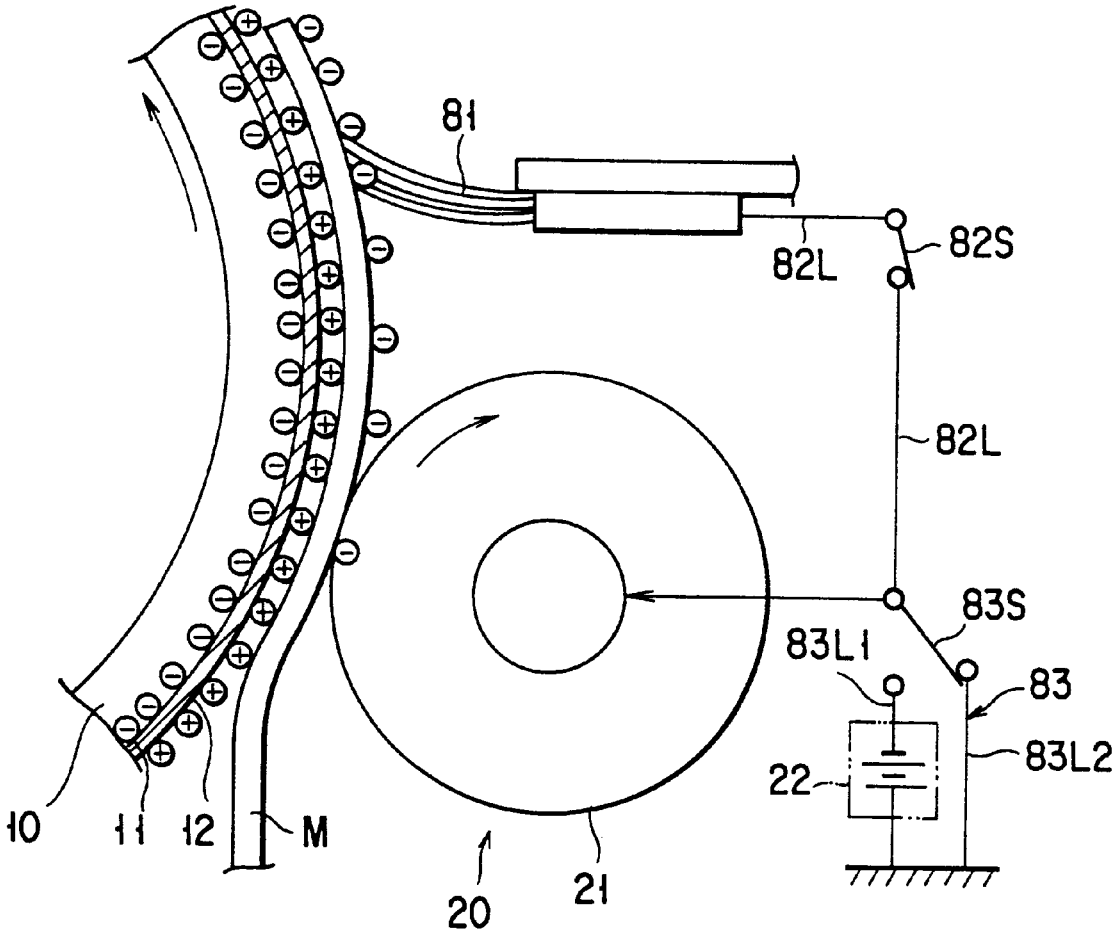
FIG. 12 is a view for explaining another charging condition employed in a case where a sheet of paper is held on the peripheral surface of the rotary drum by the sheet holding system shown in FIG. 8.

The opposite polarity charging section 3 is applied with DC+5 kV. In addition, as shown in FIG. 10, the charging roller 21 is brought into contact with the drum peripheral surface 11, and is applied with DC−800V. Alternatively, as shown in FIG. 11, the charging roller 21 and the conductive brush 81 are brought into contact with the drum peripheral surface 11, and they are applied with DC−800V.

Therefore, when the leading end of the fed sheet M (plastic film [OHP film]) has entered the region between the charging roller 21 (which is driven in accordance with the rotation of the rotary drum 10) and the peripheral surface 11, the sheet M is charged to have negative charges. The leading end of the sheet M is further charged in this manner, and the auxiliary electrostatic attraction produced thereby permits the sheet M to be attracted and held on the peripheral surface 11 of the rotary drum 10.

When the leading end of the sheet M has been held (this state is confirmed based on the output signals from the rotational position detector 10S in the case of the present embodiment), the control unit 250 moves one 91 of the loading rollers of the sheet loader 90 to the position indicated by the two-dot-dash line in FIG. 8. Since the trailing end of the sheet M is released from the rollers 91 and 92, no load is imposed on the rotary drum 10.

In this manner, the sheet M (plastic film [OHP film]) is pressed against the peripheral surface 11 of the rotary drum 10 by the charging roller 21 having a low electric resistance, and is charged thereby. Accordingly, the sheet M is in tight contact with the drum peripheral surface 11, and is rotated and fed in the Y direction in accordance with the rotation of the rotary drum 10.

Since the peripheral surface 11 of the rotary drum 10 is charged to have positive charges, which are opposite in polarity to the negative charges of the sheet M, the sheet M (plastic film [OHP film]) can be held on the rotary drum 10 reliably and stably.

In the case where plain copying paper (e.g., A4 -size copying paper) is used as the sheet, the opposite polarity charging section 3 is applied with a voltage (DC+4.5 kV or +5 kV) before the plain copying paper is fed to the drum peripheral surface. Accordingly, the opposite polarity charging section 3 is charged to have positive charges.

When a sheet of plain paper is supplied to the drum peripheral surface 11, the charging roller 21 and the conductive brush 81 are brought into contact with the drum peripheral surface 11. The charging roller 21 and the drum peripheral surface 11 are grounded as soon as they touch the sheet of plain paper.

Since the sheet of plain paper is in contact with the grounded charging roller 21 and conductive brush 81, charges that are opposite in polarity to those of the drum peripheral surface 11 are induced on the sheet of plain paper.

As a result, an electrostatic attraction force acts between the sheet of plain paper and the drum peripheral surface 11, the sheet of plain paper is reliably held on the drum peripheral surface 11.

When it is confirmed by the rotational position detector 10S that the trailing end of the sheet M has passed the charging roller 21 during one rotation of the drum 10, the roller position controller 29 causes the charging roller 21 to separate from the peripheral surface 11 and retreat to the position indicated by the two-dot-dash line in FIG. 8. Simultaneous with this, the conductive brush 81 is made to retreat and separate from the drum peripheral surface 11. Accordingly, the sheet M is attracted and held on the drum peripheral surface 11 and rotated in the Y direction.

While the rotary drum 10 thereafter makes four rotations (second to fifth rotations), ink is jetted from the print head section 200, and printing is executed with respect to the sheet M fed by rotation.

Multi-color printing for the sheet M is finished when the rotary drum 10 has made four rotations. After this printing operation, the control unit 250 causes the sheet separator 140 to mechanically separate the leading end of the printed sheet M. The separated sheet M is fed to a sheet feed-out mechanism 160 by the sheet separator 140.

According to the present embodiment, the charging roller 21 can press the sheet M against the peripheral surface 11 of the rotary drum 10 in the state where the charging roller 21 is kept applied with a voltage or grounded. The print head section 200 can execute a printing operation for the sheet M electrostatically attracted and held on the rotary drum 10. In addition, the opposite polarity charging section 3 is arranged along the peripheral surface 11 of the rotary drum 10 and located upstream of the charging roller 21, and by this opposite polarity charging section 3, the drum peripheral surface 11 is provided with charges that are opposite in polarity to those of the sheet M. Owing to the use of these structural components, a variety of types of sheets M can be held on the rotary drum 10 reliably, and high-quality printing can be effected in a stable manner.

Moreover, the conductive brush 81 is arranged along the peripheral surface 11 of the rotary drum 10 and located downstream of the charging roller 21. The conductive brush 81 can be brought into contact with the sheet M on the drum peripheral surface 11 in the state where the brush 81 is kept applied with a voltage or grounded. In addition, the brush position controller 85 permits the conductive brush 81 to contact or separate from the drum peripheral surface 11. Owing to the use of these structural components, a variety of types of sheets M can be held on the rotary drum further reliably, and high-quality printing can be effected in a stable manner.

Still further, the charging roller 21 has a resistance of $1\times10^4$ Ω·cm to $1\times10^6$ Ω·cm, and can be separated from the drum peripheral surface 11 after the sheet M is charged. The dielectric layer 12 formed on the drum peripheral surface 11 has a resistance in the range of $1\times10^{12}$ Ω·cm to $1\times10^{20}$ Ω·cm, and the voltage applied to the opposite polarity charging section 3 can be switchable from one to another. With this structure, the sheet can be charged with enhanced efficiency, and the drum peripheral surface can be charged by applying thereto a charging voltage suitable for the type of the sheet M. In addition, the charging roller 21 and the conductive brush 81 are separated from the drum peripheral surface 11 after the end of the charging operation. With this structure, the charging roller 21 does not contact the ink jetted onto the sheet from the print head section 200. Accordingly, a variety of types of sheets M can be held on the drum peripheral surface 11 further reliably, and high-quality printing is enabled.

Since the voltage applied to the charging roller 21 is switchable from one to another, the drum peripheral surface 11 and the sheet M can be provided with opposite-polarity charges in an appropriate amount. Therefore, a variety of types of sheets M can be reliably held on the drum peripheral surface 11, and high-quality printing is enabled.

In addition, since the voltage applied to the conductive brush 81 is switchable from one to another, the drum peripheral surface 11 and the sheet M can be provided with opposite-polarity charges in an appropriate amount in such a manner that the charging operation corresponds to the type of the sheet M. Therefore, a variety of types of sheets M can be reliably held on the drum peripheral surface 11, and high-quality printing is enabled.

The charging conditions in the above embodiment were described in relation to the cases where the sheet M is a plain copying sheet and where it is a plastic film (OHP film). Needless to say, however, these cases in no way restrict the present invention. For example, a sheet of paper having a surface coating and used exclusively for the subject printer may be used. In this case, the voltage applied to the opposite polarity charging section 3 is set to be DC+4.5 (or +5) kV, and the voltage applied to the charging roller 21 independently (or the voltage applied to both the charging roller 21 and the conductive brush 31) is set to be DC−200V.

An ink-jet printer according to the fourth embodiment of the present invention will now be described with reference to FIGS. 13 and 14.

Figure 13:
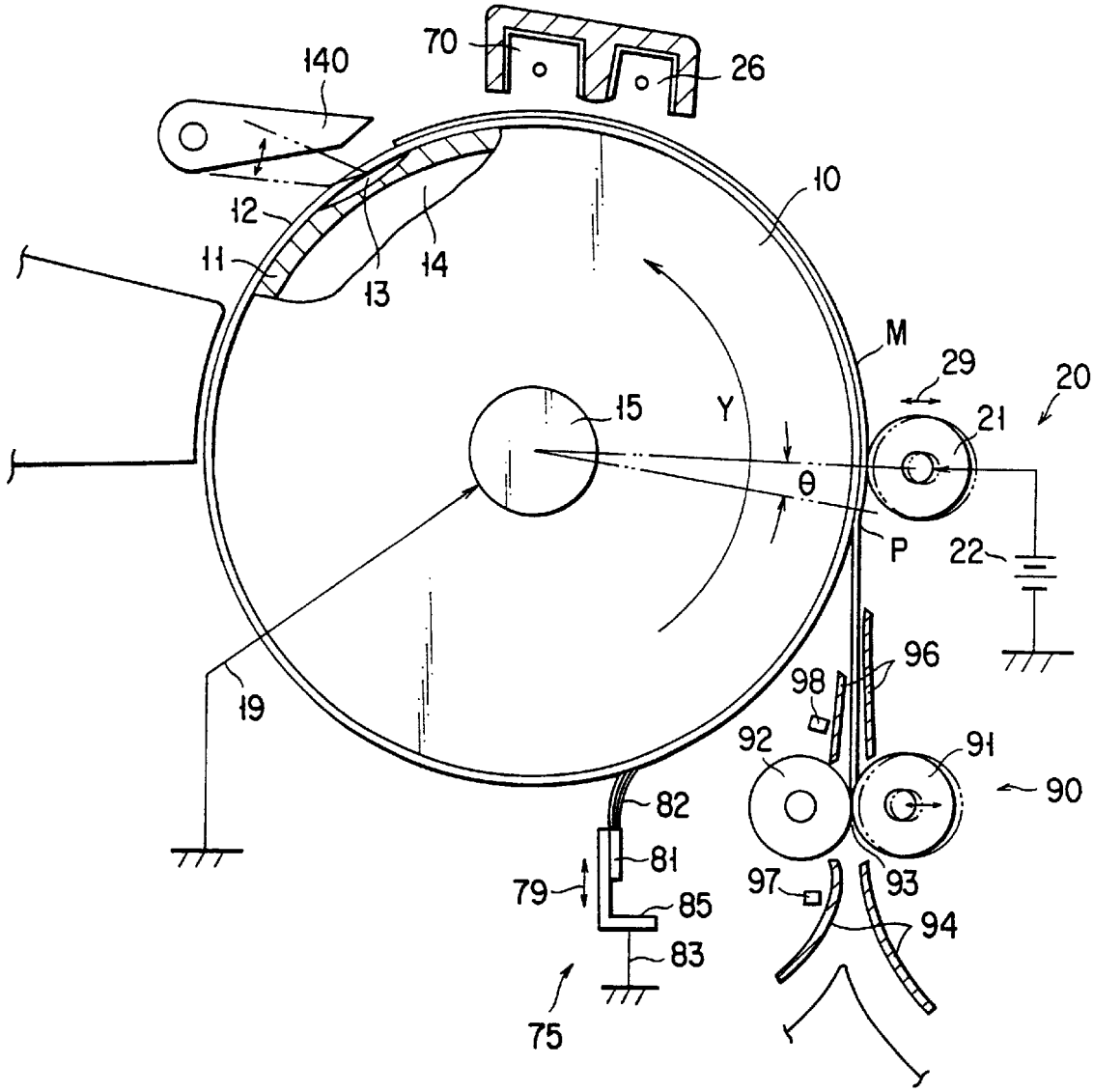
FIG. 13 is a view showing the structure of a sheet holding system incorporated in an ink-jet printer according to the fourth embodiment of the present invention.

As shown in FIG. 13, the ink-jet printer according to this embodiment is designed such that a sheet M is attracted and held on the peripheral surface 11 of a rotary drum 10, which is rotatable at a constant circumferential speed, by utilization of an electrostatic attraction force, such that ink is jetted from an ink jet nozzle 207 over the sheet M that is being rotated in accordance with the rotation of the rotary drum 10, to thereby execute printing with respect to the sheet M, and such that the rotary drum 10 can be discharged by contact with the peripheral surface 11 before the sheet M is attracted and held and/or after printing is executed.

Since this ink-jet printer has a substantially similar structure to that of the above-described embodiment, except on the points described below, similar or corresponding structural components will be denoted by the same reference numerals as used above, and a description of such structural components will be omitted or simplified.

As shown in FIG. 13, the rotary drum 10 has a hollow section 14 and is rotatable at a rate of 120 rpm, which enables multicolor printing of 20 PPM. A shaft 15, around which the drum 10 rotates, is grounded by means of a grounding line 19.

A dielectric layer 12 having a resistance (volume resistivity) in the range of $1\times10^{12}$ Ω·cm to $1\times10^{20}$ Ω·cm is formed on the peripheral surface 11 of the rotary drum 10. This is for allowing the surface potential of the rotary drum 10 to be higher than a predetermined value (e.g. 500V or higher) after charging. According to the present embodiment, the dielectric layer is made of a 25 μm-thick Mylar sheet tightly pasted on the peripheral surface 11. A groove section 13, into which the tip end of a sheet separator 140 can be inserted, is formed in part of the peripheral surface 11.

Arranged around the rotary drum 10 are: a sheet loader 90, a charger section 20, a supplementary charger section 26, a discharge section 70, a sheet separator 140, a print head section 200 and a discharge section 70. These structural components are arranged in the Y direction in the order mentioned.

The sheet loader 90 is made up of a pair of loading rollers 91 and 92, and has a sheet feed function of feeding sheets toward the rotary drum 10, a posture adjustment function and a supply standby function.

The leading end of sheet M fed from the downward region, as viewed in FIG. 13, collide with the contact portion 93 of the loading rollers 91 and 92, and is elastically deformed inside a guide 94. Therefore, the leading end of the sheet M is aligned in parallel with the shaft 15 of the rotary drum 10, and in this state it can be loaded to the rotary drum 10 without skewing. Inside the guide 94, the elastically recovering force of the sheet M promotes the posture adjustment. A sheet sensor 97 detects that a sheet M has reached the posture adjustment position.

After the end of the posture adjustment, the loading rollers 91 and 92 move a sheet M toward the rotary drum 10 such that the sheet M passes along a guide 96 until the leading end of the sheet M comes to the position detectable by a sheet sensor 98. Since the leading end of the sheet M is clamped by the loading rollers 91 and 92, the trailing end of the sheet M can be released from the cassette feeder 71 or the manual feeder 61 located under the guide 94. The feeding step for the next sheet M has come to an end by this point of time, and the supply standby state toward the rotary drum 10 is established. This is effective in increasing the printing speed.

The sheet M can be supplied to the rotary drum 10 at a predetermined timing. The feed position at which the fed sheet M first contacts the rotary drum 10, i.e., the loading point on the peripheral surface 11, is indicated by P. After the leading end of the fed sheet M is held on the peripheral surface 11, one of the rollers (namely, roller 91) is moved in the rightward direction, as indicated by the two-dot-dash line in FIG. 13. Since the trailing end of the sheet M is therefore set in the free state, no load is imposed on the rotation of the rotary drum 10.

In terms of the relationships with the discharge section 70, the charger section 20 may be either a direct (contact) charging system made of a charging roller or the like, or an indirect (non-contact) charging system made of a corona discharge unit or the like. In the present embodiment, the former system is employed.

The charger section 20 is made up of: a charging roller 21 which is selectively switchable by a roller position controller 29 between the solid line state (contact) shown in FIG. 13 and the two-dot-dash line state (separated) also shown in the same Figure, and which is capable of directly charging the sheet M (or the peripheral surface 11) when it is in the contact state; and a power supply unit 22 which applies a voltage (e.g., DC+1.5 kV) to the charging roller 21. The charging roller 21 is a conductive rubber roller having a resistance (volume resistivity) of $1\times10^6$ Ω·cm or lower. It enhances the charging efficiency and the pressing characteristics. As the conductive rubber, polyurethane rubber, silicone rubber, or the like is employed. In the case of the present embodiment, polyurethane rubber is adopted.

The charging roller 21 is arranged along the peripheral surface 11 of the rotary drum 10, and located downstream of the loading point P and close thereto. It can be brought into contact with the peripheral surface 11. To be more specific, when the shaft 15 is considered a center, the angle θ formed between the loading point P and the charging roller 21 is determined to be as narrow as possible as long as the leading end of the fed sheet M does not collide with the charging roller 21. This structure is intended to promptly charge the leading end of the fed sheet M. In the case where the leading end of the sheet M is reliably attracted and held on the peripheral surface 11, the conveyance by rotation can be performed in a more reliable manner.

The supplementary charger section 26, which constitutes a sheet holding system together with the charger section 20, is made of a corona discharger capable of removing positive charges by application of a voltage of 4 kV, for example. The corona discharger adds charges to the sheet M and maintains a constant electrostatic attraction force by compensating for charge attraction force attenuation which occurs during the rotation of the rotary drum 10 (particularly when a printing operation is executed by the print head section 200).

The discharge section 70 is made of a corona discharger capable of applying AC potential. Prior to the mechanical separation by the sheet separator 140, the charge attraction force between the peripheral surface 11 and the sheet M is canceled by the discharge section 70. The discharge section 70 provides charges of the opposite polarity to that of the charges provided by the supplementary charger section 26.

A discharge section 75 includes an electric discharge brush 82 which contacts the peripheral surface 11 formed of the dielectric layer 12 and can remove the charges remaining on the peripheral surface 11. The electric discharge brush 82 is coupled to an elevator section 79 shown in FIG. 13, by means of a holder 41 and an elevating member 85. The electric discharge brush 82 is vertically movable between a lower position and an upper position.

The elevator section 79 can be realized in a variety of manners. It may be a cam drive system similar to that of the roller position controller 29. Alternatively, it may be a solenoid drive system, an air cylinder drive system, a motor drive system, or the like.

Figure 14:
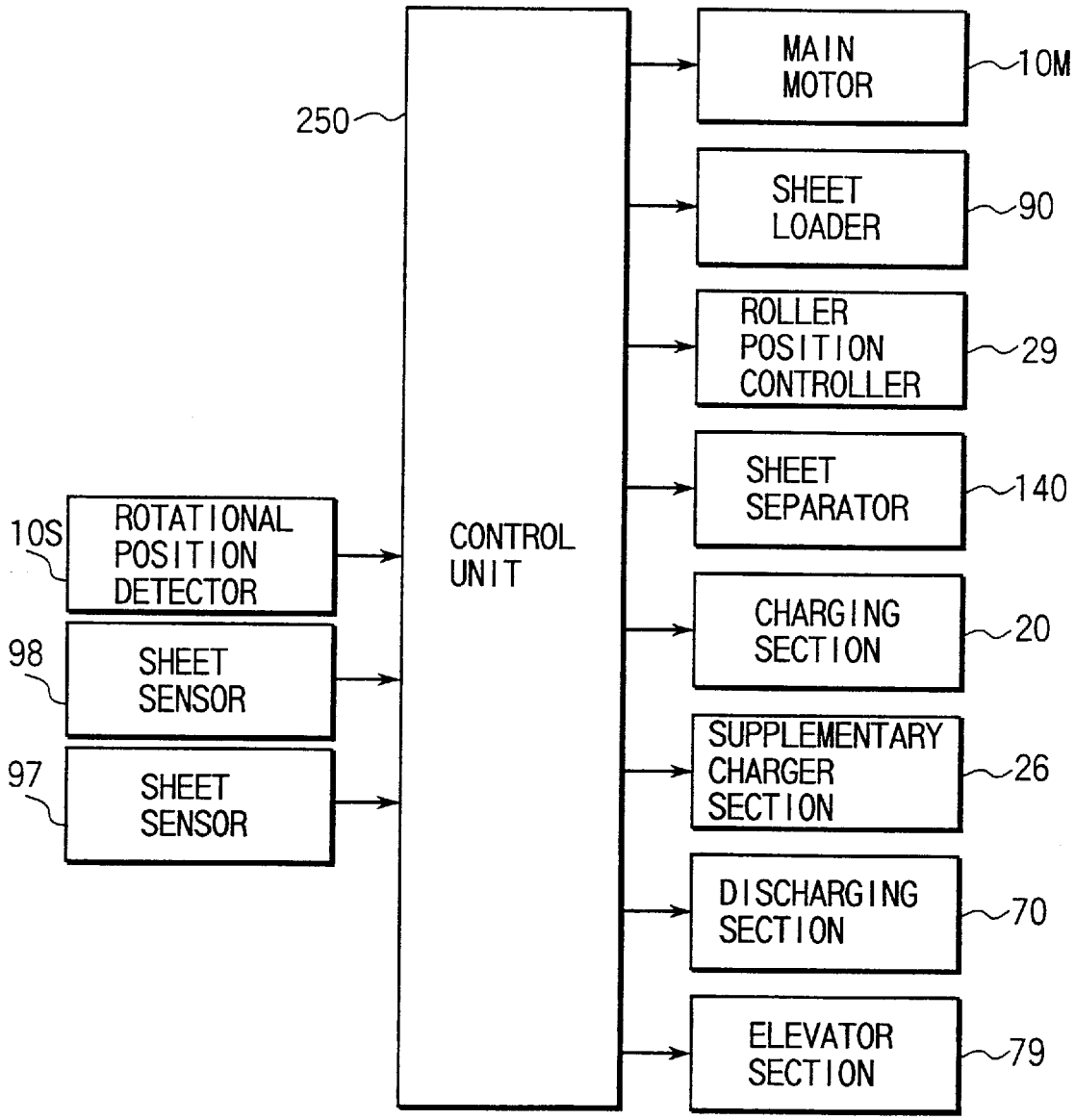
FIG. 14 is a block diagram for explaining a control unit provided for the sheet holding system shown in FIG. 13.

A control unit 250, shown in FIG. 14, includes a CPU, a ROM, a RAM, etc., and can drive or control the entire printer. Of the structural components of the control unit 250, those which do not have direct relevance to the subject printer are not illustrated.

In the case of the present embodiment, when the power supply device is switched on, the control unit 250 actuates a main motor 10M in such a manner as to rotate at low speed, and simultaneously lifts the elevator section 79 from the lower position to the upper position shown in FIG. 13. As a result, the electric discharge brush 82 is brought into contact with the peripheral surface 11 and thus removes the remaining charges from the rotary drum 10. This initializing operation is completed automatically or by entering manual instructions.

After the end of the initializing operation, the control unit 250 drives the elevator section 79 so as to move down the electric discharge brush 82 to the lower position. In addition, the main motor 10M is switched into the high-speed rotation mode.

When a rotational position detector 10S thereafter detects that the rotary drum 10 has reached the predetermined rotational position (angle), the control unit 250 drives the sheet loader 90 so as to feed the sheet M, which is then in the supply standby state, toward the rotary drum 10 shown in FIG. 13. The sheet M is fed at a moving speed corresponding to the circumferential speed of the drum.

Prior to this (or simultaneous with this), the control unit 250 drives the roller position controller 29 so as to advance the charging roller 21 from the two-dot-dash line state to the solid line state shown in FIG. 13. The advancing movement of the charging roller 21 is executed no later than a time which is immediately before the loading point P comes close. The charging roller 21 is brought into contact with the drum peripheral surface 11 (dielectric layer 12) with a certain pressure produced by the urging force (tension) of a spring 29SP. When or immediately before the charging roller 21 contacts the sheet M, the control unit 250 turns on the power supply unit 22 so as to apply a voltage to the charging roller 21.

Therefore, when the leading end (loading point P) of the fed sheet M has entered the region between the charging roller 21 (which is driven in accordance with the rotation of the rotary drum 10) and the peripheral surface 11, the sheet M can be charged. The leading end of the sheet M is charged, and the electrostatic attraction produced thereby permits the sheet M to be promptly attracted and held on the peripheral surface 11 of the rotary drum 10.

When the leading end of the sheet M has been held (this state is confirmed based on the output signals from the rotational position detector 10S in the case of the present embodiment), the control unit 250 moves one 91 of the loading rollers of the sheet loader 90 to the position indicated by the two-dot-dash line in FIG. 13. Since the trailing end of the sheet M is released from the rollers 91 and 92, no load is imposed on the rotation or conveyance by the rotary drum 10.

In this manner, the sheet M is attracted and held on the drum peripheral surface 11 (dielectric layer 12) by the electrostatic attraction force produced by the charger section 20. In addition, the sheet M is pressed against the drum peripheral surface 11 by the charging roller 21. In this state, the sheet M is rotated and fed in the Y direction in accordance with the rotation of the rotary drum 10. The charging roller 21 is a driven member and pressed against the peripheral surface 11. Since it serves to roll out the sheet M from the leading end to the trailing end, the sheet M can be brought into tight contact with the dielectric layer 12.

When it is confirmed by the rotational position detector 10S that the trailing end of the sheet M has passed the charging roller 21 during one rotation of the drum 10, the roller position controller 29 causes the charging roller 21 to separate from the sheet M (dielectric layer 12) and retreat to the position indicated by the two-dot-dash line in FIG. 13. Accordingly, the sheet M is attracted and held on the drum peripheral surface 11 by the electrostatic attraction force, and rotated and fed in the Y direction.

While the rotary drum 10 thereafter makes four rotations (second to fifth rotations), ink is jetted from the nozzle head (ink jet nozzle) 200, and printing is executed with respect to the sheet M that is being rotated and fed. The supplementary charger section 26 operates during this printing operation and maintains a constant electrostatic attraction force. The control unit 250 drives the sheet loader 90 so as to set the next sheet M into the supply standby state.

Multi-color printing is executed with respect to a sheet M (e.g., a A4 -size sheet) during four rotations of the rotary drum 10. After the end of this printing operation, the control unit 250 causes the discharge section 70 to remove the electrostatic attraction force from between the printed sheet M and the dielectric layer 12. The control unit 250 further causes the sheet separator 140 to mechanically separate the leading end of the printed sheet M. The separated sheet M is transferred to a sheet feed-out mechanism 160 by the sheet separator 140, which also functions as a transfer means.

In this manner, the control unit 250 drives the elevator section 79 and lifts the electric discharge brush 82 to the upper position, as shown in FIG. 13. Accordingly, the electric discharge brush 82 clears the dielectric layer 12 of remaining charges.

In the state where the sheet M is not attracted or held on the peripheral surface 11, the rotary drum 10 makes one rotation (the sixth rotation in the case of this embodiment), during which the electric discharge brush 1 is kept in contact with the dielectric layer 12. Hence, the entire longitudinal region of the peripheral surface 11 can be discharged uniformly and reliably.

Thereafter, printing is executed, with sheets M successively attracted and held and successively rotated and fed. When the end of the printing operation is drawing near, the control unit 250 controls the main motor 10M to rotate at low speed again. In addition, the control unit 250 causes the elevator section 79 to lift the electric discharge brush 82 to the upper position shown in FIG. 13, thereby executing a discharging operation after the end of the printing operation as well. This discharge operation is executed for a predetermined length of time Ts. Subsequently, the electric discharge brush 82 is moved down to the lower position.

According to this embodiment, a sheet M is attracted and held on the peripheral surface 11 of the rotary drum 10, which is rotatable at a constant circumferential speed, by utilization of an electrostatic attraction force. Ink is jetted from the ink jet nozzle 207 over the sheet M that is being rotated in accordance with the rotation of the rotary drum 10, to thereby execute printing with respect to the sheet M. The rotary drum 10 can be discharged by contact with the peripheral surface 11 before the sheet M is attracted and held and/or after printing is executed. Hence, the sheet M can be attracted and held on the rotary drum 10 reliably and stably, and high-quality printing can be executed with respect to the sheet M.

In addition, since the sheet loader 90, the charger section 20, the sheet separator 140, the print head section 200 and the electric discharge brush 82 are arranged in the rotating direction of the drum 10 in the order mentioned, the operations between the sheet feed and sheet separation can be successively performed in a very stable manner, with the charging operation executed in the meantime.

Moreover, the charger section 20 is made of a charging roller 21 capable of rotating while being pressed against the peripheral surface 11, and is arranged downstream of the position P on the peripheral surface, at which the leading end of the sheet M fed by the sheet loader 90 contacts the peripheral surface 11 for the first time. Since this structure enables the leading end of the fed sheet M to be immediately charged, the attracting and holding operation and the rotating and conveying operation can be performed in a very stable manner.

The charging roller 21 is made of a conductive polyurethane rubber roller having a resistance of $1\times10^6$ Ω·cm or lower. The charging roller 21 can charge the sheet M in contact therewith by applying DC 1.5 KV to the shaft of the charging roller 21. Since this structure enables the sheet M to be in tight contact with the peripheral surface 11, the charging efficiency is remarkably enhanced.

Since the charger section 20 and the discharge section 75 are movable closer to, and away from the peripheral surface 11, the charging and discharging operations do not interfere with the sheet M that is being printed, and smooth charging and discharging operations are thus ensured.

In the state where no sheet M is attracted or held on the peripheral surface 11, the rotary drum 10 makes one rotation, and the electric discharge brush 82 is kept in contact with the peripheral surface in the meantime. Hence, the entire longitudinal region of the peripheral surface 11 can be discharged uniformly and reliably.

Since the charging roller 21 can be rotated in accordance with the rotation of the rotary drum 10, it does not become a load on the rotation of the rotary drum 10, and does not apply such an unnecessary force as will cause wrinkles or the like. On the contrary, the charging roller 21 serves to roll out the sheet M from the leading end to the trailing end, so that the tight contact of the sheet to the drum peripheral surface 11 can be remarkably enhanced.

When the charging roller 21 is in the advancing state, the roller position controller 29 can press it against the drum peripheral surface 11 by utilization of the urging force (tension) of the spring 29SP. Hence, the tight contact of the sheet M with reference to the drum peripheral surface 11 can be further enhanced.

The sheet loader 90 has not only a sheet feed function but also a posture adjustment function and a supply standby function. Hence, the sheet M can be fed toward the rotary drum 10 without skewing and can be held on the drum 10. In addition, the feeding operation for the next sheet M can be completed during the printing operation of the preceding sheet M. Accordingly, the holding, rotating and conveying operation and the printing operation can be executed at very high speed.

The supplementary charger section 26 is provided to compensate for the electrostatic attraction force attenuation which may occur when the sheet is held, rotated and fed and when a printing operation is being executed for the sheet. Accordingly, the holding, rotating and conveying operation can be performed very reliably.

The discharge section 70 is provided so that the electrostatic attraction force produced by the charger section 20 and the supplementary charger section 26 can be canceled after the holding, rotating and conveying operation (printing operation). Owing to this, the mechanical separation (release from the held state) by the sheet separator 140 can be performed smoothly.

An ink-jet printer according to the fifth embodiment of the present invention will now be described with reference to FIGS. 15 through 19.

Figure 15:
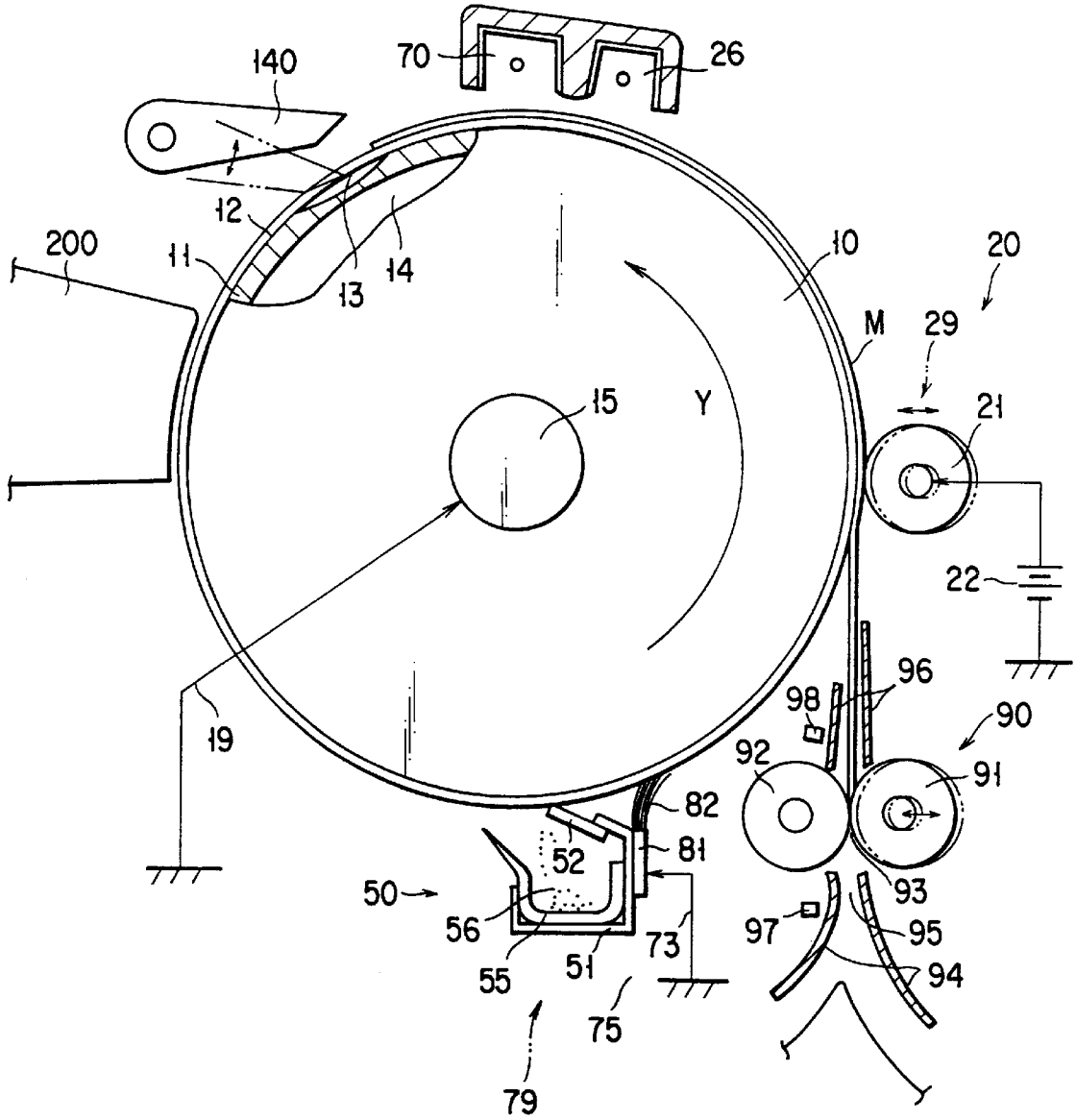
FIG. 15 a view showing the structure of a sheet holding system incorporated in an ink-jet printer according to the fifth embodiment of the present invention.

As shown in FIG. 15, this ink-jet printer comprises: a charger section 20 for charging at least one of a rotary drum 10 and a sheet M so as to provide an electrostatic attraction force; a discharge section 75 for removing charges that remain on the peripheral surface 11 of a rotary drum 10 after the sheet M is released from the held state; and a cleaner unit 50 for removing what is left on the peripheral surface 11 of the rotary drum 10. The printer is designed such that the charging for the next sheet can be executed after the residual charges are removed and such that residual substances on the peripheral surface 11 can be removed at an appropriate time.

Since this ink-jet printer has a substantially similar structure to that of the above-described embodiment, except on the points described below, similar or corresponding structural components will be denoted by the same reference numerals as used above, and a description of such structural components will be omitted or simplified.

As shown in FIG. 15, the rotary drum 10 has a hollow section 14 and is rotatable at a rate of 120 rpm, which enables multicolor printing of 20 PPM. A shaft 15, around which the drum 10 rotates, is grounded by means of a grounding line 19.

A dielectric layer 12 having a resistance (volume resistivity) in the range of $1\times10^{12}$ Ω·cm to $1\times10^{20}$ Ω·cm is formed on the peripheral surface 11 of the rotary drum 10. This is for allowing the surface potential of the rotary drum 10 to be higher than a predetermined value (e.g. 500V or higher) after charging. According to the present embodiment, the dielectric layer is made of a 25 μm-thick Mylar sheet tightly pasted on the peripheral surface 11. A groove section 13, into which the tip end of a sheet separator 140 can be inserted, is formed in part of the peripheral surface 11.

Arranged around the rotary drum 10 are: a sheet loader 90, a charger section 20 and a supplementary charger section 26 (which jointly constitutes a sheet holding system), a discharge section 70, a sheet separator 140, a print head section 200, the cleaner unit 50, and a discharge section 70. These structural components are arranged along the peripheral surface 11 of the rotary drum 10 in the order mentioned.

The sheet loader 90 is made up of a pair of loading rollers 91 and 92, and has not only a sheet feed function of feeding sheets toward the rotary drum 10, but also a posture adjustment function and a supply standby function.

The leading end of the sheet M fed from the downward region, as viewed in FIG. 15, collide with the contact portions 93 of the loading rollers 91 and 92, and is elastically deformed inside a guide 94. Therefore, the leading end of the sheet M is aligned in parallel with the shaft 15 of the rotary drum 10, and in this state it can be loaded to the rotary drum 10 without skewing. Inside the guide 94, the elastically recovering force of the sheet M promotes the posture adjustment. A sheet sensor 97 detects whether or not the sheet M enters into the posture adjustment process.

After the end of the posture adjustment, the loading rollers 91 and 92 move a sheet M toward the rotary drum 10 such that the sheet M passes along a guide 96 until the leading end of the sheet M comes to the position detectable by a sheet sensor 98. Since the leading end of the sheet M is clamped by the loading rollers 91 and 92, the trailing end of the sheet M can be released from the cassette feeder 71 or the manual feeder 61 located under the guide 94. The feeding step for the next sheet M has come to an end by this point of time, and the supply standby state toward the rotary drum 10 is established. This is effective in increasing the printing speed.

The sheet M can be supplied to the rotary drum 10 at a predetermined timing. After the leading end of the fed sheet M is held on the peripheral surface 11, one of the rollers (namely, roller 91) is moved in the rightward direction, as indicated by the two-dot-dash line in FIG. 15. Since the trailing end of the sheet M is therefore set in the free state, no load is imposed on the rotation or conveyance of the rotary drum 10.

In terms of the relationships with the discharge section 70 and the cleaner unit 50, the charger section 20 may be either a direct (contact) charging system made of a charging roller or the like, or an indirect (non-contact) charging system made of a corona discharge unit or the like. In the present embodiment, the former system is employed.

The charger section 20 is made up of: a charging roller 21 which is selectively switchable by a roller position controller 29 between the solid line state (contact) shown in FIG. 15 and the two-dot-dash line state (separated) also shown in the same Figure, and which is capable of directly charging the sheet M (or the dielectric layer 12) when it is in the contact state; and a power supply unit 22 which applies a voltage (e.g., DC+1.5 kV) to the charging roller 21.

The charging roller 21 is formed of conductive rubber having a resistance (volume resistivity) of $1\times10^6$ Ω·cm or lower. As this conductive rubber, polyurethane rubber, silicone rubber, or the like is employed. In the case of the present embodiment, polyurethane rubber is adopted.

The supplementary charger section 26, which constitutes a sheet holding system together with the charger section 20, is made of a corona discharger capable of removing positive charges by application of a voltage of 4 kV, for example. The corona discharger adds charges to the sheet M and maintains a constant electrostatic attraction force by compensating for charge attraction force attenuation which occurs during the rotation of the rotary drum 10 (particularly when a printing operation is executed by the print head section 200).

The charging roller 21 is designed such that it contacts the printing side of the sheet M and charges the printing side to produce an electrostatic attraction force. Alternatively, the charging roller 21 may be arranged on that side of the sheet M which is closer to the rotary drum 10, so as to charge the hold surface of the sheet M. In other words, the charging roller 21 is only required to charge at least one of the rotary drum 10 and the sheet M.

The discharge section 70 is made of a corona discharger capable of applying AC potential. Prior to the mechanical separation by the sheet separator 140, the charge attraction force between the peripheral surface 11 and the sheet M is canceled by the discharge section 70. The discharge section 70 provides charges of the opposite polarity to that of the charges provided by the supplementary charger section 26.

The cleaner unit 50 comprises a cleaning blade 52 formed of polyurethane rubber, and this cleaning blade 52 is fixed to one end of a case 51. The tip end (edge) of the cleaning blade 52 is made to contact the rotated drum peripheral surface 11, in such a manner that the cleaning blade form an acute angle with reference to the drum peripheral surface 11. By this cleaning blade 52, paper particles, fine dust particles or other undesirable substances which remain on the drum peripheral surface 11 can be scraped off. A dust box 55 defining a collection space 56 therein is arranged in the case in such a manner that it can be detached (pulled out). This structure is to enable easy disposable of collected paper particles or the like. An electric discharge brush 82, which is part of the discharge section 70, is attached to the case 51 by means of a holding member 81.

The electric discharge brush 82 and the cleaning blade 52 can be brought into contact with the peripheral surface 11 (dielectric layer 12) or separated therefrom. The movements of them are attained by a common elevator section 79 in the case of the present embodiment. To be more specific, the elevator section 79 vertically moves the case 51 such that the case 51 takes one of the lower position shown in FIG. 17, the first upper position shown in FIG. 16, and the second upper position shown in FIG. 15.

It is desirable that the discharge section 75 remove charges remaining on the drum peripheral surface 11 after printing is executed with respect to each sheet M. On the other hand, the removal of residual substances by the cleaning unit 50 is required once in a few days or in one day, so that the cleaning unit is designed to be a two-step lift system. The elevator section 79 may be a cam drive system similar to that of the roller position controller 29. Alternatively, it may be a solenoid drive system, an air cylinder drive system, a motor drive system, or the like.

A control unit 250 includes a CPU, a ROM, a RAM, etc., and can drive or control the entire printer. Of the structural components of the control unit 250, those which do not have direct relevance to the subject printer are not illustrated.

Figure 17:
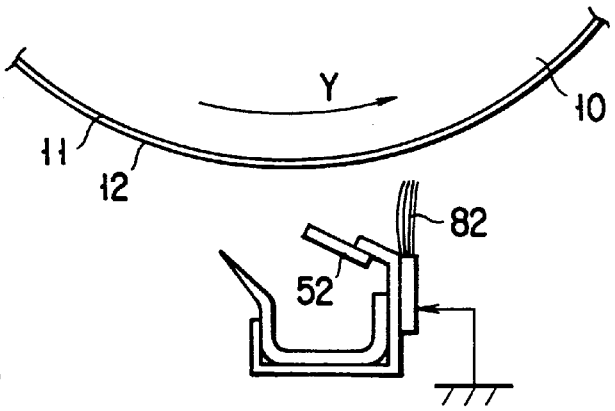
FIG. 17 is a view showing a state where the elevator section shown in FIG. 15 is located at the lower position.
Figure 18:
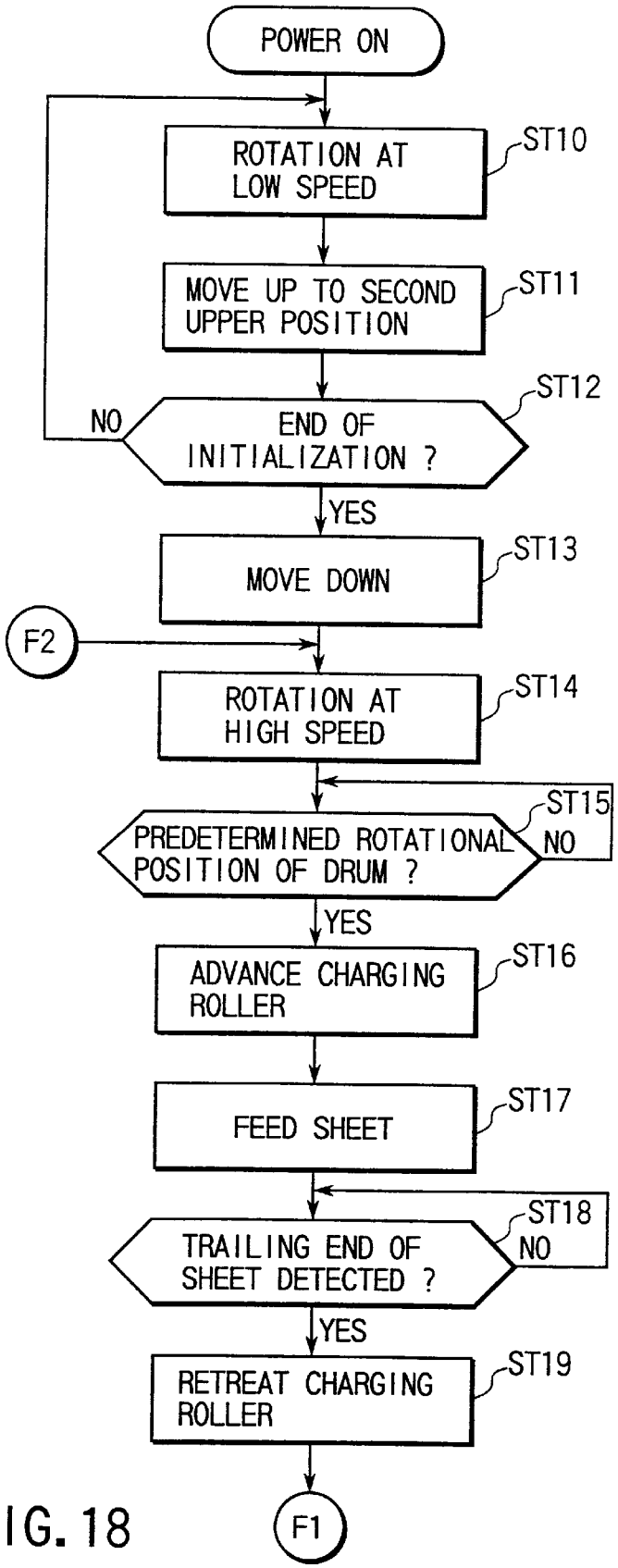
FIG. 18 is a flowchart illustrating the operation of a control unit provided for the sheet holding system shown in FIG. 15.
Figure 19:
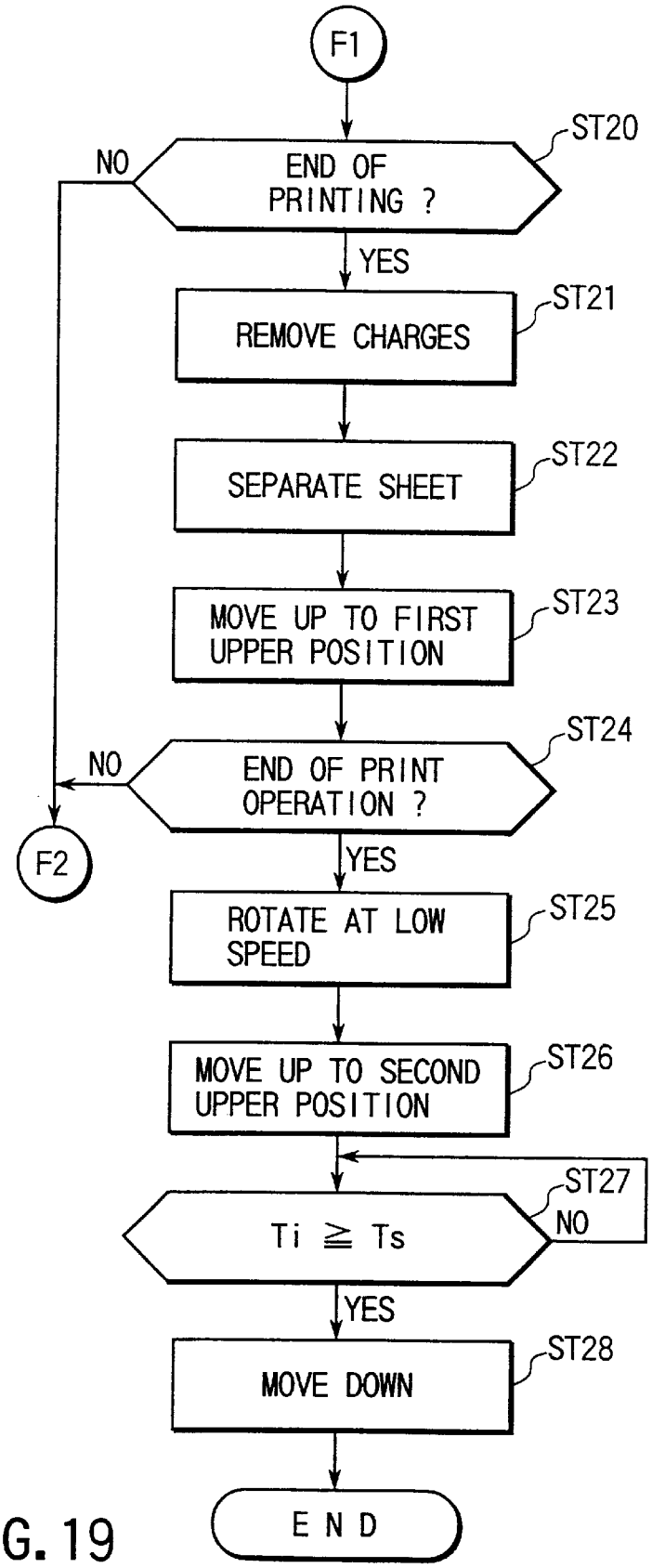
FIG. 19 is a flowchart illustrating the operation of the control unit and successive to the flowchart shown in FIG. 18.

In the case of the present embodiment, when the power supply is switched on, the control unit 250 actuates a main motor 10M in such a manner as to rotate at low speed (ST10 in FIG. 18), and simultaneously lifts the elevator section 79 from the position shown in FIG. 17 (the lower position) to the second upper position shown in FIG. 15 (ST11). Hence, the cleaning blade 52 can remove (scrape) attached particles or residual substances from the peripheral surface 11. The removed particles are collected in the dust box 55. Since the rotary drum 10 is in the low-speed rotating condition, stable removal is ensured, and the peripheral surface 11 and the cleaning blade 52 can withstand long use.

In addition, the electric discharge brush 82 is brought into contact with the dielectric layer 12 and removes residual charges remaining on the rotary drum 10. This initializing operation is completed automatically or by entering manual instructions ("YES" in ST12).

After the end of the initializing operation, the control unit 250 drives the elevator section 79 so as to move down the cleaning unit 50 and the discharge section 75 to the original lower position shown in FIG. 17 (ST13). In addition, the main motor 10M is switched into the high-speed rotation mode (ST14).

When a rotational position detector 10S detects that the rotary drum 10 has reached the predetermined rotational position (angle) ("YES" in ST15), the control unit 250 drives the sheet loader 90 so as to feed the sheet M, which is then in the supply standby state, toward the rotary drum 10 shown in FIG. 15 (ST17). The sheet M is fed at a moving speed corresponding to the circumferential speed of the drum.

Prior to this (or simultaneous with this), the control unit 250 drives the roller position controller 29 so as to advance the charging roller 21 from the two-dot-dash line state to the solid line state shown in FIG. 15 (ST16). The charging roller 21 is brought into contact with the drum peripheral surface 11 (dielectric layer 12) with a certain pressure. When or immediately before the charging roller 21 contacts the sheet M, the control unit 250 turns on the power supply unit 22 so as to apply a voltage to the charging roller 21.

Therefore, when the leading end of the fed sheet M has entered the region between the charging roller 21 (which is driven in accordance with the rotation of the rotary drum 10) and the dielectric layer 12, the sheet M can be charged. The leading end of the sheet M is charged, and the electrostatic attraction produced thereby permits the sheet M to be promptly attracted and held on the peripheral surface 11 of the rotary drum 10.

When the leading end of the sheet M has been held (this state is confirmed based on the output signals from the rotational position detector 10S in the case of the present embodiment), the control unit 250 moves one 91 of the loading rollers of the sheet loader 90 to the position indicated by the two-dot-dash line in FIG. 15. Since the trailing end of the sheet M is released from the rollers 91 and 92, no load is imposed on the rotation or conveyance performed by the rotary drum 10.

In this manner, the sheet M is attracted and held on the drum peripheral surface 11 (dielectric layer 12) with the electrostatic attraction force produced by the charger section 20. In this state, the sheet M is rotated and fed in the Y direction in accordance with the rotation of the rotary drum 10. The charging roller 21 is a driven member and presses the sheet M against the drum peripheral surface 11. Since it serves to roll out the sheet M from the leading end to the trailing end, the sheet M can be brought into tight contact with the dielectric layer 12.

When it is confirmed by the rotational position detector 10S that the trailing end of the sheet M has passed the charging roller 21 during one rotation of the drum 10 ("YES" in ST18), the roller position controller 29 causes the charging roller 21 to separate from the sheet M (dielectric layer 12) and retreat to the position indicated by the two-dot-dash line in FIG. 15 (ST19). Accordingly, the sheet M is attracted and held on the drum peripheral surface 11 by the electrostatic attraction force, and rotated and fed in the Y direction.

While the rotary drum 10 thereafter makes four rotations (second to fifth rotations), ink is jetted from the nozzle head (ink jet nozzle) 200, and printing is executed with respect to the sheet M that is being rotated and fed. The supplementary charger section 26 operates during this printing operation and maintains a constant electrostatic attraction force. The control unit 250 drives the sheet loader 90 so as to set the next sheet M into the supply standby state.

Multi-color printing is executed ("YES" in ST20 shown in FIG. 19) with respect to a sheet M (e.g., an A4 -size sheet) during four rotations of the rotary drum 10. After the end of this printing operation, the control unit 250 causes the discharge section 70 to remove the electrostatic attraction force from between the printed sheet M and the dielectric layer 12 (ST21). The control unit 250 further causes the sheet separator 140 to mechanically separate the leading end of the printed sheet M (ST22). The separated sheet M is transferred to a sheet feed-out mechanism 160 by the sheet separator 140.

Figure 16:
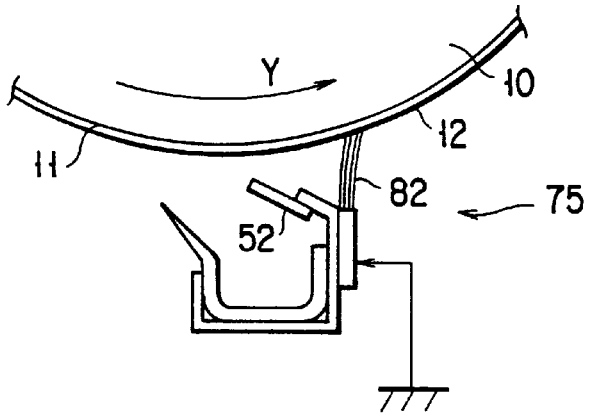
FIG. 16 is a view showing a state where the elevator section shown in FIG. 15 is located at the upper position.

The control unit 250 drives the elevator section 79 and lifts the electric discharge brush 82 to the first upper position shown in FIG. 16 (ST23), so as to hold, rotate and convey the next sheet M. Accordingly, the electric discharge brush 82 clears the dielectric layer 12 (which constitutes the peripheral surface 11) of remaining charges.

Thereafter, printing is executed, with each of sheets M successively held, rotated and fed. At the end of the printing operation ("YES" in ST24), the control unit 250 controls the main motor 10M to rotate at low speed again (ST25). In addition, the control unit 250 causes the elevator section 79 to lift the case 51 to the second upper position shown in FIG. 15 (ST26).

Therefore, the cleaning blade 52 removes residual particles or substances from the drum peripheral surface 11, and the electric discharge brush 82 removes the residual charges from the dielectric layer 12. These operations are executed for a predetermined length of time Ts (ST27). Subsequently, the case 51 is moved down to the lower position shown in FIG. 17 (ST28).

According to the present embodiment, the charger section 20 charges at least one of the rotary drum 10 and the sheet M so as to provide an electrostatic attraction force. The discharge section 75 removes charges that remain on the peripheral surface 11 of the rotary drum 10 after the sheet M is released from the held state. The cleaner unit 50 removes what is left on the peripheral surface 11 of the rotary drum 10. In addition to the use of these, the charging for the sheet M to be held next can be executed after the residual charges are removed, and what is left on the peripheral surface 11 can be removed at an appropriate time. Accordingly, satisfactory charging efficiencies are maintained and stabled. Hence, the sheet M can be held on the rotary drum 10 reliably and stably, and in this state it is rotated and fed.

The charging roller 21 of the charger section 20 is formed of conductive polyurethane rubber and is a contact charging system. Since it is brought into direct contact with the sheet M to be held and can directly charge that sheet M, the charging efficiency is remarkably high. In addition, since the held sheet M can be mechanically pressed against the peripheral surface 11 of the rotary drum 10, its tight contact with the peripheral surface 11 is further accelerated.

The resistance of the charging roller 21 is $1\times10^{6}$ Ω·cm or lower, and the dielectric layer 12 having a resistance in the range of $1\times10^{12}$ Ω·cm to $1\times10^{20}$ Ω·cm is formed on the peripheral surface 11 of the rotary drum 10. In addition, the discharge section 75 is made of an electric discharge brush 82 of an air-earth discharge system, and the cleaning blade 52 of the cleaner section 50 is formed of polyurethane rubber. Accordingly, the charging efficiency is remarkably enhanced, and particles or charges that remain on the peripheral surface 11 of the rotary drum 10 can be removed without any damage to the peripheral surface.

The charging roller 21, the electric discharge bush 52 and the cleaning blade 52 are movable closer to, and away from the peripheral surface 11 (i.e., the dielectric layer 12) of the rotary drum 10. Accordingly, the peripheral surface 11 of the rotary drum 10, the charging roller 21, the cleaning blade 52 and the electric discharge brush 82 are allowed to withstand long use, and the sheet M held on the rotary drum is not interfered with.

Since the charging roller 21 is a driven member which is rotated in accordance with the rotation of the rotary drum 10, it does not become a load on the rotation of the rotary drum 10, and does not apply such an unnecessary force as will cause wrinkles or the like. On the contrary, the charging roller 21 serves to roll out the sheet M from the leading end to the trailing end, so that the tight contact of the sheet to the drum peripheral surface 11 can be remarkably enhanced.

When the charging roller 21 is in the advancing state, the roller position controller 29 can press it against the drum peripheral surface 11 by utilization of the urging force (tension) of the spring 29SP. Hence, the tight contact of the sheet M with reference to the drum peripheral surface 11 can be further enhanced.

The elevator section 79 can lift the case 51 such that the case 51 can be positioned at two upper positions. Accordingly, charges can be removed from a sheet M each time printing is performed, and paper particles or similar substances can be removed from the drum peripheral surface 11 (at an arbitrary time) after the end of the printing operation.

The sheet loader 90 has not only a sheet feed function but also a posture adjustment function and a supply standby function. Hence, the sheet M can be fed toward the rotary drum 10 without skewing and can be held on the drum 10. In addition, the feeding operation for the next sheet M can be completed during the printing operation of the preceding sheet M. Accordingly, the holding, rotating and conveying operation and the printing operation can be executed at very high speed.

The supplementary charger section 26 is provided to compensate for the electrostatic attraction force attenuation which may occur when the sheet is held and fed by rotation, and when a printing operation is being executed for the sheet. Accordingly, the holding, rotating and conveying operation can be performed very reliably.

The discharge section 70 is provided so that the electrostatic attraction force produced by the charger section 20 and the supplementary charger section 26 can be canceled after the holding, rotating and conveying operation (printing operation). Owing to this, the mechanical separation (release from the held state) by the sheet separator 140 can be performed smoothly.

The dust box 55 is provided for the case 51 such that it can be detached or pulled out. With this structure, the removed (scraped) paper particles, fine dust particles, etc. can be easily disposed of.

An ink-jet printer according to the sixth embodiment of the present invention will now be described with reference to FIG. 20.

Figure 20:
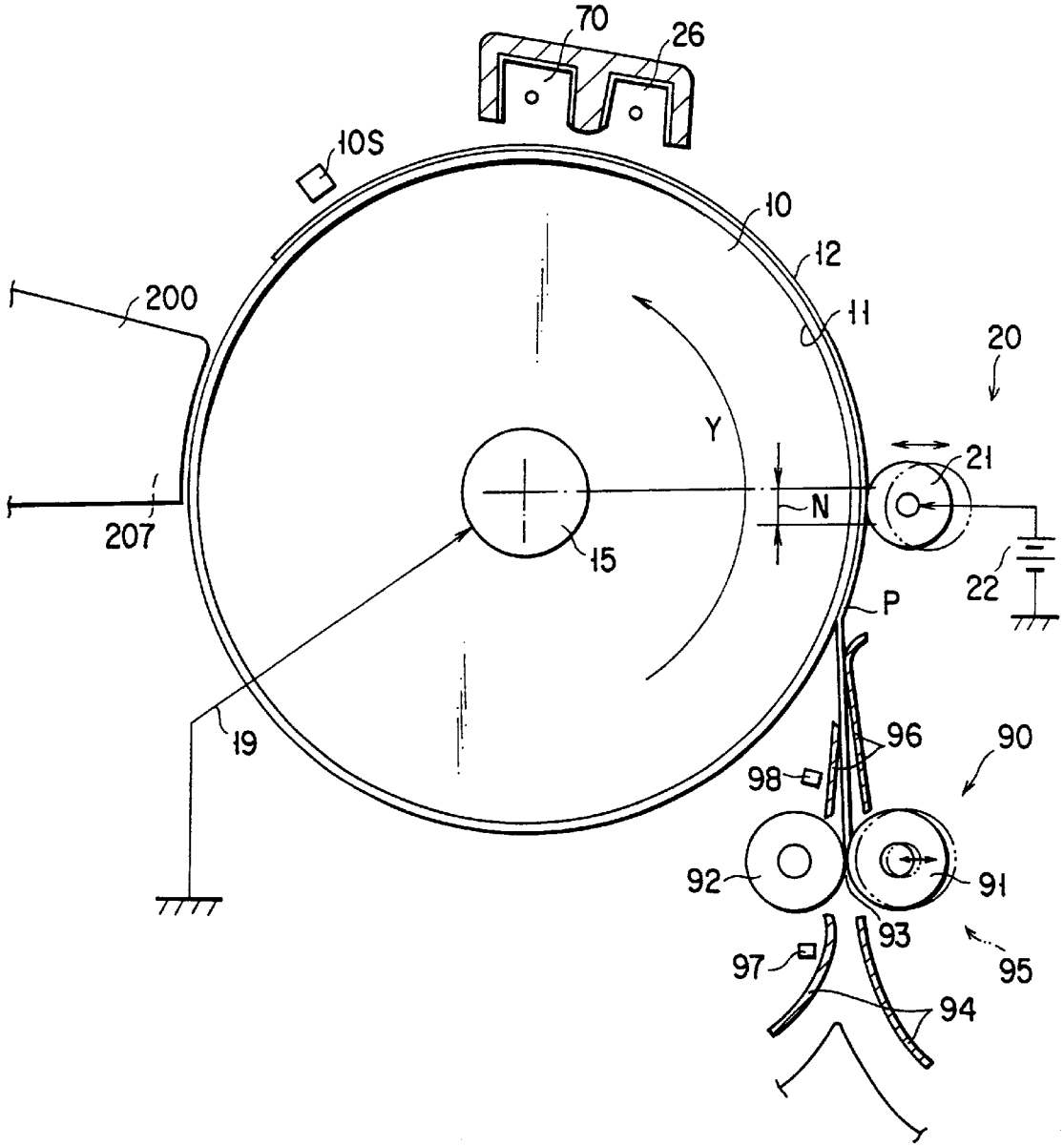
FIG. 20 is a view showing the structure of a sheet holding system incorporated in an ink-jet printer according to the sixth embodiment of the present invention.

As shown in FIG. 20, this ink-jet printer is designed such that a sheet M can be held on a rotary drum 10 by utilization of an electrostatic attraction force produced by a charging roller 21, such that the sheet M held on the rotary drum 10 can be rotated and fed by utilization of the rotation of the drum 10, and such that the charging roller 21 can perform charging by pressing the sheet fed by a sheet loader 90 against the peripheral surface 11 of the rotary drum.

Since this ink-jet printer has a substantially similar structure to that of the above-described embodiment, except on the points described below, similar or corresponding structural components will be denoted by the same reference numerals as used above, and a description of such structural components will be omitted or simplified.

As shown in FIG. 20, the rotary drum 10 is rotatable at a rate of 120 rpm, which enables multicolor printing of 20 PPM. A shaft 15, around which the drum 10 rotates, is grounded by means of a grounding line 19.

A dielectric layer 12 having a resistance (volume resistivity) in the range of $1\times10^{12}$ Ω·cm to $1\times10^{20}$ Ω·cm is formed on the peripheral surface 11 of the rotary drum 10. This is for allowing the surface potential of the rotary drum 10 to be higher than a predetermined value (e.g. 500V or higher) after charging. According to the present embodiment, the dielectric layer is made of a 25 μm-thick Mylar (polyester film) sheet tightly pasted on the peripheral surface 11. A groove section (not shown), into which the tip end of a sheet separator 140 can be temporarily inserted, is formed in part of the peripheral surface 11.

Arranged around the rotary drum 10 are: a sheet loader 90, a charger section 20 (charging roller 21) and a supplementary charger section 26 (a corona discharger), a sheet separator 140 (not shown) and a print head section 200. These structural components are arranged from upstream to downstream regions with respect to the rotating (Y) direction in the order mentioned.

The sheet loader 90 is made up of a pair of loading rollers 91 and 92, and has not only a sheet feed function of feeding sheets toward the rotary drum 10, but also a posture adjustment function and a supply standby function for the sheet M.

The leading ends of sheets M fed from the downward region, as viewed in FIG. 20, collide with the contact portions 93 of the rollers 91 and 92, and are elastically deformed inside a guide 94 arranged upstream. Therefore, the leading end of the sheet M is aligned in parallel with the shaft 15 of the rotary drum 10, and in this state they can be loaded without skewing. Inside the guide 94, the elastically recovering force of the sheet M promotes the posture adjustment. A sheet sensor 97 detects whether or not the sheet M enters into the posture adjustment process.

After the end of the posture adjustment, the loading rollers 91 and 92 move a sheet M toward the rotary drum 10 until the leading end of the sheet M comes to the position detectable by a sheet sensor 98. Since the leading end of the sheet M is clamped by the loading rollers 91 and 92, the trailing end of the sheet M can be released from the cassette feeder 71 or the manual feeder 61 located under the guide 94. The feeding step for the next sheet M has come to an end by this point of time, and the supply standby state toward the rotary drum 10 is established. This is effective in increasing the printing speed.

The sheet M can be supplied to the peripheral surface 11 of the rotary drum 10 at a predetermined timing. Let us assume that the feed position at which the fed sheet M first contacts the rotary drum 10, i.e., the loading point on the peripheral surface 11, is indicated by P. After the leading end of the fed sheet M is held on the peripheral surface 11 by means of a negative-pressure suction holder section (not shown), one of the rollers (namely, roller 91) is moved in the rightward direction by a roller position controller 95, as indicated by the two-dot-dash line in FIG. 20. Since the trailing end of the sheet M is therefore set in the free state, no load is imposed on the rotation of the rotary drum 10. Incidentally, the roller position controller 95 is designed in a similar manner to that of a roller position controller 29, which will be detailed later.

The charging roller 21 is a direct (contact) charging system. It is applied with DC 1.5 kV by a power supply unit 22, and can be pressed against the peripheral surface 11 by the urging force provided by a spring 29SP.

The charging roller 21 is selectively switchable by the roller position controller 29 between the solid line state (contact) shown in FIG. 20 and the two-dot-dash line state (separated) also shown in the same Figure. The charging roller 21 is made of a conductive rubber roller having a resistance (volume resistivity) of $1\times10^{6}$ Ω·cm or lower. The charging roller 21 has a rubber hardness of 20±5 degrees (JIS, A Scale), and can provide a great nip width N, as shown in FIG. 20. The conductive rubber is specifically polyurethane rubber (UR . . . polyester isocyanate), silicone rubber, or the like. In the case of this embodiment, a conductive polyurethane rubber roller is employed.

The charging roller 21 is arranged downstream of the loading point P and is very close thereto. The charging roller 21 is movable in such a way as to contact the peripheral surface 11. To be more specific, the charging roller 21 is located as close as possible to the loading point, as long as the leading end of the fed sheet M does not collide with the charging roller 21 when this roller 21 is in contact with the peripheral surface 11. This structure is to enable the leading end of the fed sheet M to be immediately charged. It should be noted that the sheet can be rotated and fed in a reliable manner by causing the leading end thereof to be reliably attracted and held on the peripheral surface 11.

The corona discharger 25 of the supplementary charger section removes positive charges by application of a voltage of 4 (+2, −0) kV, for example. The corona discharger adds charges to the sheet M and maintains a constant electrostatic attraction force by compensating for charge attraction attenuation which occurs during the rotation of the rotary drum 10 (particularly when a printing operation is executed by the nozzle head 200).

A discharge section 70 is made of a corona discharger capable of applying AC potential. Prior to the mechanical separation by the sheet separator 140, the electrostatic attraction force between the peripheral surface 11 and the sheet M is canceled by the discharge section 70. The discharge section 70 provides charges of the opposite polarity to that of the charges provided by the supplementary charger section 26.

A control unit 250 includes a CPU, a ROM, a RAM, etc., and can drive or control the entire printer. Of the structural components of the control unit 250, those which do not have direct relevance to the subject printer are not illustrated.

In the case of the present embodiment, when the power supply is switched on, the control unit 250 actuates a main motor 10M. When a rotational position detector 10S detects that the rotary drum 10 has reached the predetermined rotational position (angle), the control unit 250 drives the sheet loader 90 so as to feed the sheet M, which is then in the supply standby state, toward the rotary drum 10 shown in FIG. 20. The sheet M is fed at a moving speed corresponding to the circumferential speed of the drum.

Prior to this (or simultaneous with this), the control unit 250 drives the roller position controller 20 so as to advance the charging roller 21 from the two-dot-dash line state to the solid line state shown in FIG. 20. That is, the advancing movement of the charging roller 21 is executed no later than a time which is immediately before the loading point P comes close. The charging roller 21 is brought into contact with the drum peripheral surface 11 (dielectric layer 12) with a certain pressure produced by the urging force (tension) of a spring 29SP. When or immediately before the charging roller 21 contacts the sheet M, the control unit 250 turns on the power supply unit 22 so as to apply a voltage to the charging roller 21.

As soon as the leading end (loading point P) of the fed sheet M enters the region between the charging roller 21 (which is driven in accordance with the rotation of the rotary drum 10) and the dielectric layer 12, the sheet M can be charged. That is, the leading end of the sheet M can be charged, and the electrostatic attraction produced thereby permits the sheet M to be immediately attracted and held on the peripheral surface 11 of the rotary drum 10.

When the leading end of the sheet M has been held (this state is confirmed based on the output signals from the rotational position detector 10S in the case of the present embodiment), the control unit 250 actuates the roller position controller 95 such that one of the loading rollers of the sheet loader 90 (namely, roller 91) to the position indicated by the two-dot-dash line in FIG. 20. Since the trailing end of the sheet M is released from the rollers 91 and 92, no load is imposed on the rotation or conveyance performed by the rotary drum 10.

Since the charging roller 21 has a hardness of 20±5 degrees and is pressed against the dielectric layer 12, it is possible to provide a great nip width N, as shown in FIG. 20. Accordingly, the charging operation can be performed smoothly and stably. In addition, since the charges produced by friction can be utilized, the sheet M can be held very reliably. Furthermore, since the dielectric layer 12 has a very high resistance, the charging efficiency is remarkable.

In this manner, the sheet M is attracted and held on the drum peripheral surface 11 (dielectric layer 12) by the electrostatic attraction force produced by the charger section 20, and is further pressed against the drum peripheral surface 11 by the charging roller 21. In this state, the sheet M is rotated and fed in the Y direction in accordance with the rotation of the rotary drum 10. The charging roller 21 is a driven member and presses the sheet M against the drum peripheral surface 11. Since it serves to roll out the sheet M from the leading end to the trailing end, the sheet M can be brought into tight contact with the dielectric layer 12.

When it is confirmed by the rotational position detector 10S that the trailing end of the sheet M has passed the charging roller 21 during one rotation of the drum 10, the roller position controller 29 causes the charging roller 21 to separate from the sheet M (dielectric layer 12) and retreat to the position indicated by the two-dot-dash line in FIG. 20. This means that the charging roller 21 is in the separate state when it is not charging the sheet M. Accordingly, the sheet M is attracted and held on the drum peripheral surface 11 by the electrostatic attraction force alone, and rotated and fed in the Y direction.

While the rotary drum 10 thereafter makes four rotations (second to fifth rotations), ink is jetted from the print head section 200, and printing is executed with respect to the sheet M that is being rotated and fed. The supplementary charger section 26 operates during this printing operation and maintains a constant electrostatic attraction force. The control unit 250 drives the sheet loader 90 so as to set the next sheet M into the supply standby state.

Multi-color printing is executed with respect to a sheet M (e.g., a A4 -size sheet) during four rotations of the rotary drum 10. After the end of this printing operation, the control unit 250 causes the discharge section 70 to remove the electrostatic attraction force from between the printed sheet M and the dielectric layer 12. The control unit 250 further causes the sheet separator 140 to mechanically separate the leading end of the printed sheet M. The separated sheet M is transferred to a sheet feed-out mechanism 160 by the sheet separator 140.

According to the present embodiment, a sheet M can be held on the rotary drum 10 by utilization of an electrostatic attraction force produced by the charging roller 21. The sheet M held on the rotary drum 10 can be rotated and fed by utilization of the rotation of the drum 10. The charging roller 21 can perform charging by pressing the sheet fed by the sheet loader 90 against the peripheral surface 11 of the rotary drum. With this structure, not only the electrostatic attraction force produced by charging but also the electrostatic attraction force produced by friction can be utilized. Hence, the holding, rotating and conveying operation can be performed reliably and stably.

The dielectric layer 12 formed on the peripheral surface 11 of the rotary drum 10 has a resistance in the range of $1\times10^{12}$ Ω·cm to $1\times10^{20}$ Ω·cm. In addition, the charging roller 21 is made of a conductive rubber roller which has a resistance of $1\times10^{6}$ Ω·cm or lower and which has a rubber hardness of 20±5 degrees. Owing to this structure, a remarkable charging efficiency is ensured. Moreover, since a great nip width can be provided, problems such as irregular charging and an unstable operation can be solved, and the electrostatic attraction force due to the friction charging can be remarkably strong. Hence, the holding, rotating and conveying operation can be performed further reliably and stably.

The charging roller 21 is movable closer to, and away from the peripheral surface 11 or the dielectric layer 12 of the rotary drum 10. In addition, the charging roller 21 can be kept in the separated state when it does not perform charging. The charging roller 21 does not interfere with the sheet or other objects after it uniformly charges the sheet from the leading end to the trailing end. Hence, the charging roller 21 does not have adverse effects on the print quality.

Since the charging roller 21 is a driven member which is rotated in accordance with the rotation of the rotary drum 10, it does not become a load on the rotation of the rotary drum 10, and does not apply such an unnecessary force as will cause wrinkles or the like. On the contrary, the charging roller 21 serves to roll out the sheet M from the leading end to the trailing end, so that the tight contact of the sheet to the drum peripheral surface 11 can be remarkably enhanced.

When the charging roller 21 is in the advanced (contact) state, the roller position controller 29 can press it against the drum peripheral surface 11 by utilization of the urging force (tension) of the spring 29SP. Hence, the tight contact of the sheet M with reference to the drum peripheral surface 11 can be further enhanced.

The sheet loader 90 has not only a sheet feed function but also a posture adjustment function and a supply standby function. Hence, the sheet M can be fed toward the rotary drum 10 without skewing and can be held on the drum 10. In addition, the feeding operation for the next sheet M can be completed during the printing operation of the preceding sheet M. Accordingly, the holding, rotating and conveying operation and the printing operation can be executed at very high speed.

In addition, since the sheet loader 90, the charger section 20, the sheet separator 140 and the print head section 200 are arranged in the rotating direction of the drum 10 in the order mentioned, the operations between the sheet feed and sheet separation can be successively performed in a very stable manner, with the charging operation executed in the meantime.

Moreover, the charger section 20 is made of a charging roller 21 capable of rotating while being pressed against the peripheral surface 11, and is arranged downstream of the position P on the peripheral surface, at which the leading end of the sheet M fed by the sheet loader 90 contacts the peripheral surface 11 for the first time. Since this structure enables the leading end of the fed sheet M to be immediately charged, the attracting and holding operation and the rotating and conveying operation can be performed in a very stable manner.

The supplementary charger section 26 is provided to compensate for the electrostatic attraction force attenuation which occurs during the holding, rotating and conveying operation and during the printing operation. Accordingly, the holding, rotating and conveying operation can be performed in a further reliable manner.

The discharge section 70 is provided so that the electrostatic attraction force produced by the charging section 20 can be canceled after the holding, rotating and conveying operation (printing operation). With this structure, the mechanical separation (the release from the held state) can be executed smoothly.

An ink-jet printer according to the seventh embodiment of the present invention will now be described with reference to FIG. 21.

Figure 21:
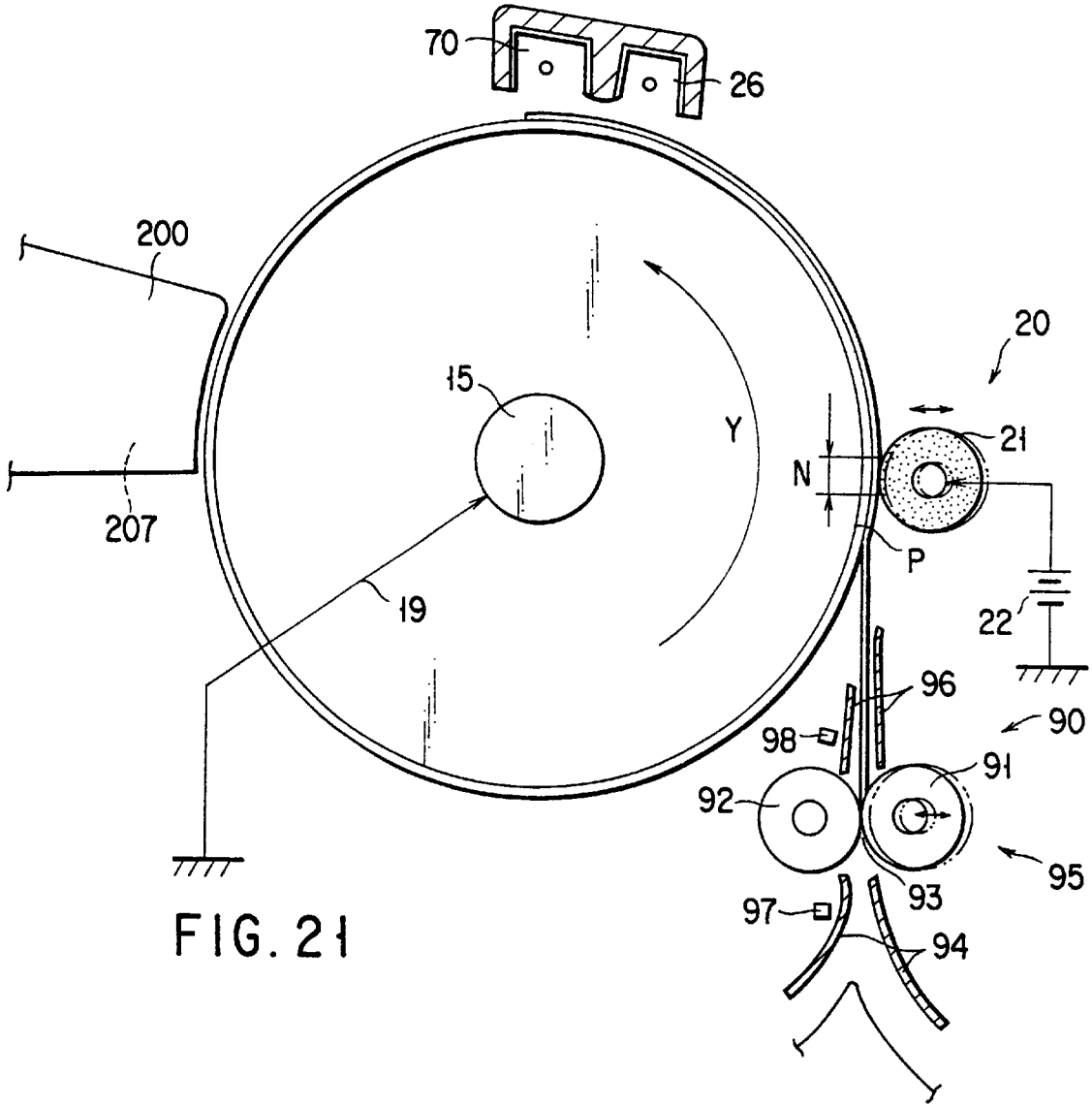
FIG. 21 is a view showing the structure of a sheet holding system incorporated in an ink-jet printer according to the seventh embodiment of the present invention.

As shown in FIG. 21, this ink-jet printer is designed such that a sheet M can be held on the peripheral surface 11 of a rotary drum 10 (which rotates at a constant circumferential speed) by utilization of an electrostatic attraction force produced by a charging roller 21, such that characters or images can be printed on the sheet M in the rotating state by jetting ink from an ink jet nozzle 207, and such that the charging roller 21 can contact the sheet M, with a predetermined nip width N defined, can also press the sheet M against the peripheral surface 11 of the rotary drum 10, and can further rotate independently of the rotation of the rotary drum 10.

Since this ink-jet printer has a substantially similar structure to that of the above-described embodiment, except on the points described below, similar or corresponding structural components will be denoted by the same reference numerals as used above, and a description of such structural components will be omitted or simplified.

As shown in FIG. 21, the rotary drum is a rotary drum 10 that is rotated by a main motor 10M at a rate of 120 rpm, which enables multicolor printing of 20 PPM. A shaft 15, around which the drum 10 rotates, is grounded by means of a grounding line 19.

A dielectric layer 12 having a resistance (volume resistivity) in the range of $1\times10^{12}$ Ω·cm to $1\times10^{20}$ Ω·cm is formed on the peripheral surface 11 of the rotary drum 10. This is for allowing the surface potential of the rotary drum 10 to be higher than a predetermined value (e.g. 500V or higher) after charging. According to the present embodiment, the dielectric layer is made of a 25 μm-thick Mylar (polyester film) sheet tightly pasted on the drum peripheral surface 11.

Arranged around the rotary drum 10 are: a sheet loader 90, a charger section 20 (charging roller 21) which constitutes a sheet holding system, a supplementary charger section 26 (a corona discharger), a discharge section 70 (a corona discharger), a sheet separator (not shown) and a nozzle (print) head 200. These structural components are arranged from upstream to downstream regions with respect to the rotating (Y) direction in the order mentioned.

The sheet loader 90 is made up of a pair of loading rollers 91 and 92, and has not only a sheet feed function of feeding sheets toward the rotary drum 10, but also a posture adjustment function and a supply standby function for the sheet M.

The leading end of the sheet M fed from the downward region, as viewed in FIG. 1, collide with the contact portion 93 of the rollers 91 and 92, and is elastically deformed inside a guide 94 arranged upstream. Therefore, the leading end of the sheet M is aligned in parallel with the shaft 15 of the rotary drum 10, and in this state it can be loaded without skewing. Inside the guide 94, the elastically recovering force of the sheet M promotes the posture adjustment. A sheet sensor 97 detects whether or not the sheet M enters into the posture adjustment process.

After the end of the posture adjustment, the loading rollers 91 and 92 move a sheet M along a downstream-side guide 96 toward the rotary drum 10 until the leading end of the sheet M comes to the position detectable by a sheet sensor 98. Since the leading end of the sheet M is clamped by the loading rollers 91 and 92, the trailing end of the sheet M can be released from the cassette feeder 71 or the manual feeder 61 located under the guide 94. The feeding step for the next sheet M has come to an end by this point of time, and the supply standby state toward the rotary drum 10 is established. This is effective in increasing the printing speed.

The sheet M can be supplied to the rotary drum 10 at a predetermined timing. Let us assume that the feed position at which the fed sheet M first contacts the rotary drum 10, i.e., the loading point on the peripheral surface 11, is indicated by P. After the leading end of the fed sheet M is held on the peripheral surface 11 by means of a negative-pressure suction holder section or a clamp-claw holder section (neither is shown), one of the rollers (namely, roller 91) is moved in the rightward direction by a roller position controller 95, as indicated by the two-dot-dash line in FIG. 21. Since the trailing end of the sheet M is therefore set in the free state, no load is imposed on the rotation or conveyance performed by the rotary drum 10. Incidentally, the roller position controller 95 is designed in a similar manner to that of a roller position controller 29, which will be detailed later.

The charging roller 21 is a direct (contact) charging system. It is applied with a voltage of DC 0.5 to 2.0 kV by a power supply unit 22 by way of the shaft, and can be pressed against the peripheral surface 11 by the urging force provided by a spring 29SP. In the case of the present embodiment, the charging roller 21 is urged toward the rotary drum shaft 15, with a force of 250 gf to 500 gf.

The charging roller 21 is selectively switchable by the roller position controller 29 between the solid line state (contact) shown in FIG. 21 and the two-dot-dash line state (separated) also shown in the same Figure. The charging roller 21 is made of a conductive low-expansion foaming polyurethane rubber roller having a resistance (volume resistivity) of $1\times10^6$ Ω·cm or lower. The charging roller 21 has a small-value rubber hardness of 20±5 degrees (JIS, A Scale), and can provide an increased nip width N (FIG. 21) of 0.5 to 2.0 mm by utilization of the urging force of the spring 29SP. This structure enhances the charging efficiency and improves the pressing contact characteristic. The polyurethane rubber mentioned above may be replaced with silicone rubber or the like.

Figure 22:
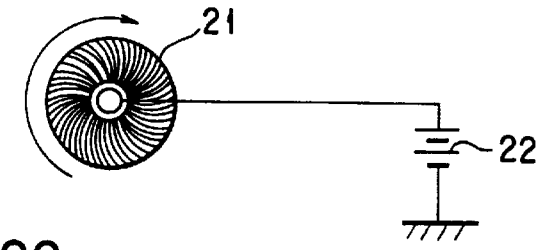
FIG. 22 is a view showing a modification of a charging roller shown in FIG. 21.

The charging roller 21 may be of such a brush structure as is shown in FIG. 22. For example, conductive fibers which have a diameter of 6 deniers and a resistance in the range of $1\times10^5$ Ω·cm to $1\times10^8$ Ω·cm and which provide satisfactory characteristics are embedded in a brush body at a predetermined density (e.g., 100,000 fibers/$cm^2$), so as to fabricate a rotatable brush. Although the resistance may be $10^8$ Ω·cm as against $10^6$ Ω·cm of the rubber roller, the fiber density is so high that the nip width provided by the rotatable brush is greater than that of the rubber roller even if the nip amounts of them are the same. Accordingly, the effects of the rotatable brush are similar to those of the rubber roller.

The charging roller 21 can rotate independently of the rotation of the rotary drum 10. Assuming that the drum circumferential speed is "1", the circumferential speed of the charging roller 21 is preferably determined to be within a range of "1" to "0.98". The reason for determining the circumferential speed to be within this range is to cause a tension (roll-out force) to act from the leading end to the trailing end of the sheet M. In other words, the circumferential speed of the charging roller 21 is determined in such a manner as to prevent the trailing end from getting ahead of the other portions of the sheet M and in due consideration of the control characteristics. The circumferential speed of the charging roller 21 is controlled by driving a charging roller motor (not shown) under the control by a control unit 250.

The charging roller 21 is arranged downstream of the loading point P and is very close thereto. The charging roller 21 is movable in such a way as to contact the peripheral surface 11. To be more specific, the charging roller 21 is located as close as possible to the loading point P, as long as the leading end of the fed sheet M does not collide with the charging roller 21 when this roller 21 is in contact with the peripheral surface 11. This structure is to enable the leading end of the fed sheet M to be immediately charged. It should be noted that the sheet can be rotated and fed in a reliable manner by causing the leading end thereof to be reliably attracted and held on the peripheral surface 11.

The corona discharger of the supplementary charger section 26 removes positive charges by application of a voltage of 4 (+2, −0) kV, for example. The corona discharger adds charges and maintains a constant electrostatic attraction force by compensating for charge attraction attenuation which occurs during the rotation of the rotary drum 10 (particularly when a printing operation is executed by the print head section 200).

The discharge section 70 is made of a corona discharger capable of applying AC potential. Prior to the mechanical separation by the sheet separator (not shown), the electrostatic attraction force between the peripheral surface 11 and the sheet M is canceled by the discharge section 70. The discharge section 70 provides charges of the opposite polarity to that of the charges provided by the supplementary charger section 26.

The control unit 250 includes a CPU, a ROM, a RAM, etc., and can drive or control the entire printer. Of the structural components of the control unit 250, those which do not have direct relevance to the subject printer are not illustrated.

In the case of the present embodiment, when the power supply is switched on, the control unit 250 actuates a main motor 10M. When a rotational position detector 10S detects that the rotary drum 10 has reached the predetermined rotational position (angle), the control unit 250 drives the sheet loader 90 so as to feed the sheet M, which is then in the supply standby state, toward the rotary drum 10 shown in FIG. 21. The sheet M is fed at a moving speed corresponding to the circumferential speed of the drum.

Prior to this (or simultaneous with this), the control unit 250 drives the roller position controller 20 so as to advance the charging roller 21 from the two-dot-dash line state to the solid line state shown in FIG. 21. That is, the advancing movement of the charging roller 21 is executed no later than a time which is immediately before the loading point P comes close. The charging roller 21 is brought into contact with the drum peripheral surface 11 (dielectric layer 12) with a certain pressure (259 gf to 500 gf) produced by the urging force (tension) of a spring 29SP. When or immediately before the charging roller 21 contacts the sheet M, the control unit 250 turns on the power supply unit 22 so as to apply a voltage to the charging roller 21.

As soon as the leading end (loading point P) of the fed sheet M enters the region between the charging roller 21 (which is rotated independently) and the dielectric layer 12, the sheet M can be charged. That is, the leading end of the sheet M can be charged, and the electrostatic attraction produced thereby permits the sheet M to be immediately attracted and held on the peripheral surface 11 of the rotary drum 10.

When the leading end of the sheet M has been held (this state is confirmed based on the output signals from the rotational position detector 10S in the case of the present embodiment), the control unit 250 actuates the roller position controller 95 such that one of the loading rollers of the sheet loader 90 (namely, roller 91) to the position indicated by the two-dot-dash line in FIG. 21. Since the trailing end of the sheet M is released from the rollers 91 and 92, no load is imposed on the rotation or conveyance performed by the rotary drum 10.

Since the charging roller 21 has a hardness of 20±5 degrees, and is pressed tightly against the dielectric layer 12, an increased nip width N (0.5 to 2.0 mm) can be provided. Therefore, irregular charging is prevented, and stable charging is ensured. In addition, since the charges produced by friction charging can also be utilized, the sheet M can be held further reliably. Moreover, since the dielectric layer 12 has a very high electric resistance, the charging efficiency is remarkably high.

As described above, the sheet M can be attracted and held on the drum peripheral surface 11 (dielectric layer 12) by utilization of the electrostatic attraction force provided by the charging roller 21 of the charger section 20. In addition, the sheet M is pressed by the charging roller 21 and is thus brought into tight contact with the drum peripheral surface 21. In this state, the sheet M is rotated and fed in the Y direction in accordance with the rotation of the rotary drum 10. The charging roller 21 is independently rotatable at a circumferential speed of "0.98", as against "1" of the drum circumferential speed, and is pressed tightly against the peripheral surface 11. Since the charging roller 21 serves to roll out the sheet M from the leading end to the trailing end, the tight contact between the sheet M and the dielectric layer 12 can be further improved, and the sheet M is reliably prevented from separating from the drum and deforming.

When it is confirmed by the rotational position detector 10S that the trailing end of the sheet M has passed the charging roller 21 during one rotation of the drum 10, the roller position controller 29 causes the charging roller 21 to separate from the sheet M (dielectric layer 12) and retreat to the position indicated by the two-dot-dash line in FIG. 21. This means that the charging roller 21 is in the separate state when it is not charging the sheet M. Accordingly, the sheet M is attracted and held on the drum peripheral surface 11 by the electrostatic attraction force alone, and rotated and fed in the Y direction.

The charging roller 21 may be separated from the drum after the drum makes one rotation, with the sheet M held thereon.

While the rotary drum 10 thereafter makes four rotations (second to fifth rotations), ink is jetted from the nozzle head (ink jet nozzle) 200, and printing is executed with respect to the sheet M that is being rotated and fed. The supplementary charger section 26 operates during this interval and maintains a constant electrostatic attraction force. The control unit 250 drives the sheet loader 90 so as to set the next sheet M into the supply standby state.

Multi-color printing is executed with respect to a sheet M (e.g., a A4 -size sheet) during four rotations of the rotary drum 10. After the end of this printing operation, the control unit 250 causes the discharge section 70 to remove the electrostatic attraction force from between the printed sheet M and the dielectric layer 12. The control unit 250 further causes the sheet separator to mechanically separate the leading end of the printed sheet M. The separated sheet M is transferred to a sheet feed-out mechanism 160 by the sheet separator 140, which also functions as a transfer means.

According to the present embodiment, a sheet M can be held on the peripheral surface 11 of the rotary drum 10 (which rotates at a constant circumferential speed) by utilization of an electrostatic attraction force produced by the charging roller 21. Characters or images can be printed on the sheet M in the rotating state by jetting ink from the ink jet nozzle 207. The charging roller 21 can contact the sheet M, with a predetermined nip width N defined, can also press the sheet M against the peripheral surface 11 of the rotary drum 10, and can further rotate independently of the rotation of the rotary drum 10. Since this structure enables the sheet M to be pulled (ironed) rearward, wrinkles, deformation and irregular charging are prevented. In addition, not only the electrostatic attraction force produced by charging but also the electrostatic force produced by friction charging can be utilized. Accordingly, the sheet M can be held reliably and stably.

Since the dielectric layer 12 having a resistance of $1\times10^{12}$ Ω·cm to $1\times10^{20}$ Ω·cm is formed on the peripheral surface 11 of the rotary drum 10, the charging efficiency can be remarkably enhanced.

The charging roller 21 is made of a conductive low-expansion foaming polyurethane rubber roller having a resistance of $1\times10^{6}$ Ω·cm or lower. With this structure, a high feeding efficiency can be provided and an intended nip width can be stably maintained even when the pressure applied to the charging roller 21 is low. In addition, irregular charging and an unstable operation are prevented, and the electrostatic attraction force produced by the friction charging can be greatly increased. Hence, both the contact area and the total electrostatic attraction force can be increased, a very reliable and stable operation is ensured.

Since the charging roller 21 is made of a conductive fiber brush roller having a resistance of $1\times10^{8}$ Ω·cm or lower, very uniform charging can be performed.

When the rotary drum makes one rotation and the sheet is fed thereto from a predetermined direction, the charging roller 21 is brought into contact with the overall length of the sheet M from the leading end to the trailing end thereof. The charging roller 21 can be separated from the sheet or peripheral surface 11 from that contact. With this structure, the charging roller 21 does not interfere with the sheet M electrostatically attracted and held or with the clamping claw or other parts of the rotary drum 10.

When the charging roller 21 is in the advancing (contact) state, the roller position controller 29 can press it against the drum peripheral surface 11 by utilization of the urging force (tension) of the spring 29SP. Hence, the tight contact of the sheet M with reference to the drum peripheral surface 11 can be further enhanced.

The sheet loader 90 has not only a sheet feed function but also a posture adjustment function and a supply standby function. Hence, the sheet M can be fed toward the rotary drum 10 without skewing and can be held on the drum 10. In addition, the feeding operation for the next sheet M can be completed during the printing operation of the preceding sheet M. Accordingly, the holding, rotating and conveying operation and the printing operation can be executed at very high speed.

The supplementary charger section 26 is provided to compensate for the electrostatic attraction force attenuation which occurs during the holding, rotating and conveying operation and during the printing operation. Accordingly, the holding, rotating and conveying operation can be performed in a further reliable manner.

The discharge section 70 is provided so that the electrostatic attraction force produced by the charging section 20 can be canceled after the holding, rotating and conveying operation (printing operation). With this structure, the mechanical separation (the release from the held state) can be executed smoothly.

In addition, since the sheet loader 90, the charger section 20, the supplementary charger section 26, the discharge section 70, the sheet separator 140 and the print head section 200 are arranged in the rotation direction of the rotary drum 10 in the order mentioned, the operations between the sheet feed and sheet separation can be successively performed in a very stable manner, with the charging operation executed in the meantime.

An ink-jet printer according to the eight embodiment of the present invention will now be described with reference to FIG. 23.

This ink-jet printer is designed such that a sheet M can be held on the peripheral surface 11 of a rotary drum (rotation drum 10) which rotates at a constant circumferential speed, by utilization of an electrostatic attraction force produced by a charging roller 21, such that printing can be performed for the sheet M in the rotating state by jetting ink from an ink jet nozzle 207, such that the charging roller 21 can contact the peripheral surface 11 of the rotary drum 10 or separate therefrom, at a position downstream of the position P at which the externally-fed sheet M first contacts the peripheral surface 11, and such that the charging roller 21 is independently rotatable at a predetermined circumferential speed in the state where the charging roller 21 is in direct or indirect contact with the peripheral surface 11.

Since this ink-jet printer has a substantially similar structure to that of the above-described embodiment, except on the points described below, similar or corresponding structural components will be denoted by the same reference numerals as used above, and a description of such structural components will be omitted or simplified.

Figure 23:
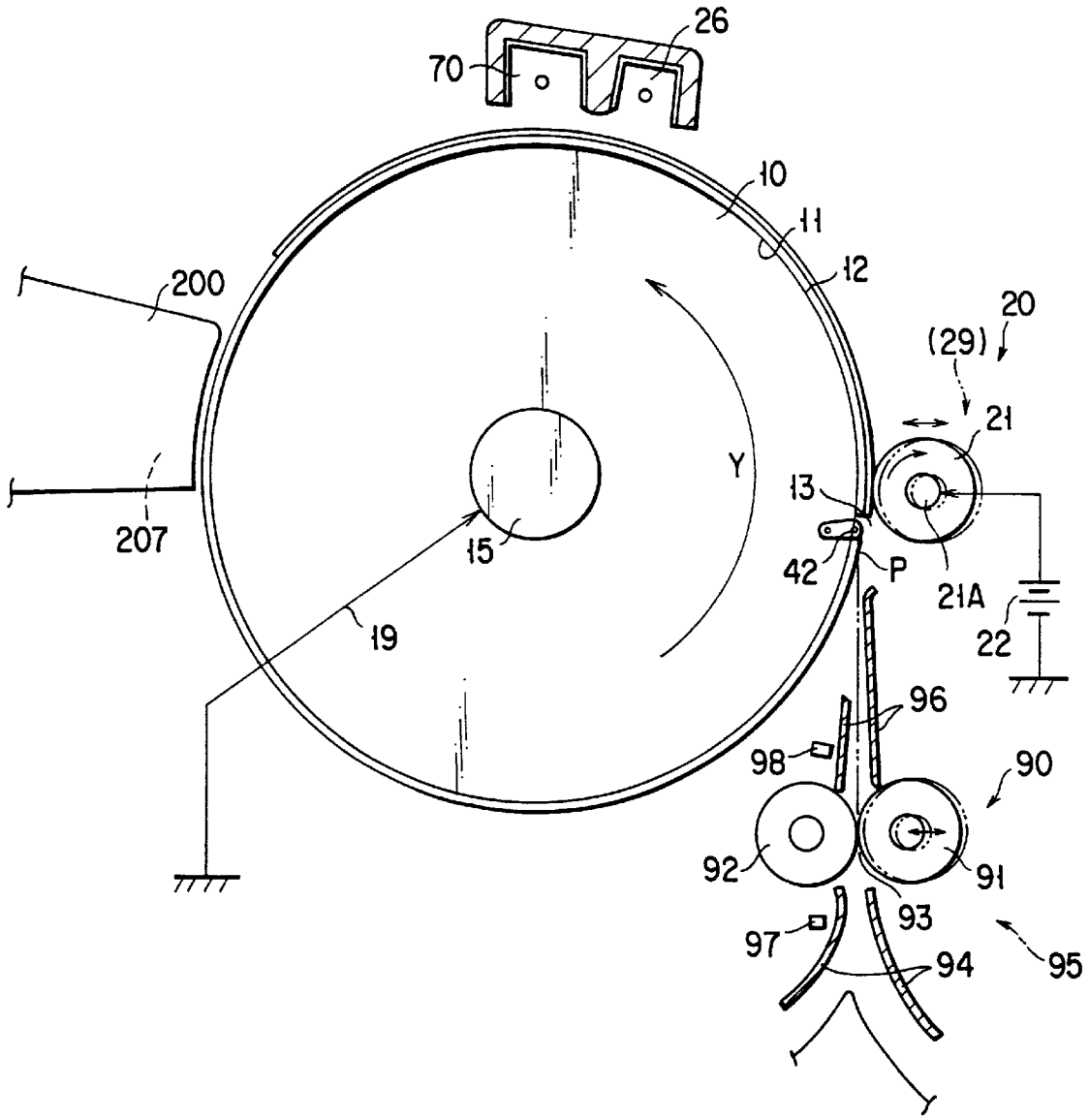
FIG. 23 is a view showing the structure of a sheet holding system incorporated in an ink-jet printer according to the eighth embodiment of the present invention.

Referring to FIG. 23, the rotary drum 10 is hollow and can be rotated at a constant circumferential speed of 120 rpm, which enables multicolor printing of 20 PPM. A shaft 15, around which the drum 10 rotates, is grounded by means of a grounding line 19.

A dielectric layer 12 having a resistance (volume resistivity) in the range of $1\times10^{12}$ Ω·cm to $1\times10^{20}$ Ω·cm is formed on the peripheral surface 11 of the rotary drum 10. This is for allowing the surface potential of the rotary drum 10 to be higher than a predetermined value (e.g. 500V or higher) after charging. According to the present embodiment, the dielectric layer is made of a 25 μm-thick Mylar (polyester film) sheet tightly pasted on the drum peripheral surface 11. A groove section 13, into which an auxiliary sheet holding system 41 (a clamping claw 42) can be fitted, is formed in part of the peripheral surface 11. Guides 16, 16 are employed to prevent the charging roller 21 from falling in the groove section 13.

Arranged around the rotary drum 10 are: a sheet loader 90, a charger section 20, a supplementary charger section 26 (a corona discharger), a discharge section 70 (a corona discharger), a sheet separator (not shown) and a print head 200. These structural components are arranged from upstream to downstream regions with respect to the rotating (Y) direction in the order mentioned.

The sheet holding system is made up of the charger section 20 and the clamp-claw holder section 41.

The sheet holding system is for permitting the entire sheet M to be held on the peripheral surface 11 of the rotary drum 10. The charger section 20 causes the sheet M to be electrostatically attracted and held by means of the charging roller 21.

The clamp-claw holder section 41 holds the leading end (indicated by Mf in FIG. 24) of the sheet M supplied to the peripheral surface 11 of the rotary drum 10 by the sheet loader 90. The clamp-claw holder section 41 need not be an electrostatic attraction type. For example, it may be a negative-pressure suction type, a mechanical clamping type, or an arbitrary combination of them.

Figure 24:
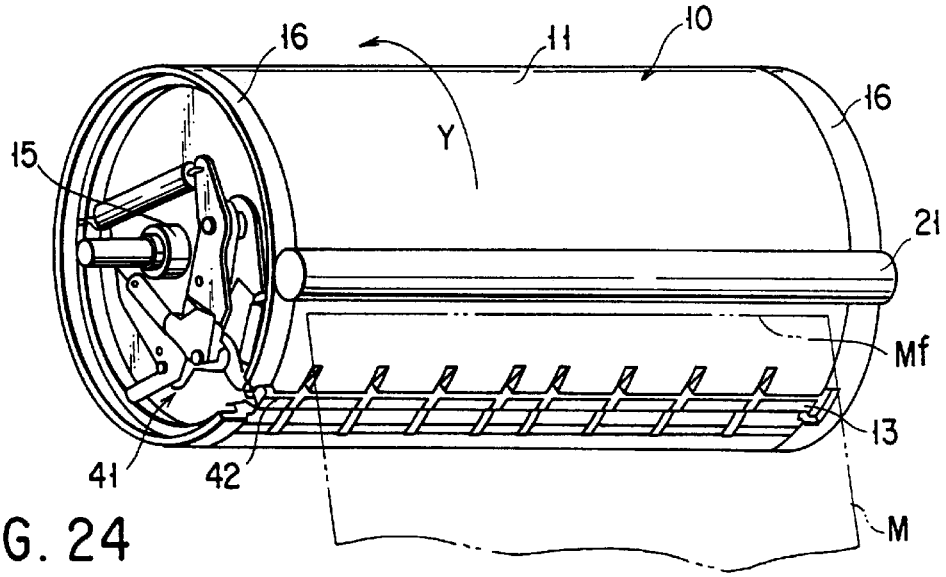
FIG. 24 is a view showing the outward appearance of the sheet holding system shown in FIG. 23.
Figure 25:
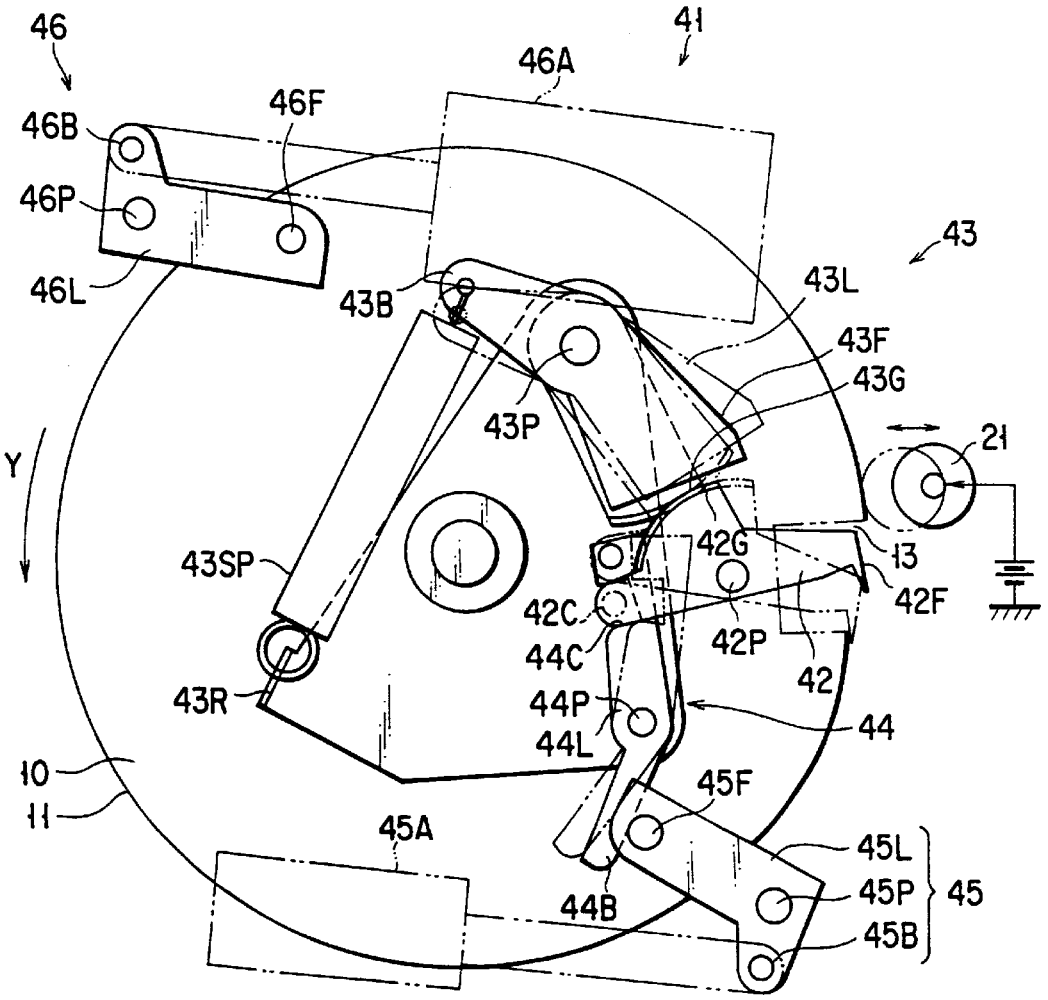
FIG. 25 is a view for explaining a clamping operation of a clamp-claw holder section shown in FIG. 24.
Figure 26:
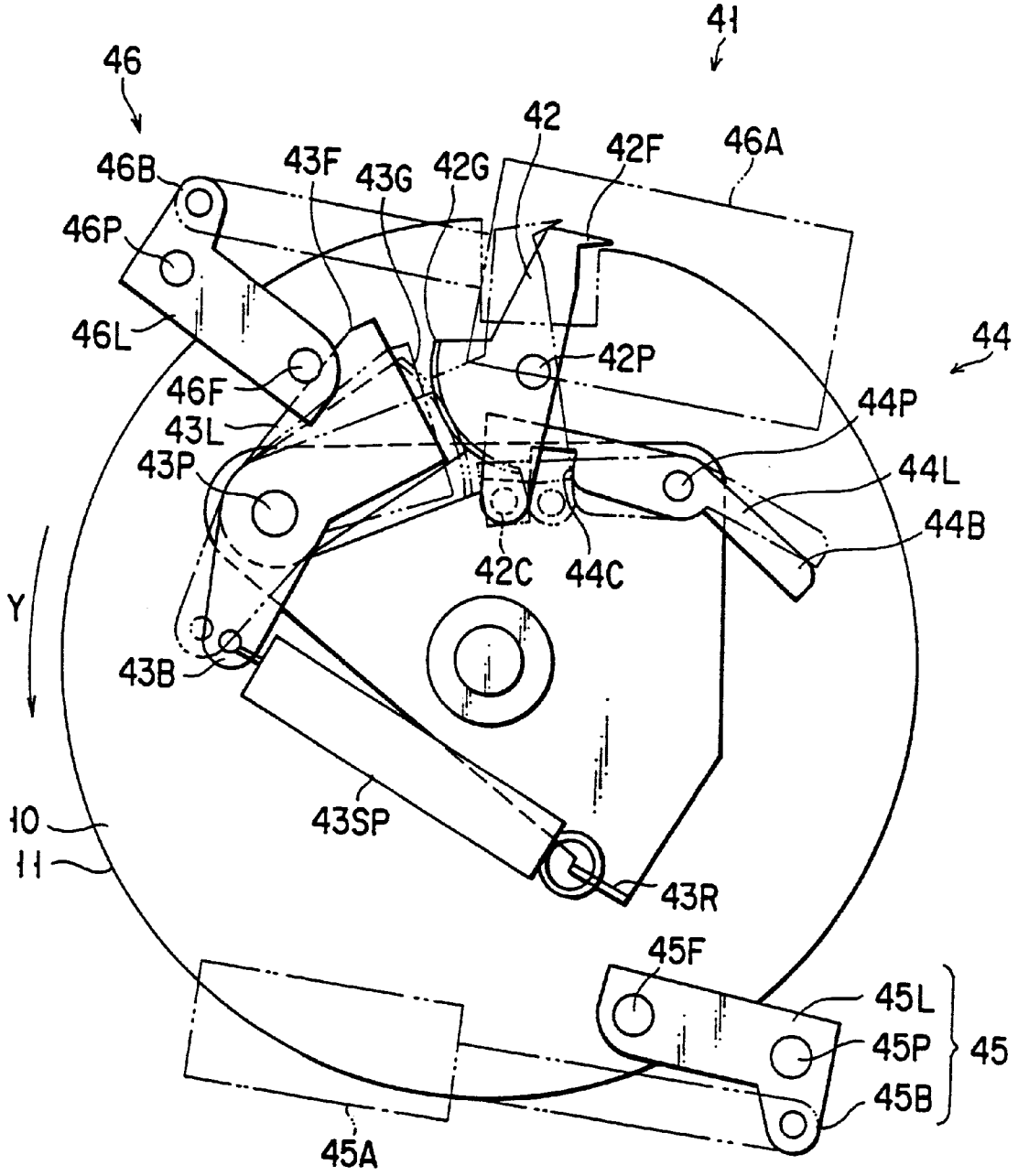
FIG. 26 is a view for explaining a releasing operation of the clamp-claw holder section shown in FIG. 24.

As shown in FIGS. 24–26, the clamp-claw holder section 41 is made up of: a clamping claw 42, a normally-clamping mechanism 43, a normally-releasing lock mechanism 44, a lock releasing mechanism 45 and a lock restoring mechanism 46. The clamping claw 42, normally-clamping mechanism 43, and normally-releasing lock mechanism 44 are provided for one side of the rotary drum 10 (movable member), while the lock releasing mechanism 45 and the lock restoring mechanism 46 are provided for a bracket (not shown) of the casing of the main body. The lock releasing mechanism 45 and the lock restoring mechanism 46 make good use of the rotation of the rotating member 10 (to be more specific, the rotational position [angle] of the rotary drum 10). They operate in association with both the normally-clamping mechanism 43 and the normally-releasing lock mechanism 44 in such a manner that the clamping claw 42 performs a clamping operation and stops that operation.

The clamping claw 42 includes a claw 42F, an engagement section 42C and a sector gear 42G. Inside the groove section 13, the clamping claw 42 is rotatable around pin 42P. The normally-clamping mechanism 43 is made up of: a lever 43L rotatable around pin 43P (the proximal end of the lever is 43B, and the tip end thereof is 43F); a sector gear 43G provided at the tip end 43F of the lever 43L and in mesh with the sector gear 42G; and a spring 43SP stretched between the proximal end 43B and a fixed point 43R. By utilization of the urging force (tension) provided by the spring 43P, the clamping claw 42 is normally in the clamping state indicated by the two-dot-dash line in FIG. 3.

The normally-releasing lock mechanism 44 is made of a lock lever 44L, which is rotatable with pin 44P as a center. The lock lever 44L has an engagement groove 44C which is engageable or separatable from the engagement section 42C of the clamping claw 42. Owing to the engagement between 44C and 42C, the clamping claw 42 can be kept in the clamp-released state indicated by the solid line in such a manner that a locking operation can be performed at any time.

The lock releasing mechanism 45 is made up of: a lever 45L which is rotatable around a pin 45P provided on the stationary side (the tip end of that lever is 45F, and the proximal end thereof is 45B); and an actuator 45A. When, with this actuator 45A, the lever 45L is rotated clockwise around the pin 45P, the pin at the tip end 45F of the lever engages with the proximal end 44B of the lock lever 44L which comes in accordance with the rotation of the rotary drum 10. In response to this engagement, the lock lever 44L rotates clockwise, thus releasing the engagement with the clamping claw 42 (42C). As a result, the clamping claw 42 is set in the clamp-enabled state due to the urging force of the spring 43SP. In this manner, the normally-released lock state can be canceled.

As shown in FIG. 26, the lock restoring mechanism 46 is made up of: a lever 46L which is rotatable around a pin 46P provided on the stationary side (the tip end of that lever is 46F, and the proximal end thereof is 46B); and an actuator 46A. When, with this actuator 46A, the lever 46L is rotated clockwise around the pin 46P, the lever 43L, which comes close in accordance with the rotation of the rotary drum 10, presses the pin at the tip end 46F of the lever 46L. In addition, the sector gears 43G and 42G operate in such a manner that the clamping claw 42 is in the clamp-releasing state indicated by the two-dot-dash line. As a result, the engagement section 42C of the clamping claw 42 is brought into engagement with the engagement groove 44C of the lock lever 44L (44F). In this manner, the normally clamping lock state of the clamping claw 42 can be restored.

The sheet holding system is made of a charger section 20 (a charging roller 21 and a power supply unit 22). The charger section 20 is brought into direct contact with the sheet M and provides that sheet with positive charges. By utilization of the electrostatic attraction force generated between the sheet M and the grounded rotary drum 10, the charger section 20 causes the sheet M to be entirely attracted and held on the peripheral surface 11.

The charging roller 21 is made of a conductive rubber roller, and the resistance between the peripheral surface of the roller and the shaft 24 is $1\times10^{6}$ Ω·cm or lower. Through the shaft 24, the charging roller 21 is powered or applied with a voltage by the power supply unit 22 in such a manner that the charging roller 21 has positive charges (e.g., DC 1.5 kV). As the conductive rubber, polyurethane rubber (polyester isocyanate), silicone rubber, or the like is selected. In the case of this embodiment, conductive polyurethane rubber is used.

The charging roller 21 is rotated by a charging roller motor (not shown) controlled by a control unit 250. The charging roller 21 is rotatable at a circumferential speed that is independent of the drum circumferential speed in the state where it is in direct contact with the drum peripheral surface 11 or in indirect contact therewith, with a sheet M interposed.

To be more specific, the circumferential speed of the charging roller 21 is so determined as to be within the range of 99.98 to 98.00% of the drum circumferential speed. Since the circumferential speed of the charging roller 21 is made to differ from the drum circumferential speed, a tension (a roll-out effect) is produced. By utilization of this, the sheet M is prevented from being wrinkled or bent and from separating from the drum circumference. In addition, the amount of friction charging can be increased. Hence, it can be understood that the charging roller 21 serves not only as a friction charger but also a mechanical ironing means.

The charging roller 21 can contact the peripheral surface 11 or separate therefrom, at a position downstream of the position P with respect to the drum rotating (Y) direction. The position P is a position at which a sheet M (i.e., a sheet fed from element 90) first contacts the peripheral surface 11.

In relation to this, the clamp-claw holder section 41 holds the leading end of the sheet M on the drum peripheral surface 11 before the sheet M is held by electrostatic attraction. The leading end is held by utilization of a mechanical holding force, not an electrostatic attraction force.

The corona discharger of the supplementary charger section 26 adds charges to the sheet M, which is electrostatically held on the peripheral surface 11 of the rotary drum 10 by the electrostatic attraction force produced by the charging roller 21, in such a manner that the attenuation in the electrostatic attraction force is supplemented. To be more specific, the corona discharger removes positive charges by application of a voltage of 4 (+2, −0) kV, for example. In this manner, the corona discharger maintains a constant electrostatic attraction force by compensating for charge attraction attenuation which occurs during the rotation of the rotary drum 10 (particularly when a printing operation is executed by the print head section 200).

The discharger section 70 (corona discharger) cancels the electrostatic attraction force before the sheet separator separates the sheet M from the peripheral surface 11.

The sheet loader 90 is made up of a pair of loading rollers 91 and 92, and has not only a sheet feed function of feeding sheets toward the rotary drum 10, but also a posture adjustment function and a supply standby function for the sheet M.

The leading end of the sheet M fed from the downward region, as viewed in FIG. 23, collide with the contact portion 93 of the rollers 91 and 92, and is elastically deformed inside a guide 94 arranged upstream. Therefore, the leading end of the sheet M is aligned in parallel with the shaft 15 of the rotary drum 10, and in this state it can be loaded without skewing. Inside the guide 94, the elastically recovering force of the sheet M promotes the posture adjustment. A sheet sensor 97 detects whether or not the sheet M enters into the posture adjustment process.

After the end of the posture adjustment, the loading rollers 91 and 92 move a sheet M along downstream-side guide 96 toward the rotary drum 10 until the leading end of the sheet M comes to the position detectable by a sheet sensor 98. Since the leading end of the sheet M is clamped by the loading rollers 91 and 92, the trailing end of the sheet M can be released from the cassette feeder 71 or the manual feeder 61 located under the guide 94. The feeding step for the next sheet M has come to an end by this point of time, and the supply standby state toward the rotary drum 10 is established. This is effective in increasing the printing speed.

The sheet M can be supplied to the peripheral surface 11 of the rotary drum 10 at a predetermined timing. Let us assume that the feed position at which the fed sheet M first contacts the rotary drum 10, i.e., the loading point on the peripheral surface 11, is indicated by P. After the leading end Mf of the fed sheet M is held on the peripheral surface 11 (dielectric layer 12) by means of the clamping claw 42 of the clamp-claw holder section 41, one of the rollers (namely, roller 91) is moved in the rightward direction by a roller position controller 95, as indicated by the two-dot-dash line in FIG. 23. Since the trailing end of the sheet M is therefore set in the free state, no load is imposed on the rotation or conveyance performed by the rotary drum 10. Incidentally, the roller position controller 95 is designed in a similar manner to that of a roller position controller 29.

The control unit 250 includes a CPU, a ROM, a RAM, etc., and can drive or control the entire printer. Of the structural components of the control unit 250, those which do not have direct relevance to the subject printer are not illustrated.

In the case of the present embodiment, when the power supply is switched on, the control unit 250 actuates a main motor 10M. When a rotational position detector 10S detects that the rotary drum 10 has reached the predetermined rotational position (angle), the control unit 250 drives the sheet loader 90 so as to feed the sheet M, which is then in the supply standby state, toward the rotary drum 10 shown in FIG. 21. The sheet M is fed at a moving speed corresponding to the circumferential speed of the drum.

When the leading end Mf of the fed sheet M reaches the loading point shown in FIG. 23, the clamp-claw holder section 41 (the lock releasing mechanism 45 and the normally-clamping mechanism 43) is actuated, and the leading end of the sheet is clamped by the clamping claw 42.

When the leading end of the sheet M has been held (this state is confirmed based on the output signals from the rotational position detector 10S in the case of the present embodiment), the control unit 250 actuates the roller position controller 95 such that one of the loading rollers of the sheet loader 90 (namely, roller 91) to the position indicated by the two-dot-dash line in FIG. 23. Since the trailing end of the sheet M is released from the rollers 91 and 92, no load is imposed on the rotation or conveyance performed by the rotary drum 10.

Before or after this operation (alternatively, concurrently therewith), the roller position controller 29 is driven so as to advance the charging roller 21 from the position of the two-dot-dash line in FIG. 23 to the position of the solid-line line in the same FIGURE. That is, the advancing movement of the charging roller 21 is executed no later than a time which is immediately before the loading point P comes close. The charging roller 21 is rotated independently and is pressed against the drum peripheral surface 11 (dielectric layer 12) by the urging force (tension) of the spring 29SP such that the pressure applied is constant. Through the shaft 24, the charging roller 21 is provided with positive charges by the power supply unit 22.

Therefore, when the leading end Mf (the loading point P) of the fed sheet M has entered the region between the charging roller 21 (which is rotated at an independent circumferential speed) and the dielectric layer 12 (which is rotated at the drum circumferential speed), the sheet M can be charged. Of the leading end portions of the sheet M, those portions subsequent to the portion clamped by the clamping claw 42 are charged to have positive charges, and the electrostatic attraction produced thereby permits the sheet M to be promptly attracted and held on the peripheral surface 11 of the rotary drum 10.

Subsequently, the charging roller 21 is pressed against the drum peripheral surface 11 by the urging force of the spring 29SP, and the sheet M is charged while being rolled out toward the trailing end thereof. That is, the sheet M is held on the drum peripheral surface 11 by utilization of the charge attraction force. The independent circumferential speed of the charging roller 21 is, for example, 99% of the drum circumferential speed. Therefore, the sheet M is prevented from being wrinkled, curved or deformed, and the tight contact is ensured, thus enabling a stable holding operation.

Since the charging roller 21 is made of a conductive polyurethane rubber roller, and is pressed tightly against the dielectric layer 12, an increased nip width N can be provided. Therefore, irregular charging is prevented, and stable charging is ensured. In addition, since the charges produced by friction charging can also be utilized, the sheet M can be held further reliably. Moreover, since the dielectric layer 12 has a very high electric resistance, the charging efficiency is remarkably high. The sheet M is attracted and held on the drum peripheral surface 11 by the electrostatic attraction force alone, and rotated and fed in the Y direction.

While the rotary drum 10 thereafter makes four rotations (second to fifth rotations), ink is jetted from the print head section 200, and printing is executed with respect to the sheet M that is being rotated and fed. The supplementary charger section 26 operates during this interval and maintains a constant electrostatic attraction force. The control unit 250 drives the sheet loader 90 so as to set the next sheet M into the supply standby state.

Multi-color printing is executed with respect to a sheet M (e.g., a A4 -size sheet) during four rotations of the rotary drum 10. After the end of this printing operation, the control unit 250 causes the discharge section 70 to remove the electrostatic attraction force from between the printed sheet M and the dielectric layer 12. The control unit 250 further causes the sheet separator to mechanically separate the leading end of the printed sheet M. The separated sheet M is transferred to a sheet feed-out mechanism 160 by the sheet separator 140, which also functions as a transfer means.

According to the present embodiment, a sheet M can be held on the peripheral surface 11 of the rotary drum 10 (which rotates at a constant circumferential speed) by utilization of an electrostatic attraction force produced by the charging roller 21. Printing is executed by jetting ink from the ink jet nozzle 207 to the sheet M in the rotating state. The charging roller 21 can contact the peripheral surface 11 of the rotary drum 10 or separate therefrom, at a position downstream of the position P with respect to the drum rotating (Y) direction. The position P is a position at which the sheet M first contacts the peripheral surface 11. In addition, the charging roller 21 is rotatable at an independent circumferential speed in the state where it is in direct contact with the drum peripheral surface 11 or in indirect contact therewith, with the sheet M interposed. Owing to this structure, wrinkles, and deformation are prevented, and the entire sheet M can be brought into uniform and tight contact with the peripheral surface 11. In addition, since the frictional charging efficiency is enhanced, the sheet M can be held reliably and stably, and high-speed printing can be executed in a very stable manner.

Since the charging roller 21 is made of a conductive polyurethane rubber roller, the charging efficiency is enhanced and an increased nip width can be provided. Accordingly, the sheet M is prevented from being wrinkled, bent and deformed, and is further prevented from separating from the peripheral surface. In addition, the amount of friction charging can be increased.

Since the charging roller 21, formed of conductive polyurethane rubber, is provided with positive charges by way of the shaft 24, the power feeding mechanism is simple in structure and small in size.

Since the resistance between the peripheral surface of the charging roller 21 and the shaft 24 is $1\times10^{6}$ Ω·cm or lower, the charging efficiency is enhanced and a stable feeding operation is ensured.

Since the circumferential speed of the charging roller 21 is 99.98 to 98.00% of that of the rotary drum 10, the roll-out effect is enhanced and the amount of frictional charging is increased. Accordingly, the electrostatic attraction force can be increased.

Since a dielectric layer having a resistance in the range of $1\times10^{12}$ Ω·cm to $1\times10^{20}$ Ω·cm is formed on the peripheral surface 11 of the rotary drum 10, the charging efficiency can be increased further.

Before the sheet M is electrostatically attracted and held, the auxiliary sheet holding system (41) causes the leading end of the sheet to be held on the peripheral surface 11 by utilization of a holding force other than an electrostatic attraction force (that is, a clamping force). Due to the use of the auxiliary sheet holding system (41), the leading end Mf of the sheet can be reliably held on the peripheral surface 11. With this structure, the tension (the roll-out effect) produced by the charging roller 21 and acting rearward and the amount of friction charging can be remarkably increased. Moreover, the charging roller 21 can be driven in such a manner that its circumferential speed difference with reference to the rotary drum 10 is in a wide range.

The roller position controller 29 causes the charging roller 21 to be pressed with a certain pressure by utilization of the urging force of the spring 29SP. Since, with this structure, the charging roller 21 is allowed to have not only a charging function but also a roll-out function, the charging efficiency is enhanced and the wrinkle preventing effect and other advantages are made reliable and stable.

The clamp-claw holder section 41 comprises a normally-clamping mechanism 43, a normally-releasing lock mechanism 44, a lock releasing mechanism 45 and a lock restoring mechanism 46, and utilizes the rotation of the rotary drum 10 and the position (angle) thereof so as to causes the clamping claw 42 to perform a clamping operation or release that clamping operation. Accordingly, the sheet loader 90 and the sheet separator can perform a clamping operation and a clamp-releasing (separating) operation at accurate positions and at accurate timings.

An ink-jet printer according to the ninth embodiment of the present invention will now be described.

This ink-jet printer is designed such that a sheet M can be attracted and held on the peripheral surface 11 of a rotary drum which rotates at a constant circumferential speed, by utilization of an electrostatic attraction force, such that printing can be performed for the sheet M held on the drum peripheral surface by jetting ink from a print head section 200, and such that the drum peripheral surface 11 is overlaid with a semi-conductive insulating layer 12 and the charger section is made of a conductive rubber roller 23 having a low electric resistance.

Since this ink-jet printer has a substantially similar structure to that of the above-described embodiment, except on the points described below, similar or corresponding structural components will be denoted by the same reference numerals as used above, and a description of such structural components will be omitted or simplified.

In the ink-jet printer, a rotary drum 10 comprises the semi-conductive insulating layer 12 described above, which constitutes the peripheral surface 11 and has a resistance (volume resistivity) in the range of $1\times10^{10}$ Ω·cm to $1\times10^{12}$ Ω·cm. This is for allowing the surface potential of the rotary drum 10 to be higher than a predetermined value (e.g. 500V or higher) after charging. The semi-conductive insulating layer 12 is made of a 25 μm-thick Mylar (polyester film) sheet tightly pasted on the rotary drum 10.

A charger section 20 is made up of: a charging roller 21 which is selectively switchable by a roller position controller 29 between the solid line state (contact) shown in FIG. 23 and the two-dot-dash line state (separated) also shown in the same Figure, and which is capable of directly charging the sheet M (or the semi-conductive insulating layer 12) when it is in the contact state; and a power supply unit 22 which applies a voltage (e.g., DC+1.5 kV) to the charging roller 21. The charging roller 21 is a conductive rubber roller having a resistance (volume resistivity) of $1\times10^{6}$ Ω·cm or lower. It enhances the charging efficiency and the pressing characteristics. As the conductive rubber, polyurethane rubber, silicone rubber, or the like is employed. In the case of the present embodiment, polyurethane rubber is adopted.

A supplementary charger section 26, which constitutes a sheet holding system together with the charger section 20, is made of a corona discharger capable of removing positive charges by application of a voltage of 4 kV, for example. The corona discharger adds charges to the sheet M and maintains a constant electrostatic attraction force by compensating for charge attraction attenuation which occurs during the rotation of the rotary drum 10 (particularly when a printing operation is executed by the nozzle head 200).

A roller position controller 29 advances or retreats under the control performed by a control unit 250. At least the advancing movement is started at such a timing as will permit the leading end of the sheet M to be charged immediately after the charging roller 21 contacts the drum peripheral surface 11.

When the power supply is switched on, the control unit 250 actuates a main motor 10M. When a rotational position detector 10S detects that the rotary drum 10 has reached the predetermined rotational position (angle), the control unit 250 drives a sheet loader 90 so as to feed the sheet M, which is then in the supply standby state, toward the rotary drum 10 shown in FIG. 23. The sheet M is fed at a moving speed corresponding to the circumferential speed of the drum.

Prior to this (or simultaneous with this), the roller position controller 29 is driven so as to advance the charging roller 21 from the two-dot-dash line state to the solid line state shown in FIG. 23. The charging roller 21 is brought into contact with the drum peripheral surface 11 (semi-conductive insulating layer 12) with a certain pressure produced by the urging force (tension) of a spring 29SP. When or immediately before the charging roller 21 contacts the sheet M, the control unit 250 turns on the power supply unit 22 so as to apply a voltage to the charging roller 21.

Therefore, when the leading end of the fed sheet M has entered the region between the charging roller 21 (which is a driven member rotated in accordance with the rotation of the rotary drum 10) and the semi-conductive insulating layer 12, the sheet M can be charged. The leading end of the sheet M is charged, and the electrostatic attraction produced thereby permits the sheet M to be promptly attracted and held on the peripheral surface 11 of the rotary drum 10.

When the leading end of the sheet M has been held (this state is confirmed based on the output signals from the rotational position detector 10S in the case of the present embodiment), the control unit 250 moves one 91 of the loading rollers of the sheet loader 90 to the position indicated by the two-dot-dash line in FIG. 1. Since the trailing end of the sheet M is released from the rollers 91 and 92, no load is imposed on the rotation or conveyance performed by the rotary drum 10.

In this manner, the sheet M is pressed against the semi-conductive insulating layer 12 of the rotary drum 10 by the conductive rubber roller 23 having a resistance of $1\times10^{6}$ Ω·cm or lower, and is charged thereby. Accordingly, the sheet M is in tight contact with the drum peripheral surface 11 (the semi-conductive insulating layer 12), and is rotated and fed in the Y direction in accordance with the rotation of the rotary drum 10.

The sheet M is electrostatically attracted and held on the semi-conductive insulating layer 12 having a resistance in the range of $1\times10^{10}$ to $1\times10^{12}$ Ω·cm. Even when printing operations are successively performed, the semi-conductive insulating layer 12 cannot be charged too much, and residual charges are led to the ground. Accordingly, the sheet M can be held on the rotary drum in a reliable and stable manner.

When the rotational position detector 10S detects (or confirms) that the trailing end of the sheet M has passed the charging roller 21 during one rotation of the rotary drum 10, the charging roller 21 is retreated to the two-dot-dash line position shown in FIG. 1 by the roller position controller 29, and is therefore separated from the sheet M (i.e., from the semi-conductive insulating layer). Accordingly, the sheet M is attracted and held on the drum peripheral surface 11 due to the action of the electrostatic attraction force alone, and is rotated and fed in the Y direction.

While the rotary drum 10 thereafter makes four rotations (second to fifth rotations), ink is jetted from the print head section 200 to the sheet M, whereby printing is executed with respect to the sheet M that is being rotated and fed. In the meantime, the supplementary charger section 26 operates in such a manner as to keep the electrostatic attraction force constant. The control unit 250 causes the sheet loader 90 to set the subsequent sheet M in the standby condition.

Multi-color printing for a sheet of e.g. A4 size is finished when the rotary drum 10 has made four rotations. After this printing operation, the control unit 250 causes the sheet separator 140 to mechanically separate the leading end of the printed sheet M. The separated sheet M is fed to a sheet feed-out mechanism 160 by the sheet separator 140.

According to the present embodiment, the rotary drum 10 is capable of rotating at a constant circumferential speed. The charger section 20 charges a sheet M so that it can be electrostatically attracted and held on the peripheral surface 11 of the rotary drum 10. The print head (200) can jet ink toward the sheet M held on the drum peripheral surface 11. A semi-conductive insulating layer 12 having a resistance in the range of $1\times10^{10}$ Ω·cm to $1\times10^{12}$ Ω·cm is formed on the drum peripheral surface 11. The semi-conductive insulating layer 12 is grounded, and the charger section 20 is made of a conductive rubber roller 23 which has a resistance of $1\times10^{6}$ Ω·cm or lower and which can charge the sheet M while being pressed against the semi-conductive insulating layer 12 of the rotary drum 10. With this structure, the sheet M can be attracted and held on the rotary drum 10 in a reliable and stable manner, and high-quality printing can be executed in a stable manner.

In addition, a contact/separation section is provided, by which the charger section 20 can be pressed against the drum peripheral surface 11 and can be separated therefrom. When the rotary drum 10 is rotating for the printing and sheet-releasing operations, the charger section 20 is kept at a position away from the rotary drum 10. With this structure, the sheet M which is being printed or released is not interfered with, and printing and sheet-releasing operations can be performed very smoothly.

The present invention concerns an ink-jet printer wherein a sheet held on a rotary drum as a print medium is printed by jetting ink thereto. The present invention enables the print medium to be held on the rotary drum reliably and stably, with no need to employ a complicated structure.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer comprising:

a rotary drum, having a dielectric peripheral surface, for rotating at a constant speed;

a medium supply section for feeding a print medium to the rotary drum;

a medium holding system for causing the print medium to be held on the peripheral surface of the rotary drum; and a print head section for printing an image by jetting ink onto the print medium held on the peripheral surface of the rotary drum while the rotary drum makes a predetermined number of rotations;

wherein said medium holding system includes an elastic charging roller for charging the print medium fed by the medium supply section such that the print medium is attracted on the rotary drum with an electrostatic attraction force produced by the charging of the print medium, and roller pressing means for applying mechanical pressure to the charging roller to increase a nip width of the charging roller which presses the print medium against the peripheral surface of the rotary drum.

2. An ink-jet printer according to claim 1, wherein said rotary drum includes a dielectric layer having a resistance of $1\times10^{12}$ to $1\times10^{20}$ Ω·cm and serving as said peripheral surface, and said charging roller is a conductive rubber roller having a resistance of $1\times10^{6}$ Ω·cm or lower and a hardness of 20±5 degrees.

3. An ink-jet printer according to claim 1, wherein said pressing means is arranged to maintain the charging roller at a position away from the rotary drum when no print medium is present on the peripheral surface of the rotary drum.

4. An ink-jet printer according to claim 1, wherein said charging roller is formed to rotate independently of rotation of the rotary drum.

5. An ink-jet printer according to claim 4, wherein said rotary drum includes a dielectric layer having a resistance of $1\times10^{12}$ to $1\times10^{20}$ Ω·cm and serving as said peripheral surface.

6. An ink-jet printer according to claim 5, wherein said charging roller is a conductive low-expansion foaming rubber roller having a resistance of $1\times10^{6}$ Ω·cm or lower.

7. An ink-jet printer according to claim 5, wherein said charging roller is a conductive fiber brush roller having a resistance of $1\times10^{8}$ Ω·cm or lower.

8. An ink-jet printer according to claim 4, wherein said pressing means is arranged such that the charging roller is continuously brought into contact with the print medium from leading and trailing ends thereof while the rotary drum makes one rotation with the print medium held thereon, and separated from the rotary drum thereafter.

9. An ink-jet printer according to claim 1, wherein said charging roller is formed to be rotatable at an independent speed in a state where the charging roller is in direct or indirect contact with the peripheral surface of the rotary drum.

10. An ink-jet printer according to claim 9, wherein said charging roller is a conductive rubber roller.

11. An ink-jet printer according to claim 10, wherein said conductive rubber roller is set at a positive potential through a shaft.

12. An ink-jet printer according to claim 11, wherein said conductive rubber roller has a resistance of $1\times10^{6}$ Ω·cm or lower in a range between a peripheral surface of the conductive rubber roller and the shaft.

13. An ink-jet printer according to claim 9, wherein a circumferential speed of the charging roller is determined to be within 99.98 to 98.00% of a circumferential speed of the rotary drum.

14. An ink-jet printer according to claim 9, wherein said rotary drum includes a dielectric layer having a resistance of $1\times10^{12}$ to $1\times10^{20}$ Ω·cm and serving as said peripheral surface.

15. An ink-jet printer according to claim 9, wherein said medium holding system further includes an auxiliary holding means for holding a leading end of the print medium to the peripheral surface of the rotary drum with a holding force other than an electrostatic attraction force after the print medium is fed to the rotary drum by the medium supply section and before the print medium is charged by the charging section.

16. An ink-jet printer according to claim 1, wherein said rotary drum includes a semi-conductive insulating layer having a resistance of $1\times10^{12}$ to $1\times10^{20}$ Ω·cm, serving as said peripheral surface and set to a ground potential, and said charging roller is a conductive rubber roller having a resistance of $1\times10^{6}$ Ω·cm or lower.

17. An ink-jet printer according to claim 16, wherein said roller pressing means is arranged to maintain the charging roller at a position away from the rotary drum in a period from a time when printing for the print medium is started to a time when the print medium is discharged.

* * * * *